US007194956B2

(12) United States Patent
Mori et al.

(10) Patent No.: US 7,194,956 B2
(45) Date of Patent: Mar. 27, 2007

(54) OFFSET PRINTING METHOD AND PRINTING APPARATUS USING HEAT AND LIGHT TO MAKE A PRINTING PLATE HYDROPHILIC AND HYDROPHOBIC

(75) Inventors: Nobufumi Mori, Kanagawa (JP); Takao Nakayama, Shizuoka (JP); Takashi Nakamura, Kanagawa (JP); Koji Kamiyama, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/937,757

(22) Filed: Sep. 10, 2004

(65) Prior Publication Data

US 2005/0028698 A1 Feb. 10, 2005

Related U.S. Application Data

(62) Division of application No. 10/745,983, filed on Dec. 29, 2003, now Pat. No. 6,892,640, which is a division of application No. 09/484,281, filed on Jan. 18, 2000, now Pat. No. 6,694,880.

(30) Foreign Application Priority Data

Jan. 18, 1999 (JP) ..... P.11-9478
Jan. 18, 1999 (JP) ..... P.11-9479
Jan. 22, 1999 (JP) ..... P.11-14561
Jan. 22, 1999 (JP) ..... P.11-14562

(51) Int. Cl.
*B41C 1/10* (2006.01)

(52) U.S. Cl. ..... 101/467; 101/478; 101/453; 101/454; 101/456; 101/463.1; 101/465; 101/466; 430/302

(58) Field of Classification Search ..... 101/453, 101/454, 456, 463.1, 465–467, 478; 430/302
See application file for complete search history.

(56) References Cited

U.S. PATENT DOCUMENTS

| | | | |
|---|---|---|---|
| 4,034,183 | A | 7/1977 | Uhlig |
| 4,081,572 | A | 3/1978 | Pacansky |
| 4,693,958 | A | 9/1987 | Schwartz et al. |
| 4,718,340 | A | 1/1988 | Love, III |
| 5,713,287 | A | 2/1998 | Gelbart |
| 5,836,249 | A | 11/1998 | Chatterjee et al. |

(Continued)

FOREIGN PATENT DOCUMENTS

DE 198 17 756 A1 11/1998

(Continued)

*Primary Examiner*—Judy Nguyen
*Assistant Examiner*—Joshua Zimmerman
(74) *Attorney, Agent, or Firm*—Sughrue Mion, PLLC

(57) ABSTRACT

There is prepared a printing plate on which a material being hydrophilic due to light energy at a first temperature and being hydrophobic at a second temperature due to heat energy which is lower than the first temperature is provided. First, the whole surface of the printing plate is forcibly made either one of hydrophobic or hydrophilic. Next, a region having the other nature out of hydrophobic and hydrophilic is formed so as to correspond to an image to be printed. Then, ink is supplied onto the region having hydrophobic nature to conduct offset printing.

13 Claims, 5 Drawing Sheets

U.S. PATENT DOCUMENTS

| | | | | |
|---|---|---|---|---|
| 5,839,370 | A * | 11/1998 | Chatterjee et al. | 101/467 |
| 5,925,496 | A | 7/1999 | Ghosh et al. | |
| 6,048,654 | A | 4/2000 | Nakayama et al. | |
| 6,079,331 | A | 6/2000 | Koguchi et al. | |
| 6,082,263 | A | 7/2000 | Koguchi et al. | |
| 6,318,264 | B1 | 11/2001 | D'Heureuse et al. | |

FOREIGN PATENT DOCUMENTS

| | | |
|---|---|---|
| EP | 0 652 483 A1 | 5/1995 |
| EP | 0 903 223 A1 | 3/1999 |
| EP | 911154 | 4/1999 |
| EP | 911155 | 4/1999 |
| EP | 963839 | 12/1999 |

* cited by examiner

OFFSET PRINTING METHOD AND PRINTING APPARATUS USING HEAT AND LIGHT TO MAKE A PRINTING PLATE HYDROPHILIC AND HYDROPHOBIC

This is a divisional of application Ser. No. 10/745,983 filed on Dec. 29, 2003 now U.S. Pat. No. 6,892,640, which is a divisional of U.S. application Ser. No. 09/484,281 filed Jan. 18, 2000, now U.S. Pat. No. 6,694,880. The entire disclosure of these prior applications are herein incorporated by reference.

BACKGROUND OF THE INVENTION

The present invention relates to a new offset printing method and a printing plate for use in a usual light-load printing field, particularly in an offset printing operation, and more particularly to an offset printing method and a printing plate capable of easily making a printing plate. More particularly, the present invention relates to an offset printing method with which a printing plate can repeatedly be reused. The present invention also relates to the above printing plate and a printing apparatus using the above printing method.

The offset printing method has a process for making a printing plate which is very simple among a multiplicity of printing methods. Therefore, the offset printing method has usually been employed as a main printing means at present. The foregoing printing technique is structured to use the immiscibility between oil and water. An oil material, that is, ink is selectively maintained in an image region, while dampening water is selectively maintained in non-image regions. Therefore, direct contact with a surface on which an image will be printed or contact with the same through an intermediate medium, called a "blanket" causes ink in the image portion to be transferred. Thus, printing is performed.

The offset printing operation is mainly performed by a method using a PS plate incorporating a support member which is an aluminum substrate and on which a diazo photosensitive layer has been formed by coating. The PS plate is configured such that the surface of the aluminum substrate, which is the support member, is grained, subjected to anode oxidation and other processes to improve the receiving performance and a repulsion characteristic of the non-image portion against ink. Thus, printing resistance is raised and the printing surface is made to be precise. Then, an image, which must be printed, is formed on the printing surface. Therefore, the offset printing has characteristics including simplicity, printing resistance and precise printing surface.

Since the precise characteristic has been attained to the offset printing method, the offset printing method has widely been used in a usual printing field. On the other hand, the offset printing method has been required to have a furthermore simplified structure. Thus, a variety of simple offset printing methods have been suggested.

A representative method of the simple offset printing method is a method using "Copyrapid" offset printing plate marketed by Agfa-Gevaert Ltd. Moreover, printing methods of the foregoing type have been disclosed in U.S. Pat. No. 3,511,656 and Japanese Patent Publication No. 7-56351A. The disclosed method is arranged to make a printing plate by a silver-salt diffusion transfer method. The foregoing method is able to form an image, which must be transferred, in only one step. Moreover, the image, which must be transferred, has a lipophilic nature. Therefore, the foregoing image can directly be used as the printing plate. Hence it follows that the foregoing printing method has been put into practical used as a simple printing method. However, the foregoing simple method requires a diffusion transfer development step using alkaline developing solution. Therefore, there is a requirement for a simple printing method which does not require a developing step using developing solution.

A method of making a simple printing plate in which the developing step using the alkaline developing solution and arranged to be performed after exposure of an image is omitted has been developed under the foregoing circumstances. In the technical field of the simple printing plate also called an "unprocessed plate" because the developing step can be omitted, a variety of means for forming an image on a recording surface has been suggested which are based on a variety of principles as follows: (1) an irradiated portion of the surface is broken due to heat of exposure; (2) an irradiated portion has a lipophilic nature by the exposure; (3) an irradiated portion is harden due to a light mode to have a lipophilic nature; (4) surface nature is changed due to light-decomposition of diazo compounds; and (5) fusible thermal transfer using a heat mode, and so on.

Disclosed techniques adaptable to the foregoing simple offset printing method include a technique disclosed in U.S. Pat. No. 3,506,779, No. 3,549,733, No. 3.574,657, No. 3,739,033, No. 3,832,948, No. 3,945,318, No. 3,962,513, No. 3,964,389, No. 4,034,183, Nos. 4,081,572, 4,693,958, No. 4,731,317, No. 5,238,778, No. 5,353,705, No. 5,385, 092, No. 5,395,729 and European Patent No. 1068.

Each of the foregoing techniques has been devised such that no developing solution is required when the printing plate is made. Each of the techniques has one or more problems which include insufficient difference between lipophilic regions and hydrophilic region, causing the image quality of the printed image is unsatisfactory, insufficient resolution which a printed image exhibiting excellent sharpness cannot be obtained, insufficient mechanical strength of the image surface and, therefore, occurrence of easy damage of the image surface, deterioration in the simplicity caused from provision of a protective film to prevent the damage and insufficient durability to endure printing for a long time. Therefore, simple omission of the alkali developing step cannot improve the degree of practical use. The requirement for a method of making a printing plate satisfying a variety of characteristics required for a printing operation and capable of simply making a printing plate has not been met in spite of a plurality of the foregoing improvements.

As one of a method of making the unprocessed printing plate, a method of making a printing plate has been disclosed in Japanese Patent Publication No. 9-169098A which uses a fact that zirconia ceramic is caused to have a hydrophilic nature owing to irradiation with light. The photosensitivity of zirconia, however, is insufficient and an unsatisfactory photoconversion effect from the hydrophobic nature to the hydrophilic nature inhibits easy identification between image portions and non-image portions.

If means capable of easily reuse and reusing the used printing plate can be employed in addition to the simple printing method which does not require the developing solution, an advantage can be obtained in that the cost and the quantity of waster can be reduced. When the printing plate is reused, the reusing operation must easily be performed. It is difficult to structure a simple reusing operation. There has substantially no investigation has been performed. Only a special material for the printing plate, which is zirconia ceramic, has been disclosed in Japanese Patent Publication No. 9-169098A.

SUMMARY OF THE INVENTION

In view of the foregoing, the first object of the present invention is to provide an offset printing method which does not require alkali developing solution, which is capable of easily making a printing plate, which exhibits a satisfactory identifying characteristic between image portions and non-image portions on the printing surface, which enables a printed matter having a practically required quality to be obtained, and which permits repeated use of the printing plate.

The second object of the present invention is to provide a printing apparatus adapted to the foregoing printing method, capable of printing an image having a practically required image quality level and permitting repeated use of the printing plate.

The third object of the present invention is to provide a printing method for making a negative-type plate making method and satisfying the above-mentioned objects.

As the first aspect of the invention, the present inventors have found that the surface of metal oxide and metal of a certain type has a characteristic that the degree of the hydrophobic nature and the hydrophilic nature is changed owing to action of heat. Another fact has been found that the foregoing change is caused to arbitrarily occur to the hydrophobic nature or the hydrophilic by changing the heating conditions. The foregoing characteristic is used to form an image, which must be formed, on the surface of the printing plate and to erase the image on the surface of the printing plate after the printing operation has been completed. When the foregoing method is used, a fact has been found that the foregoing problem can be overcome.

The first aspect of the present invention is based on the discovery of a special behavior of the physical properties of the surface of a specific substance (mainly the foregoing metal oxide and metal) occurring with heat. That is, the clear surface of the specific substance originally has a hydrophilic nature. If the foregoing surface is heated at (1) an adequate temperature (hereinafter called a "hydrophobicity developing temperature"), the characteristic is changed to the hydrophobic nature. (2) When the surface is heated at a higher temperature (hereinafter called a "higher hydrophilicity developing temperature"), the surface again has the hydrophilic nature. Moreover, (3) the foregoing change in the characteristic of the surface has a hysteresis nature.

The foregoing characteristic is used such that a first step is performed so that the surface of the substance is caused to have the hydrophilic nature by heating the substance at the temperature at which hydrophilicity characteristic is developed. Then, a second step is performed so that the surface of the substance corresponding to the image is heated at the hydrophobicity developing temperature so that a hydrophobic region is formed to correspond to the image. Then, a third step is performed so that printing ink is held in the hydrophobic region and dampening water is held in the hydrophilic region. Thus, offset printing can be performed. After the printing operation has been completed, ink on the used printing plate is removed by cleaning. The foregoing printing plate is again heated to the temperature at which hydrophilicity is developed so that the printed image is removed. As a result, the foregoing printing plate can again be used in the plate making step and the printing step. As a matter of course, the temperature of the surface of the substance must be lowered to a level not higher than hydrophobicity developing temperature between the step for heating the surface at the temperature at which hydrophilicity is developed in the first step and the step for heating the substance at the hydrophobicity developing temperature in the second step. The substance applied to the present invention has a hysteresis nature. Therefore, the surface once caused to have the hydrophilic nature at the higher hydrophilicity developing temperature is cooled without change to the hydrophobic nature if the temperature is made to be the hydrophobicity developing temperature during the cooling process. When the hydrophilic surface cooled to the level not higher than the hydrophobicity developing temperature is again heated to the hydrophobicity developing temperature, the surface is caused to have the hydrophobic nature. Moreover, the hydrophobic image region obtained on the printing plate owing to the recording operation performed in the heat mode can stably be maintained thanks to the hysteresis nature even if the temperature is not higher than room temperatures. In the following description, the foregoing substance having the characteristics (1), (2) and (3) with respect to heat is called a "thermal responsive substance". The thermal responsive substances are widely detected among metal and metal oxide. The foregoing metal and metal oxide are called "thermal responsive metal" and "thermal responsive metal oxide", respectively. The thermal responsive substance and its singular behavior will be described later.

As the second aspect of the present invention, the inventors have confirmed existence of a substance which has a photocatalyst function and which displays special change behavior of the hydrophobic nature/hydrophilic nature depending on the temperature and the heating conditions when the substance is heated. The foregoing characteristics are used to form an image which must be printed and which is formed on the surface of the printing plate and to erase the image on the surface of the printing plate after the printing operation has been completed so that the foregoing is overcome.

The second aspect of the present invention is based on the discovery of a fact that the surface of a specific substance, such as titanium oxide, is changed to a hydrophilic nature when the substance is irradiated with light having a specific wavelength. The foregoing substance is called a substance having a photocatalyst function. Light having the specific wavelength is called activation light. Moreover, a fact has been found that the some thermal responsive substances described above are included in the substances having the photocatalyst function.

The photocatalyst function and the thermal responsive characteristic are used such that a first step is performed so that the surface of the substance is caused to have the hydrophilic nature by irradiating the surface of the substance with activation light. Then, a second step is performed so that the surface of the substance corresponding to the image is heated at the hydrophobicity developing temperature so that a hydrophobic region is formed to correspond to the image. Then, a third step is performed so that printing ink is held in the hydrophobic region and dampening water is held in the hydrophilic region. Thus, offset printing can be performed. After the printing operation has been completed, ink on the used printing plate is removed by cleaning. The foregoing printing plate is again irradiated with activation light so that the printed image is removed. As a result, the foregoing printing plate can again be used in the plate making step and the printing step. The surface of the substance, such as the metal oxide, which has the photocatalyst function and as well as the thermal response characteristic, is made to have the hydrophilic nature owing to irradiation with light. The hydrophilic nature of the surface is maintained for a sufficiently long time from a viewpoint of practical use thanks to the hysteresis nature. Also the hydrophobic nature of region of the hydrophilic surface heated to the hydrophobicity developing temperature to correspond to the image is stably maintained at room temperatures thanks to the hysteresis nature. Therefore, distribution of the hydrophobic and hydrophilic portions corresponding to the image can be used in printing and plate making steps.

According to the third aspect of the present invention, there are provided a negative offset printing method and a printing apparatus which effectively use the photocatalyst function and the thermal response characteristic.

The printing method is performed such that a first step is performed so that the surface of the substance is caused to have the hydrophilic nature by uniformly heating the surface of a specific substance which performs the photocatalyst reaction at the temperature at which hydrophobicity is developed to cause the surface of the substance to have a hydrophobic nature. Then, a second step is performed so that the surface of the substance is irradiated with activation light to correspond to an image to form distribution of hydrophilic regions and hydrophobic regions corresponding to an image. Then, a third step is performed so that printing ink is held in the hydrophobic region and dampening water is held in the hydrophilic region. Thus, offset printing can be performed. After the printing operation has been completed, ink on the used printing plate is removed by cleaning. The foregoing printing plate is again heated at the temperature at which hydrophobicity is developed. The distribution of hydrophilic regions and hydrophobic regions corresponding to an image is erased so that a uniform hydrophobic surface is obtained. As a result, the foregoing printing plate can again be used in the plate making step and the printing step. The surface of the substance, such as metal and metal oxide, having the photocatalyst function has the different degrees of the original hydrophilic nature or the hydrophobic nature depending on the type of the substance. Also the foregoing degree varies depending on the elapsed time. In a case of the substance having the thermal response characteristics (1) to (3), when the surface is heated at the temperature at which hydrophobicity is developed to have the hydrophobic nature, the hydrophilic nature of the surface is maintained for a sufficiently long time from a viewpoint of practical use thanks to the hysteresis nature. Moreover, the present invention is able to adequately control the temperature in the hydrophobic nature imparting process in which heating in the first step is performed in such a manner that the temperature is not raised to the high temperature at which hydrophilicity is developed. Therefore, the hydrophobic nature can be enhanced under an optimum temperature condition.

According to the fourth aspect of the present invention, there are provided a negative offset printing method and a printing apparatus which effectively use a fact that the surface of metal oxide and metal of a certain type has a characteristic that the degree of the hydrophobic nature and the hydrophilic nature is changed owing to action of heat, and another fact that the foregoing change is caused to arbitrarily occur to the hydrophobic nature or the hydrophilic by changing the heating conditions.

The printing method is performed such that a first step is performed so that the surface of the substance is caused to have the hydrophilic nature by heating the substance at the temperature at which hydrophilicity characteristic is developed. Then, a second step is performed so that the surface of the substance corresponding to the image is heated at the temperature at which hydrophobicity is developed so that a hydrophobic region is formed to correspond to the image. Then, a third step is performed so that printing ink is held in the hydrophobic region and dampening water is held in the hydrophilic region. Thus, offset printing can be performed. After the printing operation has been completed, ink on the used printing plate is removed by cleaning. The foregoing printing plate is again heated to the temperature at which hydrophilicity is developed so that distribution of image of hydrophilic and hydrophobic natures is erased. Thus, a uniform hydrophobic surface can be obtained. As a result, the foregoing printing plate can again be used in the plate making step and the printing step.

DETAILED DESCRIPTION OF THE PREFERRED EMBODIMENTS

1. First Embodiment

Figure 1:
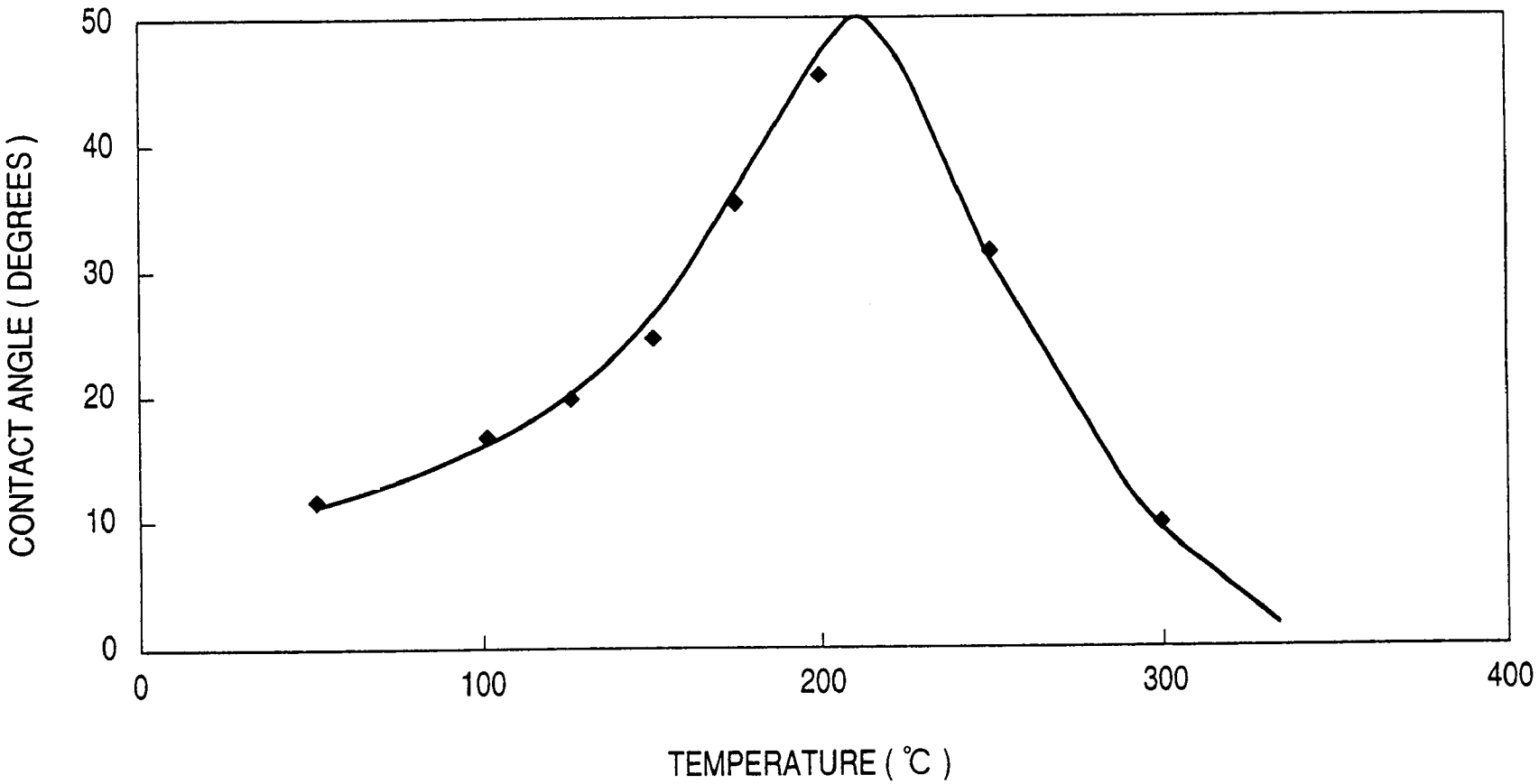
FIG. 1 is a graph showing the relationship between temperatures of the surface of titanium oxide and contact angles.

A first embodiment of the present invention will now be described.

1-1. Thermal Responsive Substance

Initially, the "thermal responsive substance" according to the present invention will now be described. The thermal responsive substance has been defined as the substance having the characteristics (1), (2) and (3). A multiplicity of metal and metal oxide including ceramic and semiconductors which are employed as functional materials have the foregoing characteristics. The thermal responsive ceramic is composed of composite metal oxide, while a major portion of the thermal responsive semiconductors is detected in both of intrinsic semiconductors, such as silicon and germanium having close ground levels and conductivity and extrinsic semiconductors, such as vanadium oxide, which depend on the impurity level. The foregoing ceramic and semiconductors similar to the other metal oxide and metal from a viewpoint of the thermal responsibility of the substance for use in the present invention. Therefore, the foregoing ceramic and semiconductors are included in the "thermal responsive metal oxide" and the "thermal responsive metal" which will sequentially be described.

A variety of metal and metal oxide have the characteristics with which the hydrophobic nature is imparted owing to adequate heating and the hydrophilic nature is imparted owing to further heating and which can be used as the thermal responsive metal oxide. Sole metal, metal oxide, alloys and composite oxide are included in the foregoing category. In the latter case, each of solid solution, mixed crystal, polycrystal, amorphous solid solution and mixture of fine particles of metal oxide has the foregoing characteristics. The metal oxide of a type having the foregoing characteristics can be detected in metal and it oxide belonging to third to sixth periods of the periodic table except for group 0 and VIIA (halogen elements). The metal and its metal oxide must be free from excessive dissolution in water when the foregoing material is used as the printing plate. Therefore, the solubility with respect to water is 10 mg or less with respect to water in a quantity of 100 ml, preferably 5 mg or less, and more preferably 1 mg or less.

Among the "thermal responsive metal oxide", titanium oxide and zinc oxide will now be described. Both of the foregoing materials can be employed in the present invention as the material of the printing plate having the thermal response characteristic. In particular, it is preferable that titanium oxide is employed from a viewpoint of sensitivity (that is, the light change characteristic of the surface characteristic). As titanium oxide, a material obtained by a known method including heating and baking of ilmenite or titanium slug with sulfuric acid or oxidation with oxygen after heating and chlorination may be employed. As an alternative to this, a method may be employed with which metal titanium is employed to perform vacuum evaporation in a step for making the printing plate so as to form an oxide film.

To form a layer containing titanium oxide or zinc oxide on the surface of the printing plate, for example, any one of the following known methods may be employed: (1) a method with which dispersant of fine particles of titanium oxide or zinc oxide is applied to the surface of the printing plate; (2) a method with which coating is performed, following by performing baking to reduce or remove a binder; (3) a method with which a titanium oxide (or zinc oxide) film is formed on the surface of the printing plate by a method, such as evaporation, sputtering, CVD or ion plating; and (4) a method with which an organic titanium oxide, such as titanium butoxide is applied to the surface of the printing plate followed by performing baking and oxidizing process to form a titanium oxide layer. In the present invention, it is preferable that the titanium oxide layer formed by the vacuum evaporation method or sputtering is employed.

Specifically, fine particles of titanium oxide obtained by the method (1) or (2) can be applied by a method with which dispersant of fine particles of amorphous titanium oxide is applied and baking is performed to form an anatase or rutile crystal titanium oxide layer; a method with which a dispersant of a mixed material of titanium oxide and silicon oxide is applied to form a surface layer; a method with which a mixed material of titanium oxide and organosiloxane or the like is applied to obtain a titanium oxide layer bonded with a support member; and a method with which dispersion in a polymer binder which coexists with oxide in the oxide layer and coating are performed followed by performing baking to remove organic components. The binder of the fine particles of the oxide may be polymer which has a dispersing characteristic with respect to fine particles of titanium oxide and which can be removed by baking at a relatively low temperature. Preferred binders are any one of the following hydrophobic binders: polyalkylene such as polyethylene, polybutadiene, polyacrylic ester, polymethacrylic ester, polyvinyl acetate, polyvinyl formate, polyethylene terephthalate, polyethylene naphthalate, polyvinyl alcohol, partially-saponified polyvinyl alcohol and polystyrene.

To perform the method (3) in which titanium oxide is vacuum-evaporated, metal titanium is usually placed on an evaporating heat source in a vacuum-evaporating apparatus. While a degree of vacuum of $10^{-8}$ Torr to $10^{-5}$ Torr is being realized, the overall gas pressure of $10^{-5}$ Torr to $10^{-2}$ Torr and the fractional pressure ratio of oxygen of 5% to 90% being maintained, metal titanium is evaporated. Thus, a thin evaporated film made of titanium oxide is formed on the evaporated surface. When sputtering is performed, a target of metal titanium is set in, for example, a sputtering apparatus. Then, the gas pressure is adjusted to $5\times10^{-3}$ Torr in such a manner that the ratio $Ar/O_2$ is made to be 60/40 (molar ratio). Then, RF power of 200 W is supplied to perform sputtering so that a thin titanium oxide film is formed on the substrate.

When a zinc oxide layer is employed in the present invention, the zinc oxide layer may be formed by a known method. It is preferable that the surface of a metal zinc plate is oxidized by electrolysis to form an oxide film or a method with which vacuum evaporation, sputtering, CVD or ion plating is performed to form a zinc oxide film.

The evaporated film made of zinc oxide may be formed by a method with which metal zinc is evaporated under presence of oxygen gas similarly to the evaporation of titanium oxide to form an oxide film. Another method may be employed with which zinc metal film is formed in a state in which no oxygen is present, followed by raising the temperature to about 700° C. in air to cause oxidation to occur.

Another method may be employed with which a layer obtained by applying zinc oxalate or a thin layer made of zinc selenide is heated in an oxidizing gas flow.

It is preferable that the thickness of the evaporated film in either case of the titanium oxide layer or the zinc oxide layer is 1 angstrom to 100000 angstrom, more preferably 10 angstrom to 10000 angstrom, and most preferably 3000 angstrom or less to prevent distortion of light interference. To sufficiently obtain the light activating effect, it is preferable that the thickness is 50 angstrom or greater.

The crystal system of titanium oxide is not limited. In particular, it is preferable that anatase system is employed because of its high sensitivity. A fact is known that anatase crystal can be obtained by selecting baking conditions in a process for obtaining titanium oxide by performing baking. In the foregoing case, amorphous titanium oxide or rutile titanium oxide may coexist. It is preferable that anatase crystal is contained by 40% or higher, preferably 60% or higher.

The volume ratio of titanium oxide or zinc oxide in the layer in which titanium oxide or zinc oxide is the main component is 30% to 100%, preferably 30% to 100% and more preferably 50% or higher. It furthermore preferable that a continuous layer of the oxide is formed, that is, the volume ratio is 100%. Any considerable influence of purity is not exerted on the change characteristic of the hydrophilic nature/the lipophilic nature as distinct from a case in which zinc oxide is employed in an electrophotographic photosensitive layer. Therefore, the material having a purity close to 100% (for example, 98%) is not required to raise the purity. The foregoing fact can be understood also from a fact that the physical properties for use in the present invention is the change characteristic of the hydrophilic nature/lipophilic nature of the surface of the film which does not concern the conductivity, that is, the change characteristic of the physical properties of the interface.

To enhance the characteristic with which the hydrophilic nature of the surface by using the action of heat, doping of certain metal sometimes effective. To achieve the foregoing object, it is preferable that doping of metal having a small ionization tendency is performed. It is preferable that doping of Pt, Pd, Au, Ag, Cu, Ni, Fe, Co or Cr is performed. A plurality of types of the foregoing metal materials may be doped. When doping is performed, the content of 5 mol % or less of metal components of zinc oxide or titanium oxide.

If the volume ratio is low, the sensitiveness of the thermal response behavior of the hydrophilic nature/lipophilic nature of the surface of the layer deteriorates. Therefore, it is preferable that the volume ratio of the oxide in The layer is 30% or higher, more preferably substantially 100%.

A metal titanate expressed by general formula $RTiO_3$ is a compound which can preferably be applied to the present invention. The foregoing compound will now be described. In general formula $RTiO_3$, R is a metal atom, such as magnesium, calcium, strontium, barium or beryllium, belonging to alkaline earth elements of the periodic table. In particular, it is preferable that strontium or barium is employed. Two or more types of alkaline earth metal elements may coexist if the overall quantity satisfies the foregoing formula from a viewpoint of the stoichiometric perfection.

A compound expressed by general formula $AB_{2-x}C_xD_{3-x}E_xO_{10}$ will now be described. In the foregoing general formula, A is a monovalent atom selected from alkali metal atoms including sodium, potassium, rubidium, cesium and lithium. Two or more types the foregoing elements may coexist if the overall quantity satisfies the foregoing formula from a viewpoint of the stoichiometric perfection.

Symbol B is alkaline earth metal atom similar to the foregoing symbol R or a lead atom. Two or more types the foregoing elements may coexist if the overall quantity satisfies the foregoing formula from a viewpoint of the stoichiometric perfection.

Symbol C is a rare earth metal atom, preferably an atom belonging to lanthanoid elements including scandium, yttrium, lanthanum, cerium, praseodymium, neodium, holmium, europium, gadolinium, terbium, thulium, ytterbium and lutetium. Two or more types the foregoing elements may coexist if the overall quantity satisfies the foregoing formula from a viewpoint of the stoichiometric perfection.

Symbol D is one or more types of element selected from elements in group 5A of the periodic table and exemplified by vanadium, niobium and tantalum. Two or more types the foregoing elements may coexist if the overall quantity satisfies the foregoing formula from a viewpoint of the stoichiometric perfection.

Also symbol E is a metal atom, such as titanium, zirconium or hafnium, belonging to elements in group 4A. Two or more types of metal elements in group 4A may coexist.

Symbol x is an arbitrary number from 0 to 2.

When the foregoing compound expressed by $RTiO_3$ or $AB_{2-x}C_xD_{3-x}E_xO_{10}$, or the metal oxide expressed by $SiO_2$, $SnO_2$, $Bi_2O_3$, $GeO_2$, $Al_2O_3$ or $FeO_x$ (x=1 to 1.5) is formed is formed for the surface of the printing plate, it is preferable that the foregoing method of providing titanium oxide and zinc oxide is employed. That is, any one of the following known methods may be employed: (1) a method with which dispersant of fine particles of the thermal responsive metal oxide is applied to the surface of the printing plate; (2) a method with which coating is performed, following by performing baking to reduce or remove a binder; (3) a method with which a film of the foregoing oxide is formed on the surface of the printing plate by any one of a variety of vacuum methods for forming a thin film; (4) a method with which an organic compound, such as alcoholate, is applied to the surface of the printing plate, followed by performing hydrolysis, and followed by performing baking and oxidizing to form a thin metal film having a proper thickness; and (5) a method with which solution of hydrochloride or nitrate is hot-sprayed.

To apply particles of barium titanate by the applying method (1) or (2), either of a method with which dispersant of a mixed material of barium titanate and silicon is applied to form a surface layer or a method with which dispersant of a mixed material of barium titanate and organopolysiloxane or its monomer is applied. As described when titanium oxide has been described, dispersion in the polymer binder which is able to coexist with oxide in the oxide layer is performed to be coated, followed by performing baking to form the oxidized layer. The polymer serving as a preferable binder of oxide particles are the same as described when the titanium oxide layer has been described.

When the foregoing method is employed, magnesium titanate, calcium titanate, strontium titanate, its intermolecular compound or a mixed material may be employed to form the thin film as well as barium titanate.

In the other portion of the specification, "$FeO_x$" is a generic name of iron oxide including FeO, $Fe_2O_3$ and $Fe_3O_4$.

Similarly, $CsLa_2NbTi_2O_{10}$ particles may be applied by the applying method (1) or (2). The $CsLa_2NbTi_2O_{10}$ particles can be obtained by pulverizing $Cs_2CO_3$, $La_2O_3$, $NbO_5$ and $TiO_2$ in a quantity corresponding to the stoichiometry of the $CsLa_2NbTi_2O_{10}$ particles in a mortar, and the pulverized material were introduced into a platinum crucible so as to be baked at 130° C. for 5 hours. Then, the materials were cooled, and then introduced into a mortar so as to be pulverized into particles having a size not larger than several microns. The $CsLa_2NbTi_2O_{10}$ particles are dispersed in the binder similarly to the barium titanate, and then applied so that a thin film is formed. The foregoing method may be applied to $AB_{2-x}C_xD_{3-x}E_xO_{10}$ ($0 \leqq x \leqq 2$) such as $HCa_{1.5}La_{0.5}Nb_{2.5}Ti_{0.5}O_{10}$ or $HLa_2NbTi_2O_{10}$ as well as $CsLa_2NbTi_2O_{10}$particles.

In general, thermal responsive metal oxide layer formed by the vacuum method (3) for forming a thin film may be formed by a sputtering method or a vacuum method for forming a thin film. The sputtering method is performed such that a single type of a composite type oxide target is prepared. For example, barium titanate target is employed, and the temperature of a support member for the evaporated film is maintained at 450° C. or higher. In an atmosphere of mixture of argon and oxygen, RF sputtering is performed so that thin crystal film of barium titanate is obtained. To control the crystallinity, post-annealing is performed at 300° C. to 900° C., if necessary. The foregoing method may be applied to the $RTiO_3$ (where R is an alkaline earth metal atom) and the other thermal responsive metal oxide to form a thin film on the basis of the similar idea by adjusting an optimum temperature of the substrate.

When, for example, a thin tin oxide film is formed, RF sputtering is performed in an atmosphere of mixture of argon and oxygen when the temperature of the substrate is 120° C. Thus, a required thin film of the tin oxide crystal can be obtained.

Also the foregoing method (4) with which metal alcoholate is employed is a method which is capable of forming a required thin film without use of a binder. To form a thin film of barium titanate, alcohol solution of mixture of barium ethoxide and titanium butoxide is applied to a silicon substrate having the surface which contains $SiO_2$. Hydrolysis of the surface of the silicon substrate is performed, and then the substrate is heated to 200° C. or higher so that a thin film of barium titanate is formed. Also the foregoing method may be applied to form a thin film of $RTiO_3$ (R is an alkaline earth metal atom), $AB_{2-x}C_xD_{3-x}E_xO_{10}$ (where A, B, C, D and E are the foregoing materials), $SnO_2$, $SiO_2$, $Bi_2O_3$, $SeO_2$, $GeO_2$, $Al_2O_3$ and $FeO_x$ (x=1 to 1.5).

Also the method (5) for forming a thin film of metal oxide having the thermal response function is able to form a thin film of a type which does not contain a binder. To form a thin film of $SnO_2$, a thin film can be formed by spraying hydrochloric acid solution of $SnCl_4$ to the surface of quartz or crystalline glass heated to 200° C. or higher. The foregoing method may be applied to form a thin film of $RTiO_3$ (R is an alkaline earth metal atom), $AB_{2-x}C_xD_{3-x}E_xO_{10}$ (where A, B, C, D and E are the foregoing materials), $SiO_2$, $Bi_2O_3$, $SeO_2$, $GeO_2$, $Al_2O_3$ and $FeO_x$ (X=1 to 1.5).

In each case, it is preferable that the thickness of the thin film of metal oxide is 1 angstrom to 100,000 angstrom, more preferably 10 angstrom to 10,000 angstrom. More preferably, it is preferable that the thickness is 3,000 angstrom from a viewpoint of preventing distortion of light interference. To sufficiently obtain light activating action, it is preferable that the thickness is 50 angstrom or greater.

The volume ratio of metal oxide in a thin layer made of the thermal responsive metal oxide realized in a case where the binder is employed is 50% to 100%, preferably 90% or higher and more preferably a continuous layer of the oxide is formed, that is, the volume ratio is substantially 100%.

Next, the "thermal responsive metal" will now be described. Metal which can be employed as the thermal responsive metal may be any metal if employed metal has the characteristic with which metal has the hydrophobic nature when metal is heated properly and metal has the hydrophilic owing to furthermore heating. Moreover, the foregoing metal must exhibit the hysteresis phenomenon. In accordance with experience, metal of a type having the foregoing characteristics is metal elements belonging to third to sixth periods of the periodic table except for group 0 and VIIA (halogen elements). Metal included in the category of metal in the foregoing range of the periodic table and having the above-mentioned thermal response characteristic may be metal having a single composition or metal having a composite composition, that is, an alloy. In the case of the alloy, solid solution of metal, an intermetallic compound or mixture of fine crystal of metal. An oxide film having a passive characteristic may be formed on the surface of the material, such as stainless steel (hereinafter called "SUS"). The purity of the single metal or the alloy is not limited particularly. The usual purity level may be applied to the present invention.

It is preferable that metal selected from aluminum, iron, silicon, nickel, zinc, germanium, tin, copper and their alloy is employed. It is most preferable that aluminum is employed. When aluminum is employed, it is preferable that an aluminum plate to be described later and serving as the support member for the printing plate is directly employed. Therefore, an aluminum plate having the surface, the hydrophilic nature has been enhanced by mechanical dressing using sand or a surface coarsening process by electrolysis or an aluminum plate subjected to an anode oxidizing process.

Thermal response metal may be used as a metal plate or thermal responsive metal may be provided for the surface of a support member made of a proper plastic film or a metal plate by electric plate or bonding. The thickness of the metal plate provided for the support member may be an arbitrary thickness which must be less than the thickness of the support member. It is preferable that the thickness is about 0.01 mm to about 0.4 mm, more preferably 0.02 mm to 0.2 mm.

To enhance the thermal response of the printing plate, it is effective to provide a heat insulating layer below an image forming layer. When recording is performed by the photothermal conversion, a photothermal converting layer may be provided as a lower layer if the functional surface is transparent with respect to light.

1-2. Printing Plate

The structure of a printing plate according to the present invention will now be described.

The original plate according to the present invention may be structured variously and made of any one of a variety of materials. For example, any one of the foregoing methods may be employed: a method with which a thin layer made of the thermal responsive substance is directly provided for the surface of a base of a printing cylinder by evaporation, immersion or coating; and a method with which a thin plate made of the thermal responsive substance and having no support member is wound around the base of the printing cylinder to make the printing plate.

As a matter of course, a usual method of mounting the made printing plate to a rotary press or a flat press as well as the foregoing method of making the printing plate on the printing cylinder.

When the thermal responsive substance is provided for the surface of the support member, it is preferable that the support member is a metal plate which is free from thermal decomposition at the higher hydrophilicity developing temperature and which exhibits dimensional stability. For example, an aluminum plate, a SUS plate, a nickel plate or copper plate is employed. In particular, it is preferable that a flexible metal plate is employed. Also a flexible plastic support member made of polyethylene or cellulose ester may be employed. An oxide layer may be provided for the surface of a support member, such as water-proofing paper, laminated polyethylene paper or impregnated paper. Any one of the foregoing structures may be employed as the printing plate.

Specifically, any one of the foregoing structures may be employed: paper, paper on which a plastic sheet (for example, a sheet made of polyethylene terephthalate or polyimide) has been laminated, a metal plate (made of, for example, aluminum, zinc, copper or stainless steel), a plastic film (made of, for example, cellulose diacetate, cellulose triacetate, cellulose propionate, cellulose butyrate, cellulose acetate butyrate, cellulose acetate, polyethylene terephthalate, polyimide, polystyrene, polycarbonate or polyvinyl acetal), paper on which any one of the foregoing metal materials has been laminated or evaporated or a plastic film.

A preferred support member is polyethylene film, polyimide film, an aluminum plate or a SUS plate which will not easily be corroded on the printing plate. In particular, it is preferable that either of the aluminum plate exhibiting dimensional stability and relatively low cost or the polyimide film which is stable when it is heated to a high temperature in the plate making process is employed.

A preferred polyimide film is a polyimide resin film obtained by polymerizing pyromellitic anhydride and m-phenylene diamine followed by forming the polymerized material into cyclic imide, the polyimide resin film being film which has been marketed (for example, "CAPTION" manufactured by DuPont-Toray Co., Ltd.)

A preferred aluminum plate is a pure-aluminum plate or an alloy plate mainly composed of aluminum and containing other elements in a small quantity. As an alternative to this, a plastic film may be employed which has a structure that aluminum is laminated or evaporated. The other elements contained in the aluminum alloy are silicon, iron, manganese, copper, magnesium, chrome, zinc, bismuth, nickel or titanium. The quantity of the different element in the alloy must be 10 wt % or less. In the present invention, preferable aluminum is pure aluminum. Since a completely aluminum cannot easily be manufactured from a viewpoint of a realized refining technique level, the different element in a small quantity may be contained. The composition of the aluminum plate according to the present invention is not limited particularly. An aluminum plate made of a conventional material may be employed. The thickness of the metal support member according to the present invention is about 0.1 mm to about 0.6 mm, preferably 0.15 mm to 0.4 mm and more preferably 0.2 mm to 0.3 mm. The thickness of the other support member made of, for example, plastic or coated paper is about 0.1 mm to about 2.0 mm, preferably 0.2 mm to 1.0 mm.

When the aluminum support member is employed, it is preferable that the surface of the aluminum support member is coarsened. In the foregoing case, rolling oil left on the surface is removed prior to performing the coarsening process by performing a degreasing process using, for example, a surface active agent, organic solvent or alkali solution.

The process for coarsening the surface of the aluminum plate can be performed by any one of a variety of methods. For example, a known method may be employed, for example, a mechanical coarsening method, a method of electrochemically dissolving and coarsening the surface, a ball polishing method, a brush polishing method, a blast polishing method or a buff polishing method. The electrochemical coarsening method may be a known method such that an AC or DC is used in hydrochloric acid electrolytic solution or acetic acid electrolytic solution. The aluminum plate having the coarsened surface is subjected to an alkali etching process or a neutralizing process, if necessary. Then, an anode oxidizing process is performed if necessary to improve a water retention characteristic and wear resistance of the surface. The concentration of the electrolyte for use in the anode oxidizing process is arbitrarily determined according to the type of the electrolyte.

Since conditions under which the anode oxidizing process vary according to the type of the electrolyte, the conditions cannot simply specified. In general, proper conditions are as follows: the concentration of the electrolyte is 1 to 80 wt %, the temperature of the solution if 5 to 70° C., the current density is 5 A/dm$^2$ to 60 A/dm$^2$, the voltage is 1 to 100 V, the time for which the electrolysis is performed is 10 seconds to 5 minutes.

If the quantity of the anode-oxidized film is less than 1.0 g/m$^2$, printing resistance is insufficient. What is worse, damage of a non-printed portion of the flat printing plate easily occurs. Thus, ink is allowed to adhere to the damage portion during the printing operation, that is, a so-called "damage contamination" easily occurs.

1-3. Printing Method

Next, a printing method according to the present embodiment will be discussed.

First, the thermal response characteristic of the thermal responsive substance, such as the metal oxide and thermal responsive metal according to the present invention will now be further described. FIG. 1 is a graph showing results of experiments for describing the thermal response characteristics (1) to (3). The angle of contact of the surface of titanium oxide with water realized after titanium oxide has been heated at various temperatures for 5 minutes by using a contact angle meter CA-D manufactured by Kyowa Interface Science Co., Ltd. The obtained values were plotted with respect to the temperatures so that relationship between the temperatures and angles of contact was obtained. Heating was performed from room temperatures to 200° C. by operating a small-size high-temperature chamber ST-110 (manufactured by Tabai Espec Co., Ltd.). The temperature was raised by an electric furnace KM-100 (manufactured by Toyo Seisakusho Co., Ltd).

As a matter of course, whether the surface has the hydrophilic nature or the hydrophobic nature can be indicated with the degree of the contact angle. As the contact angle is enlarged, the hydrophobic nature is exhibited. The hydrophobic nature can as well as be called as the lipophilic nature or the oil-philic nature. As shown in FIG. 1, as titanium oxide is heated, the surface contact angle is enlarged. When the temperature is 210° C., the surface contact angle is enlarged to a maximal value. As heating is furthermore performed, the angle of contact is reduced.

That is, when the temperature of the surface of titanium oxide is raised to the foregoing "hydrophobicity developing temperature", the hydrophobic nature is realized. When the temperature is furthermore raised to the foregoing "higher hydrophilicity developing temperature", the hydrophilic nature is again realized. When the overall surface is heated to the higher hydrophilicity developing temperature, the surface is made to be a clean and stable hydrophilic surface suitable to be used in the printing operation. Therefore, a printing plate can be made with satisfactory reproducibility. Although the means for heating the plate to high temperatures is not limited particularly, electric heating can easily be performed and control of the same is easy. Also a heat mode heating using radiating rays, such as infrared rays or laser beams is a preferred heating means.

The range of the high temperatures at which hydrophilicity is developed varies depending on the type of the thermal responsive metal oxide and metal and the heating rate. The temperature is usually 200° C. or higher. Higher temperatures are required depending on the type of the metal oxide and metal. The upper limit of the temperature raised by heating to realize the hydrophilic may be a high temperature if unsatisfactory chemical and structural changes for the metal oxide and metal do not occur. If a practical grade of the hydrophilic nature can be obtained, a furthermore high temperature is not required. When titanium oxide is employed as the thermal responsive metal oxide, it is preferable that the upper limit is 700° C. or lower to prevent phase change of titanium oxide. When polyimide film is employed as the support member for the printing plate, the upper limit is 400° C. or lower to prevent degeneration of the polyimide film.

Specifically, the region of the "hydrophobicity developing temperature" in the foregoing description about the thermal response is regions on the two sides of the maximal value of the contact angle in which the contact angle is less than the maximal contact angle by 20° or less. The foregoing region is a region for the practical hydrophobic nature capable of receiving ink. In the experiments shown in FIG. 1, the maximal value of the contact angle is 50°. Each of the ranges of the temperatures at which hydrophobicity is developed on the two sides of the maximal contact angle is 155 to 240° C. In general, the foregoing ranges vary depending on the types, the heating rate and the heating atmosphere of the thermal responsive metal oxide and metal and the other thermal responsive substance. If the heating rate and the heating atmosphere are the same, the maximal value of the contact angle varies depending on the type of the metal oxide, such as the titanium oxide, zinc oxide and barium titanate. Also the temperature ranges corresponding to the two sides of the maximal value in each of which the contact angle is reduced by 20° or less vary depending on the foregoing factors. If the heating rate is raised, the foregoing temperature range varies. Although somewhat variation takes place as described above, the hydrophobicity developing temperature is, in general, 50 to 250° C. In many cases, the temperature range is 100 to 250° C. Therefore, when the heat mode recording is performed in the foregoing temperature range, the difference between the hydrophobic and the hydrophilic of the image region and the non-image region can be enlarged. Therefore, the identifying characteristic between the image portion and the non-image portions can be improved. As a result, the characteristic of the present invention with which the quality of the printing surface can be improved can be realized.

The heating means for forming the hydrophobic image portion on the printing plate may be a solid laser for radiating infrared rays, a semiconductor laser for radiating infrared ray region light or a visible ray region light, an infrared ray lamp, xenon discharge lamp, a photothermal conversion recording apparatus incorporating a large-capacity capacitor with which discharge is performed to emit flash light or a direct image recording means incorporating a heat fusion type or a sublimation thermal pigment transfer type thermal recording head. To adjust the heating temperature to an adequate hydrophobicity developing temperature, the intensity of light of a light source for use in the heating operation is controlled or the electric power which is supplied to the thermal recording head or the recording rate is controlled.

Writing of an image may be performed by either of a plane exposing method or scanning method. The former method is a method with which infrared rays are applied or a method with which short-time light emitted from a xenon discharge lamp and having a high luminance is applied to the surface of the printing plate through a mask image to generate heat by photothermal conversion. When a plane exposing light source, such as the infrared ray lamp is employed, the preferred quantity of exposure varies depending on the luminance. It is usually preferable that the intensity of the plane exposure before modulation with the image which must be printed is performed satisfies a range from 0.1 to 10 J/cm$^2$, more preferably a range from 0:3 to 1 J/cm$^2$. When the support member is a transparent member, exposure can be performed from the reverse side of the support member through the support member and the mask image. It is preferable that exposure luminance is determined in such a manner that the foregoing exposing intensity can be obtained when the exposure duration is 0.01 μsec to 1 msec, preferably 0.01 μsec to 0.1 msec. When the irradiation is performed for a long time, the exposing intensity must be raised because of a competitive relationship between the rate at which thermal energy is generated and the diffusion rate of the generated thermal energy.

In the latter case, a method is employed which uses a laser beam source containing infrared ray components in a large quantity to modulate the image with the laser beam to scan the surface of the printing plate. The laser beam source is exemplified by a semiconductor laser, a helium neon laser, a helium-cadmium laser and a YAG laser. The output of the laser beam is 0.1 to 300 W. When a pulse laser is employed, it is preferable that laser beams having a peak output of 1000 W, preferably 2000 W is applied. In the foregoing case, it is preferable that the amount of exposure is such that the plane exposure intensity before the modulation with the image which must be printed satisfies a range from 0.1 to 10 J/cm$^2$, preferably 0.3 to 1 J/cm$^2$. When the support member is a transparent support member, exposure may be performed from the reverse side of the support member through the support member.

When light is used to perform heating, for example, a structure may be employed in which a photothermal converting layer is provided for the printing plate to cause the foregoing layer to absorb energy of light so as to generate heat. As an alternative to this, a structure may be employed in which the thermal responsive substance may absorb light to spontaneously generate heat.

When heating is performed to the hydrophobicity developing temperature, impurities mixed into the heating atmosphere in a small quantity and steam of organic compounds intentionally mixed into the heating atmosphere exerts an influence of value on the maximal contact angle, the temperature corresponding to the same and the region of the hydrophobicity developing temperature. In particular, a phenomenon attracts attention with which the contact angle is enlarged. When heat mode recording is performed in the presence of steam of organic compounds, the contact angle is enlarged. Hence it follows that the effect of identifying the hydrophilic nature and the hydrophobic nature from each other can be improved. Although the mechanism of the foregoing effect has not been detected yet, an estimation can be made that adsorption of the organic compounds to the surface of the heated printing plate causes a hydrophobic film to be formed.

The organic compound having the above-mentioned excellent effect is an organic compound, the vapor pressure of which is at least 1 mmHg when the temperature is 400° C. and which is stable at the temperature at which the vapor pressure is made to be 1 mmHg. When the organic compound having the above-mentioned vapor pressure is caused to exist when heat mode recording is performed, the contact angle of the image portion to be enlarged. Thus, the identifying characteristic between the hydrophilic nature and the hydrophobic nature can be improved. It is furthermore preferable that an organic compound is employed which has a vapor pressure of 1 mmHg or higher at a temperature of 300° C. and which is stable at the temperature at which the vapor pressure is made to be 1 mmHg. More preferably, an organic compound is employed which has a boiling point of 30 to 400° C. and which is stable in a temperature range from 30 to 400° C. It is furthermore preferable that the boil point satisfies a range from 50 to 350° C. Organic compounds having the boiling point satisfying the above-mentioned temperature range are exemplified by aliphatic hydrocarbon, aromatic hydrocarbon, aliphatic carboxylic acid, aromatic carboxylic acid, aliphatic alcohol, aromatic alcohol, aliphatic ether, aromatic ether, organic amine, an organic silicon compound, any one of various solvent and plasticizer which can be added to printing ink.

Preferred aliphatic hydrocarbon is aliphatic hydrocarbon having 8 to 30 carbon atoms, more preferably 8 to 20 carbon atoms. Preferred aromatic hydrocarbon is aromatic hydrocarbon having 6 to 40 carbon atoms, more preferably 6 to 20 carbon atoms. Preferred aliphatic alcohol is aliphatic alcohol having 2 to 30 carbon atoms, more preferably 2 to 18 carbon atoms. Preferred aromatic alcohol is aromatic alcohol having 6 to 30 carbon atoms, more preferably 6 to 18 carbon atoms. Preferred aliphatic carboxylic acid is aliphatic carboxylic acid having 2 to 24 carbon atoms, more preferably aliphatic mono carboxylic acid having 2 to 20 carbon atoms and aliphatic poly carboxylic acid having 4 to 12 carbon atoms. Preferred aromatic carboxylic acid is aromatic carboxylic acid having 6 to 30 carbon atoms, more preferably 6 to 18 carbon atoms. Preferred aliphatic ester is aliphatic ester having 2 to 30 carbon atoms, more preferably 2 to 18 carbon atoms. Preferred aromatic ester is aromatic carboxylic ester having 8 to 30 carbon atoms, more preferably 8 to 18 carbon atoms. Preferred aliphatic ether is aliphatic ether having 8 to 36 carbon atoms, more preferably 8 to 18 carbon atoms. Preferred aromatic ether is aromatic ether having 7 to 30 carbon atoms, more preferably 7 to 18 carbon atoms. Also aliphatic or aromatic amid having 7 to 30 carbon atoms, more preferably 7 to 18 carbon atoms may be employed.

Specifically, any one of the following materials may be employed: aliphatic hydrocarbon, such as 2,2,4-trimethylpentane (isooctane), nonane, decane, n-hexadecane, octadecane, arachidic acid, methylheptane, 2,2-dimethylhexane or 2-methyloctane; aromatic hydrocarbon, such as benzene, toluene, xylene, cumene, naphthalene, antrathene or styrene; monovalent alcohol, such as dodecyl alcohol, octylalcohol, n-octadecylalcohol, 2-octanol or lauryl alcohol; polyalcohol, such as propyleneglycol, triethylene glycol, tetraethylene glycol, glycerine, hexyleneglycol or dipropyleneglycol; aromatic alcohol, such as benzylalcohol, 4-hydroxytoluene, phenetylalcohol, 1-naphthol, 2-naphthol, catechol or phenol; aliphatic monovalent carboxylic acid, such as acetic acid, propionic acid, butyric acid, caproic acid, acrylic acid, crotonic acid, capric acid, stearic acid or oleic acid; multivalent aliphatic carboxylic acid, such as oxalic acid, succinic acid, adipic acid, maleic acid or glutaric acid; aromatic carboxylic acid, such as benzoic acid, 2-methyl benzoic acid or 4-methyl benzoic acid; aliphatic ester, such as ethyl acetate, isobutyl acetate, acetate-n-butyl, methylpropionate, ethylpropionate, methylbutyrate, methylacrylate, dimethyloxalate, dimethylsuccinate, methylcrotonate; aromatic carboxylic acid, such as methylbenzoate, 2-methylbenzoate or methyl; organic amine, such as imidazole, triethanolamine, diethanolamine, cyclohexylamine, hexamethylenetetramine, triethylenetetramine, aniline, octylamine, aniline or phenetylamine; ketone, such as acetone, methylethylketone, methylisobutylketone or benzophenone; ether, such as methoxybenzene, ethoxybenzene, methoxytoluene, laurylmethylether or stearylmethylether; and amide, such as stearylamide, benzoylamide or acetoamide.

Also any one of the following oils and fats which are the components of printing plate ink may be employed: linseed oil, soy oil, poppy oil or safflower oil. Also any one of the following plasticizers may be employed: tributyl phosphate, tricresyl phosphate; dibutyl phthalate, butyl laulate, dioctyl phthalate and paraffin wax.

Also any one of the following organic solvent having a boiling point which satisfies the preferred range may be employed: ethyleneglycol monoethylether, cyclohexane, methylcellosolve, butylcellosolve, cellosolveacetate, 1,4-dixane, dimethylformamide and acrylonitrile.

A preferred organic silicon compound is an organopolysiloxane compound represented by dimethyl silicon oil and methylphenylisilicon oil. It is furthermore preferable that an organopolysiloxane compound having a degree of polymerization of 12 or lower is employed. The foregoing preferred organopolysiloxane has a structure that one to two. organic groups per unit siloxane bond. The organic group is an alkyl group having 1 to 18 carbon atoms, an alkenyl group having 2 to 18 carbon atoms, an aryl group having 6 to 18 carbon atoms, an aralkyl group having 7 to 18 carbon atoms and an alicyclic group having 5 to 20 carbon atoms. Moreover, a halogen atoms, a carboxylic group or a hydroxy group may be substituted for the foregoing organic substitutional group. A lower alkyl group, such as a methyl group, an ethyl group or a propyl group, may be substituted for the aryl group, the aralkyl group or the alicyclic group in the range of the above-mentioned number of carbon atoms.

The organic silicon compound which can be employed in the present invention is exemplified as follows. Note that the present invention is not limited to the following description.

Preferred polyorganopolysiloxane is exemplified by: a dialkylsiloxane group incorporating an alkyl group having 1 to 5 carbon atoms, an alkyl group, an amino group or a hydroxy group having, as a repeated unit, a dialkoxysiloxane incorporating an alkoxy group having 1 to 5 carbon atoms and a terminal having 1 to 5 carbon atoms; polysiloxane which is a hydroxyalkyl group having 1 to 5 carbon atoms or an alkoxy group having 1 to 5 carbon atoms and which has a degree of polymerization of 2 to 12; and polysiloxane which has, as a repeated unit, methoxyethoxysiloxane which incorporates a terminal which is a hydroxy group, a methoxy group or an ethoxy group and which has a degree of polymerization of 2 to 12. Specifically, any one of the following silicon oil may be employed: dimethylsiloxane having a degree of polymerization of 2 to 10, dimethylsiloxane-diphenylsiloxane copolymer having a degree of polymerization of 2 to 10, dimethylsiloxane-diphenylsiloxane copolymer having a degree of polymerization of 2 to 8 and dimethylsiloxane-monomethylsiloxane copolymer having a degree of polymerization of 2 to 8. The terminal of the foregoing silicon oil is a trimethylsilane group. Also any one of the following materials may be employed: 1,3-bis(3-aminopropyl)tetramethyidisiloxane, 1,5-bis(3-aminopropyl) hexamethyltrisiloxane, 1,3-dibutyl-1,1,3,3-tetramethyldisiloxane, 1,5-dibutyl-1,1,3,3,5,5-hexaethyltrisiloxane, 1,1,3,3,5,5-hexaethyl-1,5-dichlorotrisiloxane, 3-(3,3,3-trifluoropropyl)-1,1,3,3,5,5,5-heptamethyl-trisiloxane and decamethyltetrasiloxane.

A most preferred compound is so-called silicon oil which is exemplified by dimethyl silicon oil (for example, silicon KF96 (manufactured by Shin-Etsu Chemical Co., Ltd.) is marketed), methylphenyl silicon oil (for example, silicon KF50 (manufactured by Shin-Etsu Chemical Co., Ltd.) is marketed) and methylhydrogen silicon oil (for example, silicon KF99 (manufactured by Shin-Etsu Chemical Co., Ltd.) is marketed).

Also any one of the following silane compound may be employed; n-decyltrimethoxysilane, n-decyltri-t-butoxysilane, n-octadecyltrimethoxysilane, n-octadecyltriethoxysilane and dimethoxydiethoxysilane.

To perform heating to raise the temperature to the hydrophobicity developing temperature in the atmosphere of the organic compound, a container in which the organic compound has been introduced is placed in a mantole of a heating portion which covers the surface of the printing plate. During the heating operation, steam of the organic compound is caused to present in the mantle. Another method may be employed with which paper or a cloth impregnated with the organic compound is inserted into the mantle so as to be heated.

The printing plate is processed such that a lipophilic image is applied to the surface of the thermal responsive substance. Then, the printing plate can directly be supplied to an offset printing step without a necessity of performing a developing process.

Therefore, a multiplicity of advantages including the easiness and simplicity can be realized as compared with a usual and conventional flat-plate printing method. That is, the foregoing chemical process using alkali developing solution is not required. Therefore, a wiping operation and a brushing operation are not required. Moreover, discharge of waste of the developing solution causing a load on the environment can be omitted. Another advantage can be realized in that an image forming means can be selected from a wide range. Thus, the above-mentioned simple image recording means may be employed to easily perform the printing operation.

The non-image portion of the flat-plate printing plate obtained from the thermal responsive substance has a sufficient hydrophilic nature. If necessary, a post-treatment may be performed by using cleaning water, a rinsing solution containing a surface active agent or the like or a desensitizer containing arabic gum or a starch derivative. As the post-treatment which is performed when the image recording material according to the present invention is used as the material of the printing plate, the foregoing processes may variably be combined with one another.

As the post-treatment, any one of the following methods may be employed: a method with which sponge or absorbent cotton impregnated with the foregoing surface treatment solution is used to apply the solution to the surface of the flat printing plate, a method with which the printing plate is immersed in a vat filled with the surface treatment solution to apply the solution and a method with which an automatic coater is used. When a squeeze or a squeeze roller is used to uniform the quantity of application after the application has been performed, a preferred result can sometimes be obtained. In general, it is preferable that the quantity of application of the surface treatment solution is 0.03 to 0.8 $g/m^2$ (dry weight).

The flat printing plate obtained as a result of the foregoing processes is mounted on an offset printing machine or the like or made on the printing machine to print a multiplicity of sheets.

1-4. Reuse of Printing Plate

A step for reuse the printing plate used in the printing process will now be described.

Ink allowed to adhere to the printing plate after it has been used in the printing operation is removed by a cleaning operation by using petroleum solvent. As the solvent, marketed printing ink dissolving solution is employed which is made of aromatic hydrocarbon which is, for example, kerosene, isoperm, benzole, toluole, xylol, acetone, methylethylketone and their mixed solvent. When the image substance is not dissolved, a cloth or the like is used to wipe off the same with a light load. When 1/1 mixed solvent of toluene/dieclean is used, a satisfactory result is sometimes obtained.

When the printing plate from which ink has been removed by cleaning is heated to the higher hydrophilicity developing temperature, the hydrophilic is again imparted to the overall surface of the printing plate. At this time, the temperature is raised to 200° C. or higher which is higher than the upper limit of the hydrophobicity developing temperature. It is preferable that the duration of heating at a level slightly higher than the upper limit of the temperature is 10 minutes or longer, about five minutes when the temperature is 50° C. or higher and about two minutes when the temperature is 100° C. or higher. If the duration of the heat treatment is elongated, no problem arises. If the duration is elongated after the hydrophilic nature of the surface has been recovered, no advantage can be realized.

The heat source for use in the reuse process may be an arbitrary means if the employed means is able to satisfy the foregoing temperature and time conditions. The heating means is exemplified by radiation heating which is arranged to directly apply infrared rays, indirect application of infrared rays which is performed such that a heating-ray absorbing sheet, such as black carbon paper, is brought into contact with the surface of the printing plate, insertion into an air thermostatic chamber set to a predetermined temperature, contact heating with a heating plate, such as a hot plate and contact with a heating roller. The printing plate reproduced from the used printing plate is stored such that exposure to active light is prevented so as to be used in a next printing process.

The number of times the printing plate according to the present invention is repeatedly reproduced is not completely detected. The number of times is 15 or more. It is considered that the number of times is limited by contamination of the surface of the printing plate which cannot be removed, damage which cannot practically be repaired and mechanical deformation (distortion) of the material of the printing plate.

1-5. Printing Apparatus

Next, an apparatus in which the printing plate is mounted to perform printing will now be described with reference to the drawings.

The printing plate having the surface which incorporates the thermal responsive substance may be secured as a component of a printing cylinder or structured to be detachable. In the description with reference to FIG. 2 and following figures, a former example in which the printing cylinder is the printing plate will now be described with which the simplicity, which is the characteristic of the present invention, can be exhibited.

Figure 2:
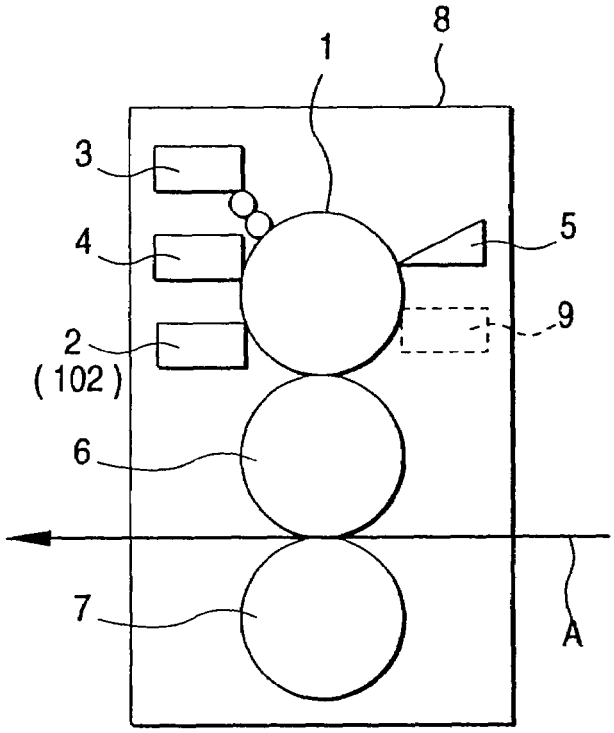
FIG. 2 is a diagram showing the structure of an offset printing apparatus according to a first embodiment of the present invention.

FIG. 2 is a diagram showing the structure of the offset printing apparatus according to a first embodiment of the present invention. As shown in FIG. 2, the offset printing apparatus according to the first embodiment of the present invention incorporates a printing cylinder 1 having the surface which incorporates a thermal responsive substance, such as titanium oxide or zinc oxide; a heating unit 2 which heats the printing cylinder 1 at the higher hydrophilicity developing temperature to cause the overall surface of the printing cylinder 1 to have the hydrophilic; a cooling unit 9 disposed at required portion to cool the printing cylinder heated at the high temperature to a level not higher than the hydrophobicity developing temperature; a thermal recording unit 5 for recording an image in a heat mode at the hydrophobicity developing temperature on the printing cylinder 1 caused to have the hydrophilic nature by heating; an ink/dampening water supply unit 3 for supplying ink and dampening water to the printing cylinder 1 on which an image has been recorded in the heat mode; an ink cleaning unit 4 for removing ink left on the printing cylinder 1 after the printing operation has been completed; a blanket 6 serving as an intermediate member for transferring ink held on the printing cylinder 1 to paper; and an impression drum 7 for holding supplied paper together with the blanket 6. The foregoing elements are accommodated in a body 8.

The thermal recording unit 5 will now be described.

To form a lipophilic image region on the printing cylinder 1, the overall surface of which has been caused to have the hydrophilic nature, the surface of the printing cylinder 1 is heated by the thermal recording unit 5 to correspond to the image. The means for heating the surface to correspond to the image may be an infrared-ray lamp, a laser beam or contact heating.

Figure 3:
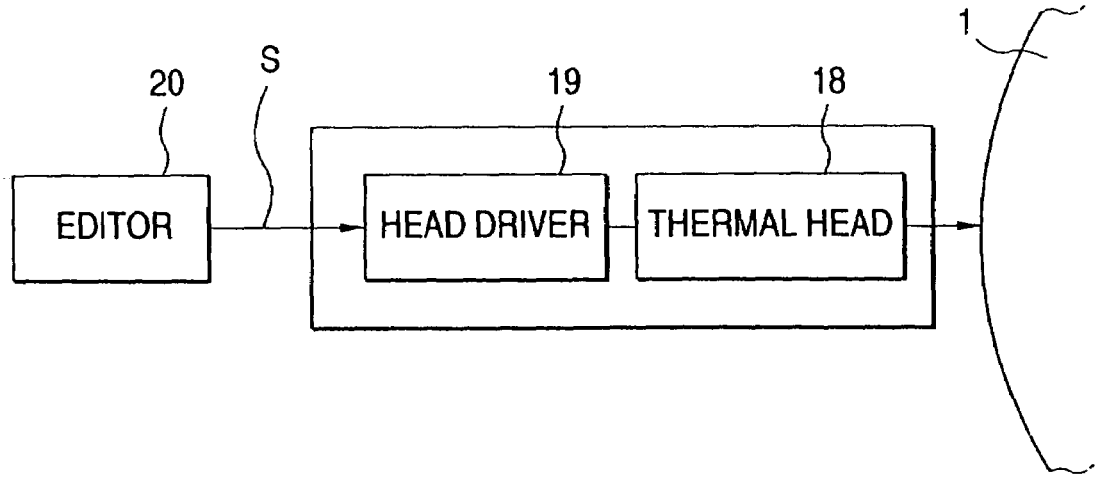
FIG. 3 is a diagram showing a first example of the thermal recording unit of FIG. 1.

FIG. 3 is a diagram showing a first example of the thermal recording unit 5. The contact heating type thermal recording unit 5 shown in FIG. 3 incorporates a thermal head 18 which is brought into contact with the surface of the printing cylinder 1 to record an image in the heat mode; and a head driver 19 for operating the thermal head 18 in response to an image signal S generated by an editor 20, such as a computer, a work station, or the like, from an image which must be printed and supplied to the recording unit so as to record the image in the heat mode on the surface of the printing cylinder 1. The thermal head 18 has a plurality of small heat generating members which extend in an array configuration or a matrix configuration in the direction of rotation of the printing cylinder 1. Thus, recording in the heat mode for each line or plural lines is performed. When the printing cylinder 1 is rotated, an image is recorded on the surface of the printing cylinder 1 in the heat mode. Portion of the printing cylinder 1 on which no image has been recorded are the hydrophilic non-image regions. On the other hand, the portion on which the image has been recorded is the lipophilic image region.

Figure 4:
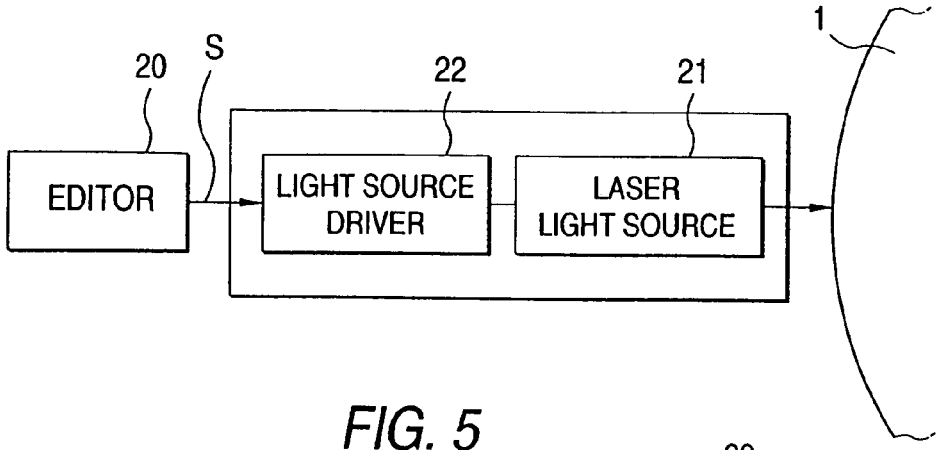
FIG. 4 is a diagram showing a second example of the thermal recording unit of FIG. 1.

FIG. 4 shows a second example of the thermal recording unit 5. The thermal recording unit 5 incorporates a laser light source 21 for emitting a laser beam to irradiate the printing cylinder 1; and a light source driver 22 for operating the laser light source 21 in response to image signal S generated by an editor 20, such as a computer, a work station, or the like, from an image to be printed and supplied to a recording unit to modulate the laser beam to record the image in the heat mode on the surface of the printing cylinder 1. The laser light source 21 is structured to relatively move the emitted laser beam with respect to the printing cylinder 1 in the direction of the rotational axis of the printing cylinder 1 so as to scan the surface of the printing cylinder 1. When the printing cylinder 1 is rotated, the surface of the printing cylinder 1 is exposed with the modulated laser beam. Thus, the portions of the printing cylinder 1 which have not been irradiated with the laser beam are hydrophilic non-image regions, while the portion irradiated with the laser beam is the lipophilic image region. Thus, recording in the heat mode is performed. It is preferable that the laser beam is the infrared laser beam. If the printing plate has a photothermal converting mechanism, the laser beam is not limited to the infrared laser beam.

When heat mode image recording is performed in the presence of organic compounds, an organic-compound steam supply means for introducing steam of the organic compounds to the thermal recording unit shown in FIGS. 3 and 4. The organic-compound steam supply means is, for example, a container filled with organic solvent to evaporate the same or a container of the above-mentioned type provided with air diffusing openings or a container of the above-mentioned type also provided with a simple heating means.

Figure 5:
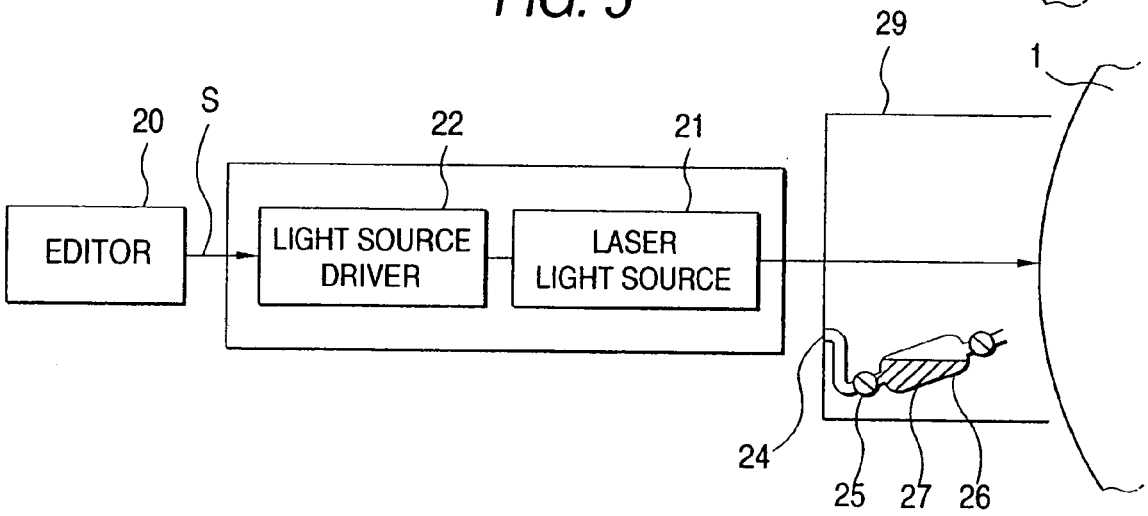
FIG. 5 is a diagram showing a third example of the thermal recording unit of FIG. 1.

FIG. 5 shows a third example of the thermal recording unit incorporating an organic-compound steam supply means for performing heat mode recording in a state in which the surface of the printing plate is exposed to an atmosphere containing steam of the organic compound. In the example shown in FIG. 5, the organic-compound steam supply means is combined with the laser light source 21 to perform thermal recording. Also application to the thermal head 18 for performing thermal recording is permitted.

In the organic-compound steam supply means 29 according to this embodiment, air is introduced through an air intake opening 24 so as to be, through a cock 25, supplied to an evaporating chamber 26 in which a separating funnel having an inner diameter of about 30 mm is laterally placed. The evaporating chamber is filled with the organic compound 27 (indicated with hatching) in such a manner that the capacity ratio is, for example, 50%. During passage of air through the organic compound 27 and the surface of the same, steam of the organic compound is introduced to the surface of the printing plate on the printing cylinder 1. Thus, recording is performed in an atmosphere of the mixture of air and steam. The quantity of steam of the organic compound is determined to be capable of enhancing the hydrophobic nature when the surface of the printing plate has been set to the hydrophobicity developing temperature. In a case of an organic compound (for example, methylethylketone or methyl cellosolve) which has a low boiling point and which can easily be vaporized, the lower portion of the evaporating chamber is simply filled with the organic compound. In a case of a compound (for example, hexyleneglycol) having a relatively high boiling point and requiring another means, a structure is employed in which diaton earth, silica particles or zeolite having a high percentage of voids is placed in the evaporating chamber together with the organic compound to raise the degree of contact with the introduced air and the organic compound. If the organic compound 27 is a solid material, such as naphthalene, it is charged into the evaporating chamber 26 at a proper percentage of voids. In a case of an organic compound having a furthermore high boiling point, a mechanism is employed which has a temperature control portion, an electric heater and a temperature sensor (not shown) and which is able to adjust the temperature in the evaporating chamber 26 to a level suitable to cause evaporation to occur. When, for example, silicon oil is used, diaton earth impregnated with silicon oil is placed in the lower half portion of the glass tube such that the capacity ratio is 50% and contact with air is permitted. The temperature of air is room temperature at the intake opening 24, and then the temperature is raised to 190° C. during passage through the tube by an electric heater (not shown).

As a matter of course, air containing the foregoing material is discharged to the outside portion. If necessary, air is purified before discharge.

Although the method has been described with which the laser beam is directly modulated, recording can, as a matter of course, similarly be performed when a combination of the laser beam and an external modulating device, such as an acoustic optical device is employed.

In the present invention, the thermal recording unit 5 incorporating the thermal recording head or arranged to use the laser beam may be structured to employ a photothermal heating method for applying heat rays, such as light of an infrared-ray lamp through an image mask which does not permit penetration of the heat ray. As an alternative to this, a photothermal conversion heating method may be employed with which high-luminance instantaneous flash using a large-capacity capacitor is performed through an image mask.

The operation of the first embodiment will now be described.

The portion of the printing cylinder 1 which rotates and passes through the heating unit 2. The overall surface of the printing cylinder 1 which has passed through the heating unit 2 is heated to the higher hydrophilicity developing temperature with heat emitted from the heating resistors of the heating unit 2. As a result, the surface of the printing cylinder 1 is changed from the lipophilic nature to the hydrophilic nature. After heating at the high temperature has been completed, the printing cylinder having the hydrophilic nature is cooled to a temperature not higher than the hydrophobicity developing temperature. To cool the printing cylinder, a natural cooling method owing to heat radiation is performed. Also a forcible cooling method is employed with which cooling water is supplied to a cooling jacket of the cooling unit 9 simultaneously with heating of the heating unit 2 or after heating has been completed. Thus, the portion of the rotating printing cylinder allowed to pass through the heating unit 2 and caused to have the hydrophilic nature is cooled by the cooling unit 9. In the thermal recording unit 5, heating to the hydrophobicity developing temperature is performed so that heat mode recording is performed. The region heated to correspond to the image is made to be an image region having the lipophilic nature, while the region which has not been heated is made to be a non-image region having the hydrophilic nature. After heat mode recording has been completed, ink and dampening water are supplied from the ink/dampening water supply unit 3 to the printing cylinder 1. As a result, ink is held in the lipophilic image region of the printing cylinder 1. On the other hand, no ink is held in the hydrophilic non-image region and dampening water is held.

Then, paper is supplied to a space between the blanket 6 and the impression drum 7 as indicated with an arrow A. Thus, ink held on the printing cylinder 1 is transferred to the paper through the blanket 5 so that offset printing is performed.

After printing has been completed, the ink cleaning unit 4 removes ink left on the printing cylinder 1. Then, the printing cylinder 1 is heated by the heating unit 2 so that the lipophilic region corresponding to the image and existing on the printing cylinder 1 is removed. Then, a state before recording in the heat mode is restored.

As described above, the offset printing apparatus according to the present invention is able to form a printing surface on the printing cylinder 1 only by high-temperature heating of the overall surface and by recording in the heat mode. As a result, offset printing can be performed which does not require development and which is able to maintain the sharpness of the printing surface. When the printing cylinder 1 is cleaned and again heated at the high temperature, the initial state can be restored. Therefore, the printing cylinder 1 can repeatedly be used. As a result, prints can be provided at a low cost. Since the necessity for removing the printing cylinder 1 from the printing apparatus can be eliminated, adhesion of dust or the like experienced with the conventional PS plate and occurring when the printing cylinder 1 is mounted to the printing apparatus can be prevented. As a result, the quality of the print can be improved.

The printing cylinder 1 is employed as the printing plate. Moreover, the heating unit 2, the ink/dampening water supply unit 3, the ink cleaning unit 4 and the thermal recording unit 5 disposed around the printing cylinder 1. Thus, simple rotation of the printing cylinder 1 enables the overall surface of the printing plate to have the hydrophilic nature, recording in the heat mode to be performed, supply of ink and dampening water to be performed and cleaning of ink to be performed after the printing operation has been performed. As a result, a compact apparatus can be realized, causing a required space to be saved.

1-6. Examples of Embodiment

Some examples of the present embodiment will be discussed.

EXAMPLE 1

A first example according to the present embodiment will now be described. The surface of a rolled plate containing 99.5 wt % aluminum, 0.01 wt % copper, 0.03 wt % titanium, 0.3 wt % of iron and 0.1 wt % silicon, made of JIS A1050 aluminum and having a thickness of 0.30 mm was dressed with 20 wt % aqueous suspension printing 400-mesh PAMISTON (manufactured by Kyoritsu Ceramic Materials) and a rotative nylon brush (6,10-nylon). Then, the surface was sufficiently cleaned with water.

The rolled plate was immersed in 15 wt % sodium hydroxide solution (containing aluminum by 4.5 wt %) to etch the rolled plate in such a manner that the quantity of dissolution of aluminum was 5 $g/m^2$. Then, the surface was cleaned with flowing water. Then, neutralization using 1 wt % nitric acid was performed. Then, the surface was coarsened by electrolysis in 0.7 wt % nitric acid solution (containing aluminum by 0.5 wt %) under conditions that rectangular alternating waveform voltage (current waveform which had current ratio r=0.90 and which was disclosed in Japanese Patent Publication No. 58-5796B) which was 10.5 volts at the moment of the anode and 9.3 volts at the moment of the cathode was used with the quantity of electric power was 160 $C/dm^2$ at the moment of the anode. After cleaning was performed by using water, the plate was immersed in 35° and 10 wt % sodium hydroxide to etch the plate in such a manner that the quantity of dissolution of aluminum was 1 $g/m^2$. Then, the surface was cleaned with water. Then, the plate was immersed in 50° C. and 30 wt % sulfuric acid solution so that desmut was performed. Then, the surface was cleaned with water.

Then, a process for forming a porous anode oxide film was performed in 35° C. and 20 wt % solution (containing aluminum by 0.8 wt %) by using a DC current. That is, electrolysis was performed at a current density of 13 $A/dm^2$. The duration of the electrolysis was adjusted so that the weight of the anode oxide film was made to be 2.7 $g/m^2$.

The obtained support member was cleaned with water and immersed in 70° C. and 3 wt % sodium silicate for 30 seconds, and then the support member was cleaned with water. Then, the support member was dried.

The thus-obtained aluminum support member resulted in a reflecting density of 0.30 measured by a Macbeth reflecting densitometer RD920 and an average roughness on the center line of 0.58 μm.

Then, the aluminum support member was introduced into a vacuum evaporating apparatus to electrically heat a titanium member under a condition that the partial pressure of oxygen gas was 70% to made the total pressure was $1.5\times10^{-4}$ Torr. Thus, titanium was evaporated to the surface of the aluminum support member so that a thin titanium oxide film was formed. The crystal components of the formed thin film were analyzed by an X-ray analysis method. As a result the ratio of amorphous crystal structure/anatase crystal structure/rutile crystal structure was 15/6.5/2. The thickness of the thin $TiO_2$ film was 900 angstrom. The formed thin film was wound around the base of the printing cylinder 1 so that printing plate for performing printing on the machine was obtained.

The heating resistors of the heating unit 2 were supplied with electric power, and then the printing cylinder 1 around which the printing plate was wound was slowly rotated. The printing plate allowed to pass through the heat generating portion was allowed to pass through a heating portion at which the temperature of the printing plate was raised to 300° C. or higher (highest temperature was 380° C.) in two minutes. Then, supply of electric power was interrupted, and then the printing plate was allowed to naturally stand to restore the temperature of the printing cylinder to the room temperatures. Then, the contact angle meter CA-D manufactured by Kyowa Interface Science Co., Ltd. was operated to measure the contact angle of the surface with respect to water by a water drop method in air. As a result, all of the portions satisfied a range from 7 degrees to 9 degrees.

Then, a heating-member array incorporating 150 μm×150 μm thermal heads each of which was configured such that a SIALON wear resisting protective layer was formed on a Ta—SiO2 heating resistor and disposed apart from one another for a distance of 250 μm in the thermal recording unit 5 was used so as to be brought into contact with the surface layer of titanium oxide so that printing of characters was performed at raised temperature. The operated thermal heed was heated to 210° C. owing to supply of electric power for 5 msec and 450° C. owing to supply of electric power for 10 msec. When electric power was continuously supplied while the surface of the anode oxide film having a low heat conductivity was being scanned at 2.5 m/sec, a fact was confirmed that the surface was maintained at substantially 210° C. by performing an individual measurement of the temperature. The recording speed was 2.5 m/sec. At this time, the contact angle was estimated from experimental example shown in FIG. 1. The contact angle with respect to water was estimated to be 50° by performing measurement by the water drop method in air by using the contact angle meter CA-D manufactured by Kyowa Interface Science Co., Ltd..

The printing cylinder 1 was mounted to the single-side printing apparatus OLIVER-52 manufactured by Sakurai Graphic Systems Co., Ltd. Graphic Systems Co., Ltd. Then, pure water serving as dampening water and ink which was Newchampion F-gloss 85 ink manufactured by Dainippon Ink & Chemicals, Incorporated were used in the ink/dampening water supply unit 3. Thus, offset printing was performed to make 1000 prints. Clear prints were obtained from start of the operation to the end of the same. Moreover, the printing cylinder 1 was free from any damage.

Then, the surface of the printing cylinder 1 was, in the ink cleaning unit 4, thoroughly cleaned with a waste impregnated with 1/1 mixed solution of printing ink cleaning solution DICLEAN R (released from Dainippon Ink & Chemicals, Incorporated) and toluene so that ink was removed. Then, electric power was again supplied to the heating unit 2 so as to perform heating under the same conditions. Then, the contact angle was measured by a method similar to the foregoing measurement in a state in which the temperature was lowered to the room temperatures. All portions of the printing cylinder 1 satisfied a range from 7 degrees to 9 degrees.

Then, an image different from the foregoing image was recorded on the surface of the printing cylinder 1 under the same conditions as those employed in the printing plate process.

The printing cylinder 1 was mounted to the single-side printing apparatus OLIVER-52 manufactured by Sakurai Graphic Systems Co., Ltd. Then, pure water serving as dampening water and ink which was Newchampion F-gloss 85 ink manufactured by Dainippon Ink & Chemicals, Incorporated were used in the ink/dampening water supply unit 3. Thus, offset printing was performed to make 1000 prints. Clear prints were obtained from start of the operation to the end of the same. Moreover, the printing cylinder 1 was free from any damage.

The foregoing operation was repeated five times. As a result, no change occurred in the value of the contact angle realized after heating at the high temperature, recovery speed of the contact angle owing to heating and sharpness of the image on the printing surface.

As a result, the printing plate having the aluminum support member on which the titanium oxide layer was formed and the printing apparatus according to the first embodiment enable printing to be performed by high temperature heating and heat mode printing. Moreover, the printing plate can repeatedly be reused only by removing ink by cleaning.

EXAMPLE 2

A SUS plate having a thickness of 100 microns was placed in a vacuum evaporating apparatus. Then, zinc oxide was evaporated to have a thickness of 1000 angstroms under a total vacuum pressure of $5\times10^{-3}$ Torr. Then, the SUS plate was subjected to a further oxidizing process at 600° C. for 2 hours which was performed in air so that a thin zinc oxide was formed on either side of the SUS plate.

The SUS plate having the zinc oxide film formed thereon and having the thickness of 100 microns was, similarly to Example 1, wound around the base of the printing cylinder 1 of the printing apparatus according to Example 1. Thus, a printing plate of a type on the machine was obtained.

The heating resistors of the heating unit 2 were supplied with electric power, and then the printing cylinder 1 around which the printing plate was wound was slowly rotated. The printing plate allowed to pass through the heat generating portion was allowed to pass through a heating portion at which the temperature of the printing plate was raised to 300° C. or higher (highest temperature was 380° C.) in two minutes. Then, supply of electric power was interrupted, and then the printing plate was allowed to naturally stand to restore the temperature of the printing cylinder to the room temperatures. Then, contact angle meter CA-D manufactured by Kyowa Interface Science Co., Ltd. was operated to measure the contact angle of the surface with respect to water by a water drop method in air. As a result, all of the portions satisfied a range from 15 degrees to 18 degrees.

Then, a heating-member array incorporating 150 μmm× 150 μm thermal heads each of which was configured such that a SIALON wear resisting protective layer was formed on a Ta—$SiO_2$ heating resistor and disposed apart from one another for a distance of 250 μm in the thermal recording unit 5 was used so as to be brought into contact with the surface layer of titanium oxide so that printing of characters was performed at raised temperature. When the scanning speed of the thermal head was 2.5 m/sec, the surface of zinc oxide was maintained at 210° owing to supply of electric power. The foregoing fact was confirmed by performing measurement performed individually. The recording speed was 2.5 m/sec.

The printing cylinder 1 was mounted to the single-side printing apparatus OLIVER-52 manufactured by Sakurai Graphic Systems Co., Ltd. Then, pure water serving as dampening water and ink which was Newchampion F-gloss 85 ink manufactured by Dainippon Ink & Chemicals, Incorporated were used in the ink/dampening water supply unit 3.

Thus, offset printing was performed to make 1000 prints. Clear prints were obtained from start of the operation to the end of the same. Moreover, the printing cylinder 1 was free from any damage.

Then, the surface of the printing cylinder 1 was, in the ink cleaning unit 4, thoroughly cleaned with a waste impregnated with 1/1 mixed solution of printing ink cleaning solution DICLEAN R (released from Dainippon Ink & Chemicals, Incorporated) and toluene so that ink was removed. Then, electric power was again supplied to the heating unit 5 so as to perform heating under the same conditions. Then, the contact angle was measured by a method similar to the foregoing measurement in a state in which the temperature was lowered to the room temperatures. All portions of the printing cylinder 1 satisfied a range from 15 to 18 degrees.

Then, an image different from the foregoing image was recorded on the surface of the printing cylinder 1 under the same conditions as those employed in the printing plate process.

The printing cylinder 1 was mounted to the single-side printing apparatus OLIVER-52 manufactured by Sakurai Graphic Systems Co., Ltd. Then, pure water serving as dampening water and ink which was Newchampion F-gloss 85 ink manufactured by Dainippon Ink & Chemicals, Incorporated were used in the ink/dampening water supply unit 3. Thus, offset printing was performed to make 1000 prints. Clear prints were obtained from start of the operation to the end of the same. Moreover, the printing cylinder 1 was free from any damage.

As a result, the printing plate having the SUS support member on which the zinc oxide layer was formed and the printing apparatus according to the first embodiment enable printing to be performed by high temperature heating and heat mode printing. Moreover, the printing plate can repeatedly be reused only by removing ink by cleaning.

EXAMPLE 3

An aluminum support member subjected to the anode oxidizing process similar to Example 1 was immersed in a 20% ethanol solution containing cesium ethoxide, titanium butoxide, lantan isobutoxide and niobium ethoxide corresponding to the stoichiometry of $CsLa_2NbTi_2O_{10}$ to hydrolyze the surface. Then, the aluminum support member was heated to 280° C. so that a thin film made of $CsLa_2NbTi_2O_{10}$ and having a thickness of 1000 angstroms was formed on the aluminum support member.

The aluminum support member having the thin film made of composite metal oxide was wound around the base of the printing cylinder to make the printing plate. The plate making process, printing, cleaning ink to remove the same and re-printing were performed similarly to Example 1 except for the foregoing process.

The contact angle of the hydrophilic region with respect to water owing to high temperature heating was 15° to 22° in each of the first and second operations. Also the quality of the printing surface was free from contamination in each of the first and second operations. Moreover, the identifying characteristic between the image region and the non-image was satisfactory.

EXAMPLE 4

The aluminum support member subjected to the coarsening process and the anode oxidizing process similar to that according to Example 1 was used to make a printing plate having barium titanate serving as a thermal responsive metal oxide. That is, the foregoing aluminum support member was introduced into a sputtering apparatus. Then, the internal gas was discharged to realize a vacuum of $5.0\times10^{-7}$ Torr. The support member was heated to 200° C., and then the gas pressure was set to $5\times10^{-3}$ Torr in such a manner that the ratio $Ar/O_2$ was 90/10 (molar ratio). Then, RF power of 200 W was supplied to a $SiO_2$ target so that a thin layer made of $SiO_2$ and having a thickness of 1 μm was formed. Then, the Ar gas pressure was set to $5\times10^{-3}$ Torr, and then RF power of 200 W to a Si target so that a Si thin film having a thickness of 1 μm was formed. Then, the Ar gas pressure was set to $5\times10^{-3}$ Torr, and then RF power of 200 W was supplied to a sintered target having a diameter of 6 inches and made of barium titanate. Thus, a thin film having a thickness of 1000 Å and made of barium titanate was formed. An X-ray analysis was performed, resulting in a fact that the formed thin film was in the form of polycrystal.

Processes for making printing plate, printing, removal of ink by performing cleaning and re-printing were performed similarly to Example 1 except for the following operation: the aluminum support member having the thin film made of barium titanate, the Si thin film having a photothermal converting characteristic and a heat insulating layer made of $SiO_2$ was wound around the base of the aluminum support member so as to be used as the printing plate; and an infrared laser-beam recording apparatus was employed in the thermal recording unit as a substitute for the thermal recording head.

The infrared laser-beam recording apparatus was operated such that solid infrared laser beam having an output of 500 mW was reduced to a beam width of 45 μm to perform scanning exposure so that recording was performed.

In the foregoing case, applied infrared rays were absorbed by the Si layer and, therefore, heat was generated. Therefore, the barium titanate layer could be heated.

In accordance with a result of a comparison with a result of the test with which measurement was performed owing to contact with the thermal head, a fact was detected that the temperature of the barium titanate layer in the light applied portion when the infrared laser recording was performed under the foregoing conditions was 250° C.

The contact angle of the hydrophilic region with respect to water owing to high temperature heating was 14° to 20° in each of the first and second operations. Also the quality of the printing surface was free from contamination in each of the first and second operations. Moreover, the identifying characteristic between the image region and the non-image was satisfactory.

EXAMPLE 5

A polyimide (pyromellitic dianhydride-m-phenylene diamine copolymer) film ("CAPTON" which was trade name of DuPont-Toray Co., Ltd.) having a thickness of 100 μm was used. Thus, a photothermal converting layer was formed similarly to Example 4. Then, a thin film made of titanium dioxide was formed on the photothermal converting layer so that a sample was obtained. That is, the aluminum support member was introduced into a sputtering apparatus, and then the inside gas was discharge to realize a vacuum of $5.0\times10^{-7}$ Torr. The support member was heated to 200° C., followed by setting the gas pressure to $5\times10^{-3}$ Torr in such a manner that the ratio $Ar/O_2$ was 90/10 (molar ratio). Then, RF power of 200 W was supplied to a $SiO_2$ target so that a $SiO_2$ thin layer having a thickness of 1 μm was formed. Then, the Ar gas pressure was set to $5\times10^{-3}$ Torr, and then RF power of 200 W was supplied to a Si target so that a Si thin film having a thickness of 1 μm was formed. Then, the gas pressure was set to $5\times10^{-3}$ Torr in such a manner that the ratio $Ar/O_2$ was 60/40 (molar ratio). Then, the gas pressure was set to $5\times10^{-3}$ Torr. Then, RF power of 200 W was supplied to a target made of titanium metal so that a thin film made of titanium dioxide was formed by evaporation. The crystal components of the formed thin film were X-ray analyzed, thus resulting in the ratio of the amorphous crystal structurelanatase crystal structure/rutile crystal structure was 15/6.5/2. The thickness of the thin film made of titanium dioxide was 900 angstroms. A polyimide support member having the titanium dioxide thin film, a Si thin film having a photothermal converting characteristic and a heat insulating layer made of $SiO_2$ formed thereon was wound around the base of the printing cylinder so as to be used as the printing plate. Moreover, an infrared laser-beam recording apparatus was employed as the thermal recording unit as a substitute for the thermal recording head. Similarly to Example 1, plate making, printing, removal of ink by performing cleaning and re-printing were performed except for the foregoing arrangements.

The infrared laser-beam recording apparatus was operated such that a solid infrared laser beam having an output of 500 mW reduced to a beam width of 45 μm to perform scanning exposure to perform recording.

The contact angle of the hydrophilic region with respect to water owing to high temperature heating was 11° to 17° in each of the first and second operations. Also the quality of the printing surface was free from contamination in each of the first and second operations. Moreover, the identifying characteristic between the image region and the non-image was satisfactory.

EXAMPLE 6

A glass tube (a separating funnel was used) having an inner diameter of about 30 mm was laterally placed at an air inlet portion of the thermal recording unit. Thus, air in the room was taken into the inside portion of the thermal recording unit through the foregoing glass tube. Diatom earth impregnated with silicon oil ("SILICON KF99" which was trade name of Shin-Etsu Chemical Co., Ltd.) was introduced into a lower half portion of the glass tube in such a manner that the capacity ratio was 50%. The temperature at the air intake portion was raised from the room temperature to 150° during passage through the glass tube. Since silicon KF99 has a vapor pressure of 1 mmHg or higher at the foregoing temperature, air introduced into the thermal recording unit contains steam of silicon KF99. The air exchange rate in the tubular thermal recording unit including a space having an internal capacity of 2 litters was 10 vol %/minute. Plate making and printing were performed by using the same printing plate and the same apparatus as those according to Example 1 except for the process for introducing steam of the organopolysiloxane compound. The used printing plate was reproduced by the same method to again perform the printing operation. A maximal contact angle of the image region on which an image was recorded in the heat mode with respect to water appeared when the temperature was 190° C. The value of the contact angle with respect to water (measured by using contact angle meter CA-D manufactured by Kyowa Interface Science Co., Ltd. and by the water drop method in air) was 73°. The result was compared with the result in Example 1. When heating to the temperature at which hydrophobicity was developed performed in the presence of steam of organic silicon compound, the temperature at which the contact angle was made to be a maximal value was changed. However, the contact angle was considerably enlarged so that the identifying characteristic between the lipophilic nature and the hydrophilic nature was improved.

Then, the foregoing printing plate was used to perform offset printing to make 1000 prints. Similarly to Example 1 clear prints were obtained from start to completion. When the printing operation was continued to make 5000 prints, visible ink contamination occurs in Example 1 in which printing was performed without presence of silicon KF99. In Example 6 in which printing was performed in the presence of silicon KF99, no ink contamination was observed. Also the printing cylinder 1 was free from any damage.

A second embodiment of the present invention will now be described.

2. Second Embodiment

Figure 6:
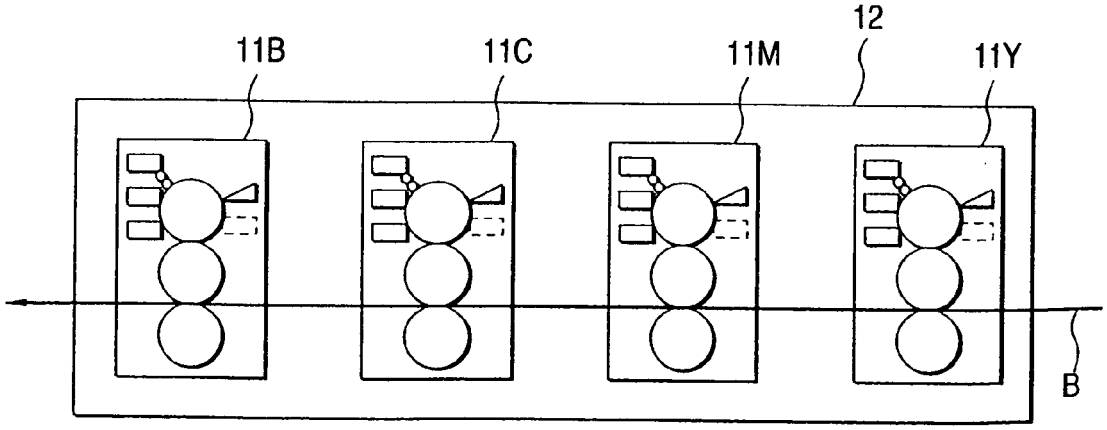
FIG. 6 is a diagram showing the structure of an offset printing apparatus according to a second embodiment of the present invention.

FIG. 6 is a diagram showing an offset printing apparatus according to a second embodiment of the present invention. The offset printing apparatus shown in FIG. 6 incorporates four printing units 11Y, 11M, 11C and 11B each of which is the offset printing apparatus shown in FIG. 2 and which are in series disposed in a body 12. Thus, Y (yellow), M (magenta), C (cyan) and B (Black) ink is used to perform color printing.

Since the structure and operation of each of the printing units 11Y, 11M, 11C and 11B are the same as those of the offset printing apparatus shown in FIG. 2, they are omitted from description. The second embodiment is different in that ink in Y (yellow), M (magenta), C (cyan) and B (Black) is supplied to the ink/dampening water supply unit of each of the printing units 11Y, 11M, 11C and 11B.

The operation of the second embodiment will now be described.

In the printing units 11Y, 11M, 11C and 11B, electric power is supplied to the heating resistors in the heating unit while the printing cylinder 1 is being rotated slowly. Then, the overall surface of the printing cylinder 1 is allowed to pass through the 350° C. heating unit in two minutes so that the overall surface of the printing cylinder is made to be hydrophilic. Then, thermal recording is performed by operating the thermal head according to Example 1 to record images in the foregoing colors in the heat mode. Ink in Y, M, C and B is supplied from the ink/dampening water supply unit of each of the printing units 11Y, 11M, 11C and 11B. Thus, ink and dampening water are held in the printing cylinder 1 of each of the printing units 11Y, 11M, 11C and 11B. Then, as indicated with an arrow B shown in FIG. 6, paper is supplied to transfer ink in each of the printing units 11Y, 11M, 11C and 11B to the paper. That is, ink in Y is transferred in the printing unit 11Y, ink in M is transferred in the printing unit 11M, ink in C is transferred in the printing unit 11C and ink in B is transferred in the printing unit 11B. As a result, a color image can be printed on the paper.

After the printing operation has been completed, the ink cleaning unit of each of the printing units 11Y, 11M, 11C and 11B removes ink left on the printing cylinder. Then, while printing cylinder 1 is being slowly rotated, electric power is supplied to the heating resistors in the heating unit. Thus, the overall surface of the printing cylinder 1 is heated to 350° C. for 15 second so that the printing cylinder 1 is restored to a state before recording is performed in the heat mode.

3. Third Embodiment

A third embodiment of the present invention will now be described.

Figure 7:
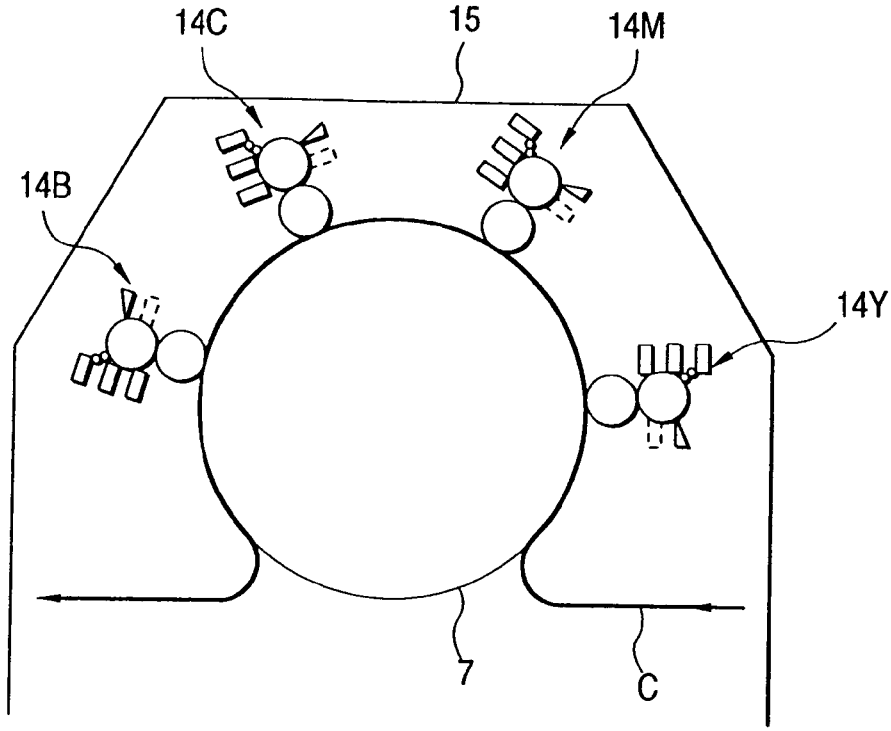
FIG. 7 is a diagram showing the structure of an offset printing apparatus according to a third embodiment of the present invention.
Figure 8:
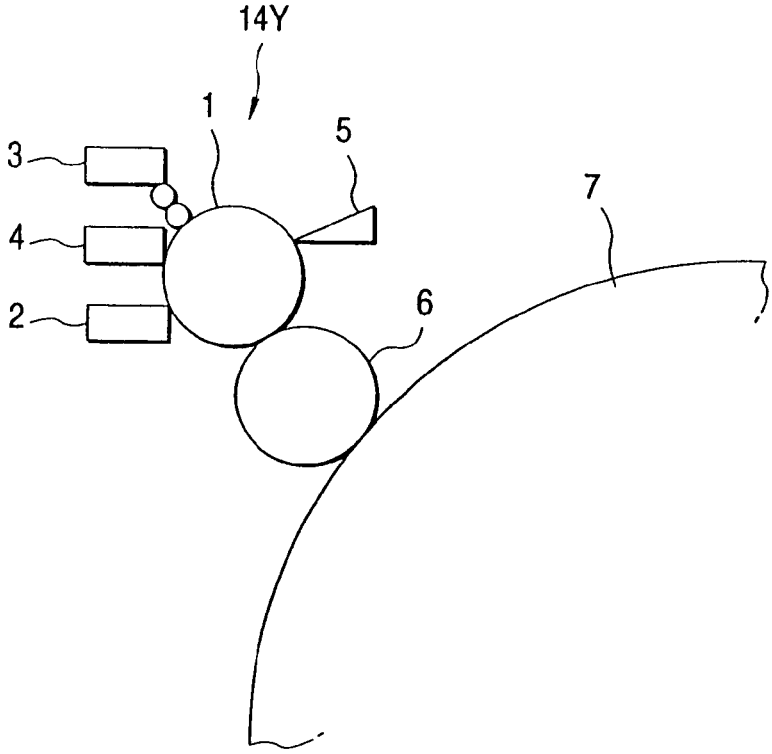
FIG. 8 is an enlarged view showing an essential portion of the printing apparatus of FIG. 7.

FIG. 7 is a diagram showing the structure of an offset printing apparatus according to a third embodiment of the present invention. FIG. 8 is an enlarged view showing an essential portion shown in FIG. 7. The offset printing apparatus shown in FIG. 7 incorporates the offset printing apparatuses each of which is shown in FIG. 2 and which are, in the body 15, disposed as printing stations 14Y, 14M, 14C and 14B around the impression drum 7. Thus, ink in Y (yellow), M (magenta), C (cyan) and B (Black) is used to perform color printing.

The structures of the printing stations 14Y, 14M, 14C and 14B are the same. Therefore, the printing station 14Y is shown in FIG. 7 as a representative station. As shown in FIG. 7 and similarly to the first embodiment, the printing station 14Y incorporates: a printing cylinder 1 having a surface mainly composed of thermal responsive substance, such as titanium oxide or zinc oxide; a heating unit 2 for heating the printing cylinder 1 to the higher hydrophilicity developing temperature and which is higher than the hydrophobicity developing temperature; a thermal recording unit 5 for recording an image in the heat mode on the printing cylinder 1 made to be hydrophilic owing to heating at the high temperature; an ink/dampening water supply unit 3 for supplying ink and dampening water to the printing cylinder 1 on which the image has been recorded in the heat mode; an ink cleaning unit 4 for removing ink left on the printing cylinder 1 after the printing has been completed; and a blanket 6 serving as an intermediate member for transferring ink held on the printing cylinder 1 to paper and made contact with the impression drum 7. Moreover, a cooling unit 9 incorporating a water-cooling jacket may be provided to forcibly cool the printing cylinder after the high-temperature heating operation has been completed.

The operations of the printing stations 14Y, 14M, 14C and 14B are the same as the operation of the offset printing apparatus shown in FIG. 2. Therefore, the operations are omitted from description. The third embodiment has a difference in that ink which is supplied from the ink/dampening water supply unit of each of the printing stations 14Y, 14M, 14C and 14B is Y (yellow), M (magenta), C (cyan) and B (black).

The operation of the third embodiment will now be described.

Initially, in the printing stations 14Y, 14M, 14C and 14B, the printing cylinder is heated to a high temperature not lower than an intermediate temperature level so that the overall surface of the printing cylinder is made to be hydrophilic. Then, images in the foregoing colors are, in the thermal recording unit, recorded in the heat mode at the hydrophobicity developing temperature. Ink in Y, M, C and B is supplied from the ink/dampening water supply unit of each of the printing stations 14Y, 14M, 14C and 14B to cause ink to be held on the printing cylinder 1 of each of the printing stations 14Y, 14M, 14C and 14B. Then, paper is supplied as indicated with an arrow C shown in FIG. 7, and then paper is conveyed around the impression drum 7. Thus, ink in each of the printing stations 14Y, 14M, 14C and 14B is transferred to the paper. That is, ink in Y is transferred in the printing station 14Y, ink in M is transferred in the printing station 14M, ink in C is transferred in the printing station 14C and ink in B is transferred in the printing station 14B. Thus, a color image is printed on the paper.

After the printing operation has been completed, ink left on the printing cylinder is removed by the ink cleaning unit of each of the printing stations 14Y, 14M, 14C and 14B. Then, the printing cylinder is heated at a high temperature under the same conditions as those in the above-mentioned process. Thus, the printing cylinder is restored to a state before recording is performed in the heat mode.

In the second and third embodiments, the four printing units 11Y, 11M, 11C and 11B or the four printing stations 14Y, 14M, 14C and 14B are employed to perform color printing. Five or more printing units or printing stations may be employed to perform color printing.

In the first to third embodiments, the printing cylinder 1 is employed. Note that the present invention is not limited to this. As a matter of course, the present invention can be applied to a structure in which a sheet-shape printing plate is used to perform offset printing.

In the first to third embodiments, the heating unit 2, the ink cleaning unit 4, the ink/dampening water supply unit 3 and the thermal recording unit 5 are clockwise disposed. The structure is not limited to this. The disposing order may arbitrarily be determined.

In each of the embodiments and examples, structures in each of which titanium oxide and zinc oxide is employed. The present invention is not limited to this, an arbitrary thermal responsive metal oxide or metal may be selected from the foregoing materials.

The printing method according to the present invention is configured such that the thermal responsive substance, in particular, the thermal responsive metal or metal oxide described in the specification are employed to form the image forming layer so that the printing plate was made. Then, the printing plate is heated to the higher hydrophilicity developing temperature to make the surface to be hydrophilic. Then, an image is recorded on the surface of the printing plate in the heat mode at the hydrophobicity developing temperature so that the printing plate is made. The method according to the present invention does not require a developing process and the like. Thus, the printing can directly be made. Moreover, ink on the printing plate is removed after the printing operation has been completed to permit reproduction and repeated use of the printing plate. In addition, since making the printing plate hydrophilic, recording in the heat mode, supplying ink and dampening water, printing, and reusing the printing plate can be performed in an identical printing apparatus, simple and low-cost offset printing can be conducted.

4. Fourth Embodiment

A fourth embodiment of the present invention will now be described.

4-1. Thermal Responsive Substance Having Photocatalyst Function

Initially, the "thermal responsive substance having the photocatalyst function" according to the present invention will now be described. The material of the printing plate according to the present invention is the substance having both of the photocatalyst function and the thermal response characteristic. The substance having the foregoing characteristics is not limited to the metal oxide. Also in consideration of requirements as the material of the printing plate, the foregoing characteristics are widely be detected among the metal oxide. Also the foregoing substance is detected among ceramic and semiconductors. The thermal responsive ceramic having the photocatalyst function is constituted by composite metal oxide. A major portion of the thermal response semiconductors having the photocatalyst function is detected in both of intrinsic semiconductors, such as silicon and germanium having close ground levels and conductivity and extrinsic semiconductors, such as vanadium oxide, which depend on the impurity level. The foregoing ceramic and semiconductors similar to the other metal oxide and metal from a viewpoint of the thermal response of the substance for use in the present invention. Therefore, the foregoing ceramic and semiconductors are included in the "thermal responsive metal oxide materials having the photocatalyst function" which will sequentially be described.

The metal oxide according to the present invention and having both the "thermal response characteristic" with which the hydrophobic nature is developed owing to adequate heating and the hydrophilic nature is developed owing to furthermore heating with the hysteresis phenomenon and the "photocatalyst function" with which the hydrophilic nature is developed owing to irradiation with activation light is detected among a variety of metal oxide materials.

Specifically, the "thermal responsive metal oxide materials having the photocatalyst function" may be substituted for the "thermal responsive metal oxide materials" described in connection with the first embodiment (see section 1-1). Since the same discussion can be applied, detailed explanations are omitted.

4-2. Printing Plate

The structure of the printing plate according to the present embodiment will now be described.

The printing plate according to the present embodiment may be structured variously and made of any one of a variety of materials. For example, any one of the foregoing methods may be employed: a method with which a thin layer made of the thermal responsive substance having the photocatalyst function is directly provided for the surface of a base of a printing cylinder by evaporation, immersion or coating; and a method with which a thin plate made of the thermal responsive substance and having no support member is wound around the base of the printing cylinder to make the printing plate.

As a matter of course, a usual method of mounting the made printing plate to a rotary press or a flat press as well as the foregoing method of making the printing plate on the printing cylinder.

When the thermal responsive substance having the photocatalyst function is provided for the surface of the support member, it is preferable that the support member is a metal plate which is free from thermal decomposition at the hydrophobicity developing temperature for performing recording an image in the heat mode and which exhibits dimensional stability. For example, an aluminum plate, a SUS plate, a nickel plate or copper plate is employed. In particular, it is preferable that a flexible metal plate is employed. Also a flexible plastic support member made of polyethylene or cellulose ester may be employed. An oxide layer may be provided for the surface of a support member, such as water-proofing paper, laminated polyethylene paper or impregnated paper. Any one of the foregoing structures may be employed as the printing plate.

Specifically, as the above materials, the materials described in connection with the first embodiment (see section 1-2) may be applied. Since the same discussion can be applied, detailed explanations are omitted.

4-3. Printing Method

Next, a printing method according to the present embodiment will be discussed.

According to the present embodiment, activation light is applied to the overall surface as a substitute for heating of the surface at the higher hydrophilicity developing temperature. Thus, the surface is made to be hydrophilic. When the photocatalyst function is used and activation light is employed, (1) a more uniform hydrophilic surface can be obtained by the irradiation with the activation light as compared with the heating method. (2) Cooling period of time is not required after the process for realizing the hydrophilic nature. That is, recording in the heat mode can immediately be performed. Therefore, the operation for making the plate can easily and quickly be performed. (3) No influence of the hysteresis during the preservation of the printing plate is exerted and satisfactory reproducibility of the hydrophilic nature can be realized in spite of dependency on the type of the material of the plate. (4) The process for heating at a high temperature for realizing the hydrophilic nature is not required. Therefore, the support member of the printing plate is not limited to heat resistance. Therefore, the support member can be selected from a wide range.

In the present invention in which the substance having the photocatalyst function and the thermal response characteristic is used, the hydrophilic nature is realized by applying activation light. Then, recording in the heat mode is performed at the hydrophobicity developing temperature. Therefore, recording can be performed without any influence of the hysteresis nature of the printing plate at a temperature at which optimum recording can be performed. Therefore, an advantage can be realized in that a printing plate with which the image region and the non-image can significantly clearly be distinguished from each other can be reproduced. Another advantage can be realized in that the following organic compound can be selected to be adaptable to the characteristic of the hydrophobicity developing temperature to improve the effect of distinguishing the hydrophilic nature and the hydrophobic nature. Thus, the quality of the printing plate can be improved.

Active light for realizing the hydrophilic nature by using the photocatalyst function is light having the wavelength corresponding to the photosensitive region of a thin layer made of the thermal responsive substance having the photocatalyst function, that is, the light absorbing region. When the thermal responsive substance is, for example, titanium oxide, the following materials has the following photosensitive regions in the ultraviolet region. That is, the anatase material has the photosensitive region in a region not higher than 387 nm, the rutile material has the photosensitive region in a region not higher than 413 nm, zinc oxide has the photosensitive region in a region not higher than 387 nm and a multiplicity of the other metal oxide has the photosensitive region in a region from 250 to 390 nm. Therefore, a mercury lamp, a tungsten halogen lamp, a metal halide lamp or a xenone discharge lamp may be employed. If beam scanning light is used in a case where the intervals of scanning beams are sufficiently narrow, that is, if the intervals are closed, substantially the same effect as that obtainable from a structure in which uniform irradiation is performed can be obtained. Therefore, a laser beam can be employed. As exciting light, helium-cadmium laser having an oscillating wavelength of 325 nm or a water-cooled argon laser having an oscillating wavelength of 351.1 to 363.8 nm may be employed. Also a zinc sulfide/cadmium laser having the oscillating wavelength of 330 nm to 440 nm may be employed.

When zinc oxide is employed, the spectral sensitization may be performed. Also in the foregoing case, any one of the foregoing light sources may be employed. Another light source, for example, a tungsten lamp having a spectral distribution in the spectral sensitization region may be employed.

The preferred intensity of irradiation light varies depending on the characteristic of the image forming layer of the thermal responsive substance having the photocatalyst function. Also the intensity varies depending on the wavelength of the activation light, the spectral distribution and light absorbance of the thermal responsive substance having the photocatalyst function. In usual, the plane exposure intensity before modulation with the image which must be printed is 0.05 to 100 joule/cm$^2$, preferably 0.05 to 10 joule/cm$^2$, and more preferably 0.05 to 5 joule/cm$^2$.

The photocatalyst reaction usually satisfies a reciprocity law. If exposure is performed with 10 mW/cm$^2$ for 100 seconds, or if exposure is performed with 1 W/cm$^2$ for one second, the same effect is usually obtained in many cases. In the foregoing case, the selection of the light source for emitting activation light can be performed from a wide range.

The quantity of irradiating light is a quantity with which a scanning method using a laser beam or plane exposure method using a dispersion light source can easily be embodied.

Another discussions related to the printing method are substantially the same with the discussion described in connection with the first embodiment (see section 1-3). Thus, detailed explanations are omitted.

4-4. Reuse of Printing Plate

A step for reuse the printing plate used in the printing process will now be described.

Ink allowed to adhere to the printing plate after it has been used in the printing operation is removed by a cleaning operation by using petroleum solvent. As the solvent, marketed printing ink dissolving solution is employed which is made of aromatic hydrocarbon which is, for example, kerosene, isoperm, benzole, toluole, xylol, acetone, methylethylketone and their mixed solvent. When the image substance is not dissolved, a cloth or the like is used to wipe off the same with a light load. When 1/1 mixed solvent of toluene/dieclean is used, a satisfactory result is sometimes obtained.

When the printing plate from which ink has been removed by cleaning is irradiated with activation light, the hydrophilic of the overall surface can uniformly be restored. The irradiation with activation light may be performed at arbitrary timing from a moment printing ink has been removed by cleaning to a moment recording in the heat mode is performed in a next plate making process. It is preferable that the irradiation is performed when the printing plate is reused in a next plate making process from a view point of eliminating an influence of the hysteresis during the preservation of the printing plate. The conditions under which activation light is applied have been described above.

The number of times the printing plate according to the present invention is repeatedly reproduced is not completely detected. The number of times is 15 or more. It is considered that the number of times is limited by contamination of the surface of the printing plate which cannot be removed, damage which cannot practically be repaired and mechanical deformation (distortion) of the material of the printing plate.

4-5. Printing Apparatus

Next, an apparatus in which the printing plate is mounted to perform printing will now be described with reference to FIG. 2.

The printing plate having the surface which incorporates the thermal responsive substance having the photocatalyst function may be secured as a component of a printing cylinder or structured to be detachable. Here, a former example in which the printing cylinder is the printing plate will now be described with which the simplicity, which is the characteristic of the present invention, can be exhibited.

FIG. 2 can be used for explaining the present embodiment by replacing the heating unit 2 with an irradiation unit 102. The same reference numerals can be used with any other members, and detailed explanations are omitted. In the present embodiment, the cooling unit 9 may be omitted.

The irradiation unit 102 employs a mercury lamp serving as a light source thereof. Another light source may be employed which is a xenon discharge lamp, a high-luminance halogen-tungsten lamp containing ultraviolet-ray component. A slit formed perpendicular to a direction of rotation of the printing cylinder permits slight light to scan and expose the overall surface when the printing cylinder has been rotated. The width of the slit is not required to a narrow width. The luminance, the width of the slit and the rotational speed of the printing cylinder are determined in such a manner that the quantity of received light with which the surface of the printing plate can be made to be hydrophilic during passage through the irradiation unit 102 can be obtained. As an alternative to the slit, a so-called ore-pipe lamp house having an irradiation width corresponding to the width of the printing cylinder may be employed.

Another structure may be employed in which the light source is a laser having an oscillation wavelength in an ultraviolet ray region, a visible ray region or a near infrared ray region, for example, helium-cadmium laser is mounted to use the laser beam. In the foregoing case, an apparatus is employed which performs scanning such that the beam width is enlarged to be 100 microns or greater. Thus, the overall surface can be irradiated with the laser beam.

To form a lipophilic image region on the printing cylinder 1, the overall surface of which has the uniform hydrophilic nature, the surface of the printing cylinder 1 is heated to the hydrophobicity developing temperature to correspond to the image by the thermal recording unit 5. As a means for heating the surface to correspond to the image, the foregoing infrared-ray lamp, the infrared-ray laser beam or a contact heating means may be selected.

The operation of the first embodiment will now be described.

The portion of the printing cylinder 1 which rotates and passes through the irradiation unit 102. The overall width of the surface of the printing cylinder 1 which has passed through the irradiation unit 102 is irradiated with activation light. As a result, the surface of the printing cylinder 1 is changed from the lipophilic nature to the hydrophobic nature. The printing cylinder having the overall surface changed to the hydrophilic nature is, in the thermal recording unit 5, heated to the hydrophobicity developing temperature so that recording in the heat mode is performed. The region heated to corresponding to the image is made to be a lipophilic image region, while the region which has not been heated is made to be a hydrophilic non-image. After recording in the heat mode has been completed, ink and dampening water are supplied from the ink/dampening water supply unit 3 to the printing cylinder 1. As a result, ink is held in the lipophilic image region of the printing cylinder 1. On the other hand, no ink is held in the hydrophilic non-image region and dampening water is held.

Then, paper is supplied to a space between the blanket 6 and the impression drum 7 as indicated with an arrow A.

Thus, ink held on the printing cylinder 1 is transferred to the paper through the blanket 5 so that offset printing is performed.

After printing has been completed, the ink cleaning portion 4 removes ink left on the printing cylinder 1. Then, the printing cylinder 1 is allowed to pass through the irradiation unit 102 to cause the hydrophilic nature to be realized. Thus, the lipophilic region on the printing cylinder 1 corresponding to the image is erased. Then, a state before recording in the heat mode is restored.

As described above, the offset printing apparatus according to the present embodiment is able to form a printing surface on the printing cylinder 1 only by irradiation with activation light and recording in the heat mode. As a result, offset printing can be performed which does not require development and which is able to maintain the sharpness of the printing surface. When the printing cylinder 1 is cleaned and again irradiated with activation light, the initial state can be restored. Therefore, the printing cylinder 1 can repeatedly be used. As a result, prints can be provided at a low cost. Since the necessity for removing the printing cylinder 1 from the printing apparatus can be eliminated, adhesion of dust or the like experienced with the conventional PS plate and occurring when the printing cylinder 1 is mounted to the printing apparatus can be prevented. As a result, the quality of the print can be improved.

The printing cylinder 1 is employed as the printing plate. Moreover, the irradiation unit 102, the ink/dampening water supply unit 3, the ink cleaning portion 4 and the thermal recording unit 5 disposed around the printing cylinder 1. Thus, simple rotation of the printing cylinder 1 enables the overall surface of the printing plate to have the hydrophilic nature, recording in the heat mode to be performed, supply of ink and dampening water to be performed and cleaning of ink to be performed after the printing operation has been performed. As a result, a compact apparatus can be realized, causing a required space to be saved.

The present embodiment configured such that the irradiation with light is performed to cause the overall surface to have the hydrophilic nature and recording in the heat mode are combined with each other. When a comparison is made with the method with which both of the hydrophilic nature and the heat mode are realized by heating, the following advantages can be realized: (1) a uniform hydrophilic surface can be obtained; (2) recording in the heat mode can be performed immediately after the process for realizing the hydrophilic nature. That is, simple and quick system can be structured; (3) no influence of the hysteresis is exerted and satisfactory reproducibility can be obtained; (4) the support member of the printing plate can be selected from a wide range. The recording in the heat mode is performed at the hydrophobicity developing temperature. Therefore, recording can be performed without any influence of the hysteresis of the printing plate and at the temperature at which optimum recording can be performed. Therefore, an advantage can be obtained in that a printing plate which permits easily distinguish the image region and the non-image region from each other with a satisfactory reproducibility. Another advantage can be obtained in that selection of an organic compound adaptable to the characteristic of the hydrophobicity developing temperature and performing of recording in the presence of the organic compound enables the effect of distinguishing the hydrophilic nature and the hydrophobic nature from each other to be improved. As a result, the quality of the printing plate can be improved.

4-6. Examples of Embodiment

Some examples of the present embodiment will be discussed.

EXAMPLE 1

Using a printing plate prepared under the condition as same as Example 1 described in connection with the first embodiment (see section 1-6), the irradiation unit 102 was US10 printi URM 600 GH60201X (manufactured by Ushio Inc.). The intensity of light was set to be 100 mW/cm$^2$ and the printing cylinder was rotated at a rotational speed with which the passing time was 15 seconds. Then, contact angle meter CA-D (manufactured by Kyowa Interface Science Co., Ltd.) was operated to measure the contact angle of the surface with respect to water by a water drop method in air. As a result, all of the portions satisfied a range from 7 to 9 degrees.

Then, a heating-member array incorporating 150 μm×150 μm thermal heads each of which was structured such that a SIALON wear resisting protective layer was formed on a Ta—$SiO_2$ heating resistor and disposed apart from one another for a distance of 250 μm in the thermal recording unit 5 was used so as to be brought into contact with the surface layer of titanium oxide so that printing of characters was performed at raised temperature. The operated thermal heed was heated to 210° C. owing to supply of electric power for 5 msec and 450° C. owing to supply of electric power for 10 msec. When electric power was continuously supplied while the surface of the anode oxide film having a low heat conductivity was being scanned at 2.5 m/sec, a fact was confirmed that the surface was maintained at substantially 210° C. by performing an individual measurement of the temperature. The recording speed was 2.5 m/sec. At this time, the contact angle was estimated to be 50° or smaller from experimental example shown in FIG. 1.

The printing cylinder 1 was mounted to the single-side printing apparatus OLIVER-52 manufactured by Sakurai Graphic System Co., Ltd. Then, pure water serving as dampening water and ink which was Newchampion F-gloss 85 ink manufactured by Dainippon Ink & Chemicals, Incorporated were used in the ink/dampening water supply unit 3. Thus, offset printing was performed to make 1000 prints. Clear prints were obtained from start of the operation to the end of the same. Moreover, the printing cylinder 1 was free from any damage.

Then, the surface of the printing cylinder 1 was, in the ink cleaning unit 4, thoroughly cleaned with a waste impregnated with 1/1 mixed solution of printing ink cleaning solution DICLEAN R (released from Dainippon Ink & Chemicals Incorporated) and toluene so that ink was removed. Then, electric power was again supplied to the irradiation unit 102 so as to perform irradiation under the same conditions. After that, the US10 printing light source apparatus Unilec URM 600 GH60201X in the irradiation unit 102 was operated to apply ultraviolet rays. Then, the contact angle was measured by a method similar to the above-mentioned process. All portions of the printing cylinder 1 satisfied a range from 7 to 9 degrees.

Then, the surface of the printing cylinder 1 was heated by the thermal head to correspond to the image.

The printing cylinder 1 was mounted to the single-side printing apparatus OLIVER-52 manufactured by Sakurai Graphic Systems Co., Ltd. Then, pure water serving as dampening water and ink which was Newchampion F-gloss 85 ink manufactured by Dainippon Ink & Chemicals Incorporated were used in the ink/dampening water supply unit 3.

Thus, offset printing was performed to make 1000 prints. Clear prints were obtained from start of the operation to the end of the same. Moreover, the printing cylinder 1 was free from any damage.

The foregoing operation was repeated five times. As a result, no change occurred in the value of the contact angle realized after heating at the high temperature, recovery speed of the contact angle owing to heating and sharpness of the image on the printing surface.

Therefore, the printing plate having the aluminum support member on which the titanium oxide layer was formed and the printing apparatus according to the present embodiment enable printing to be performed by irradiation with active light and heat mode printing. Moreover, the printing plate can repeatedly be reused only by removing ink by cleaning.

EXAMPLE 2

Under the condition as same as Example 2 described in the first embodiment (see section 1-6), similarly to Example 1, the irradiation unit 102 incorporating the US10 printing light source apparatus Unilec URM 600 GH60201X was operated such that irradiation was performed while the printing cylinder 1 was being slowly rotated. The contact angle of the surface of the printing plate irradiated with light with respect to water was measured by contact angle meter CA-D manufactured by Kyowa Interface Science Co., Ltd. by a water drop method in air. As a result, all of the portions satisfied a range from 20 to 27 degrees.

Then, a heating-member array incorporating 150 μm×150 μm thermal heads each of which was configured such that a SIALON wear resisting protective layer was formed on a Ta—$SiO_2$ heating resistor and disposed apart from one another for a distance of 250 μm in the thermal recording unit 5 was used so as to be brought into contact with the surface layer of zinc oxide so that printing of characters was performed at raised temperature. When the scanning speed of the thermal head was 2.5 m/sec, the surface of zinc oxide was maintained at 200° C. owing to supply of electric power. The foregoing fact was confirmed by performing measurement performed individually.

Then, the surface of the printing cylinder 1 was, in the ink cleaning unit 4, thoroughly cleaned with a waste impregnated with 1/1 mixed solution of printing ink cleaning solution DICLEAN R (released from Dainippon Ink & Chemicals Incorporated) and toluene so that ink was removed. Then, electric power was again supplied to the irradiation unit 102 so as to perform irradiation under the same conditions. After that, the US10 printing light source apparatus Unilec URM 600-GH60201X in the irradiation unit 102 was operated to apply ultraviolet rays. Then, the contact angle was measured by a method similar to the above-mentioned process. All portions of the printing cylinder 1 satisfied a range from 20 to 27 degrees.

Then, the surface of the printing cylinder 1 was heated by the thermal head to correspond to the image.

The printing cylinder 1 was mounted to the single-side printing apparatus OLIVER-52 manufactured by Sakurai Graphic Systems Co., Ltd. Then, pure water serving as dampening water and ink which was Newchampion F-gloss 85 ink manufactured by Dainippon Ink & Chemicals Incorporated were used in the ink/dampening water supply unit 3. Thus, offset printing was performed to make 1000 prints. Clear prints were obtained from start of the operation to the end of the same. Moreover, the printing cylinder 1 was free from any damage.

The foregoing operation was repeated five times. As a result, the printing plate having the SUS support member on which the zinc oxide layer was formed and the printing apparatus according to the present embodiment enable printing to be performed by irradiation of the overall surface with active light and heat mode printing. Moreover, the printing plate can repeatedly be reused only by removing ink by cleaning.

EXAMPLE 3

Under the condition as same as Example 3 described in the first embodiment (see section 1-6), the plate making process, printing, cleaning ink to remove the same and re-printing were performed similarly to Example 1.

As a result, the contact angle of the hydrophilic region with respect to water after irradiation with activation light was 15 to 22 degrees in each of the first and second operations. Also the quality of the printing surface was free from contamination in each of the first and second operations. Moreover, the identifying characteristic between the image region and the non-image was satisfactory.

EXAMPLE 4

Under the condition as same as Example 4 described in the first embodiment (see section 1-6), the plate making process, printing, cleaning ink to remove the same and re-printing were performed similarly to Example 1.

As a result, the contact angle of the hydrophilic region with respect to water owing to irradiation with ultraviolet rays was 14° to 20° in each of the first and second operations. Also the quality of the printing surface was free from contamination in each of the first and second operations. Moreover, the identifying characteristic between the image region and the non-image was satisfactory.

EXAMPLE 5

Under the condition as same as Example 5 described in the first embodiment (see section 1-6), the plate making process, printing, cleaning ink to remove the same and re-printing were performed similarly to Example 1.

As a result, the contact angle of the hydrophilic region with respect to water owing to high temperature heating was 11 to 17 degrees in each of the first and second operations. Also the quality of the printing surface was free from contamination in each of the first and second operations. Moreover, the identifying characteristic between the image region and the non-image was satisfactory.

EXAMPLE 6

Under the condition as same as Example 6. described in the first embodiment (see section 1-6), the plate making process, printing, cleaning ink to remove the same and re-printing were performed similarly to Example 1.

As a result, a maximal contact angle of the image region on which an image was recorded in the heat mode with respect to water appeared when the temperature was 190° C. The value of the contact angle with respect to water was 77 degrees. The result was compared with the result in Example 1. When heating to the temperature at which hydrophobicity was developed performed in the presence of steam of organic silicon compound, the temperature at which the contact angle was made to be a maximal value was changed. However, the contact angle was considerably enlarged so that the identifying characteristic between the lipophilic nature and the hydrophilic nature was improved.

Then, the foregoing printing plate was used to perform offset printing to make 1000 prints. Similarly to Example 1, clear prints were obtained from start to completion. When the printing operation was continued to make 5000 prints, visible ink contamination occurs in Example 1 in which printing was performed without presence of silicon KF99. In the present example in which printing was performed in the presence of silicon KF99, no ink contamination was observed. Also the printing cylinder 1 was free from any damage.

EXAMPLE 7

Tubular heat recording was performed by the same method as that according to the foregoing embodiment except for the structure that silicon KF99 according to Example 6 was changed to organic compounds. Results were shown in Table 1. As can be understood from Table 1, recording performed by the thermal recording unit 5 such that the organic compound was present enabled the difference between the hydrophobic nature and the lipophilic nature of the image region and the non-image region to be made clearer. It leads to a fact that durability against increase in the number of prints was improved. In Table 1, contamination with ink was evaluated such that no contamination after 5000 prints were made was given mark O, and allowable range and visible contamination was given mark Δ.

TABLE 1

| organic compound | boiling point (° C.) | contact angle image region | contact angle non-image region | contamination |
|---|---|---|---|---|
| 2,2,4-trimethylpentane | 99 | 78 | 8 to 10 | ○ |
| cyclohexane | 131 | 75 | 8 to 10 | ○ |
| 1-dodecanol | 255 | 70 | 8 to 10 | ○ |
| n-hexadecane | 287 | 65 | 7 to 9 | ○ |
| no organic compound | | 46 | 7 to 9 | Δ |

5. Fifth Embodiment

A second embodiment of the present invention will now be described with reference to FIG. 6.

As well as the second embodiment, a printing apparatus according to the present embodiment can be realized by four printing units each of which is the offset printing apparatus of the fourth embodiment are in series disposed in a body 12. Thus, Y (yellow), M (magenta), C (cyan) and B (Black) ink is used to perform color printing.

Since the structure and operation of each of the printing units 11Y, 11M, 11C and 11B are the same as those of the offset printing apparatus of the fourth embodiment, they are omitted from description.

The operation of the present embodiment will now be described.

In the printing units 11Y, 11M, 11C and 11B, the US10 printing light source apparatus Unilec URM600 GH60201X was turned on and the printing cylinder 1 was rotated. Then, the overall surface of the printing cylinder 1 is allowed to pass through the irradiation unit 102 in 15 minutes so that the overall surface of the printing cylinder is made to be hydrophilic. Then, thermal recording is performed by operating the thermal head according to the first embodiment to record images in the foregoing colors in the heat mode. Ink in Y, M, C and B is supplied from the ink/dampening water supply unit of each of the printing units 11Y, 11M, 11C and 11B. Thus, ink and dampening water are held in the printing cylinder 1 of each of the printing units 11Y, 11M, 11C and 11B. Then, as indicated with an arrow B shown in FIG. 6, paper is supplied to transfer ink in each of the printing units 11Y, 11M, 11C and 11B to the paper. That is, ink in Y is transferred in the printing unit 11Y, ink in M is transferred in the printing unit 11M, ink in C is transferred in the printing unit 11C and ink in B is transferred in the printing unit 11B. As a result, a color image can be printed on the paper.

After the printing operation has been completed, the ink cleaning portion of each of the printing units 11Y, 11M, 11C and 11B removes ink left on the printing cylinder. Then, while printing cylinder 1 is being slowly rotated, irradiation is conducted by the irradiation unit 102. Thus, the overall surface of the printing cylinder 1 is caused to have the hydrophilic nature so that the printing cylinder 1 is restored to a state before recording is performed in the heat mode.

6. Sixth Embodiment

A third embodiment of the present invention will now be described with reference to FIGS. 7 and 8.

As well as the third embodiment, a printing apparatus according to the present embodiment can be realized by four printing units each of which is the offset printing apparatus of the fourth embodiment are, in the body 15, disposed as printing stations 14Y, 14M, 14C and 14B around the impression drum 7. Thus, ink in Y (yellow), M (magenta), C (cyan) and B (Black) is used to perform color printing.

Since the structure of the apparatus of the present embodiment is the same as that of the offset printing apparatus of the third embodiment, they are omitted from description.

The operation of the present embodiment will now be described.

Initially, in the printing stations 14Y, 14M, 14C and 14B, the printing cylinder is irradiated with activation light in the irradiation unit so that the overall surface of the printing cylinder is made to be hydrophilic. Then, images in the foregoing colors are, in the thermal recording unit, recorded in the heat mode at the hydrophobicity developing temperature. Ink in Y, M, C and B is supplied from the ink/dampening water supply unit of each of the printing stations 14Y, 14M, 14C and 14B to cause ink to be held on the printing cylinder 1 of each of the printing stations 14Y, 14M, 14C and 14B. Then, paper is supplied as indicated with an arrow C shown in FIG. 6, and then paper is conveyed around the impression drum 7. Thus, ink in each of the printing stations 14Y, 14M, 14C and 14B is transferred to the paper. That is, ink in Y is transferred in the printing station 14Y, ink in M is transferred in the printing station 14M, ink in C is transferred in the printing station 14C and ink in B is transferred in the printing station 14B. Thus, a color image is printed on the paper.

After the printing operation has been completed, ink left on the printing cylinder is removed by the ink cleaning portion of each of the printing stations 14Y, 14M, 14C and 14B. Then, the printing cylinder is irradiated with activation light under the same conditions as those in the above-mentioned process. Thus, the printing cylinder is restored to a state before recording is performed in the heat mode.

In the fifth and sixth embodiments, the four printing units 11Y, 11M, 11C and 11B or the four printing stations 14Y, 14M, 14C and 14B are employed to perform color printing. Five or more printing units or printing stations may be employed to perform color printing.

In the fourth to sixth embodiments, the printing cylinder 1 is employed. Note that the present invention is not limited to this. As a matter of course, the present invention can be applied to a structure in which a sheet-shape printing plate is used to perform offset printing.

In the fourth to sixth embodiments, the irradiation unit 102, the ink cleaning portion 4, the ink/dampening water supply unit 3 and the thermal recording unit 5 are clockwise disposed. The structure is not limited to this. The disposing order may arbitrarily be determined.

In each of the embodiments and examples, structures in each of which titanium oxide and zinc oxide is employed. The present invention is not limited to this. The foregoing thermal responsive substance having the photocatalyst function may arbitrarily be selected.

The printing method according to the present invention is configured such that the thermal responsive substance, in particular, the thermal responsive substance having the photocatalyst function described in the specification is employed to form the image forming layer so that the printing plate was made. Then, the printing plate is irradiated with activation light to make the surface to be hydrophilic. Then, an image is recorded on the surface of the printing plate in the heat mode so that the printing plate is made. The method according to the present invention does not require a developing process and the like. Thus, the printing can directly be made. Moreover, ink on the printing plate is removed after the printing operation has been completed to permit reproduction and repeated use of the printing plate. In addition, the printing apparatus configured such that the printing plate is mounted to the printing cylinder of the printing machine to perform conversion to the hydrophilic nature, recording in the heat mode, supply of ink/dampening water and reproduction of the printing plate is used to perform simple and low-cost offset printing. The foregoing method and apparatus enables distinguishment between the image region and the non-image region from each other to be performed satisfactorily to improve the quality of prints as compared with the method with which the region in which the hydrophilicity is developed with high temperatures is caused to have the hydrophilic nature and the method with which the temperature is not adjusted to the hydrophobicity developing temperature.

7. Seventh Embodiment

A seventh embodiment of the present invention will now be described.

7-1. Thermal Responsive Substance Having Photocatalyst Function

The material of the printing plate according to the present embodiment is the substance having a "thermal response characteristic" with which the hydrophobic nature is realized owing to adequate heat and the hydrophilic nature is again realized owing to further added heat with a hysteresis phenomenon and a "photocatalyst function" with which hydrophilic nature is realized owing to irradiation with activation light.

The materials described in connection with the fourth embodiment can be adopted as the above "thermal responsive substance having photocatalyst function". Since the same discussion can be applied, detailed explanations are omitted.

7-2. Printing Plate

The structure of the printing plate according to the present embodiment will now be described.

The printing plate according to the present embodiment may be structured variously and made of any one of a variety of materials. Specifically, the materials and the structure described in connection with the fourth embodiment can be adopted. Since the same discussion can be applied, detailed explanations are omitted.

7-3. Printing Method

Next, a printing method according to the present embodiment will be discussed.

According to the present embodiment, heating is performed at the proper hydrophobicity developing temperature except for the higher hydrophilicity developing temperature, the overall surface is caused to have the hydrophobic nature. Then, the surface is irradiated with activation light to correspond to the image so that negative hydrophobic and hydrophilic image distribution in which the region irradiated with light has the hydrophilic nature can be obtained.

The present embodiment is characterized in the negative plate making method. When the heat treatment temperature is set to the hydrophobicity developing temperature, the hydrophobic nature and a uniform surface can be realized. Moreover, the photocatalyst function is used to improve the distinguishing capability between the hydrophobic regions and hydrophilic regions. Since no influence of the hysteresis of the printing plate during preservation is exerted, satisfactory reproducibility of the hydrophobic nature can be realized in the present invention. The foregoing characteristics are used to realize advantage that a printing plate exhibiting excellent capability of distinguishing image regions and non-image region can be manufactured with satisfactory reproducibility.

Another advantage can be obtained in that the process for heating the temperature to a high level is not required to realize the hydrophilic nature. Therefore, the support member is not required to have considerable heat resistance. Thus, the support member can be selected from a wide range.

Moreover, the organic compound caused to present in the atmosphere of the hydrophobicity developing temperature enhances the hydrophobic nature. Thus, the effect of distinguishing the hydrophilic regions and the hydrophobic regions from each other can furthermore be improved. As a result, the quality of the printing plate can be improved.

The light source of activation light with which the surface of the hydrophobic printing plate is irradiated is a light source for emitting light having the wavelength corresponding to the photosensitive region of the substance having the photocatalyst function, that is, the light absorbing region. When the substance having the photocatalyst function is, for example, titanium oxide, the following materials has the following photosensitive regions in the ultraviolet region. That is, the anatase material has the photosensitive region in a region not higher than 387 nm, the rutile material has the photosensitive region in a region not higher than 413 nm, zinc oxide has the photosensitive region in a region not higher than 387 nm and a multiplicity of the other metal oxide has the photosensitive region in an ultraviolet region from 250 nm to 390 nm. In a case of zinc oxide, the wavelength region of activation light can be widened by performing spectral sensitization by a known method in addition to the specific absorbing wavelength region (the ultraviolet region. Therefore, the light source is a light source which emits light in the foregoing wavelength regions. That is, the light source for emitting ultraviolet rays is employed.

The means for forming the distribution of the image in the hydrophilic region by using the photocatalyst action of activation light may be either of a plane exposure method or a scanning method.

When the plane exposure method is employed, an operation is performed such that uniform light is applied to the surface of the printing plate through a mask image (a lith film on which an original document to be printed has been developed) to cause the surface of the irradiated region to have the hydrophilic nature. When the support member is a transparent member, exposure may be performed from the reverse side of the support member through the support member and the mask image. A light source suitable to apply activation light by the plane exposure method is a mercury lamp, a tungsten halogen lamp, a metal halide lamp or a xenon discharge lamp. The duration of exposure is determined in such a manner that the foregoing intensity of exposure is obtained in consideration of the exposure luminance.

The preferred intensity of irradiation light varies depending on the characteristic of the image forming layer of the thermal response substance having the photocatalyst function. Also the intensity varies depending on the wavelength of the activation light, the spectral distribution and light absorbance of the thermal response substance having the photocatalyst function. In usual, the plane exposure intensity before modulation with the image which must be printed is 0.05 to 100 joule/$cm^2$, preferably 0.05 to 10 joule/$cm^2$, and more preferably 0.05 to 5 joule/$cm^2$.

The photocatalyst reaction usually satisfies a reciprocity law. If exposure is performed with 10 mW/$cm^2$ for 100 seconds, or if exposure is performed with 1 W/$cm^2$ for one second, the same effect is usually obtained in many cases. In the foregoing case, the selection of the light source for emitting activation light can be performed from a wide range.

In the latter case, that is, in a case of the scanning exposure, a method is employed in which the laser beam is electrically modulated with an image to scan the surface of the printing plate as a substitute for the image mask. The light source of the laser beam may be a known laser which oscillates activation light beam. For example, a helium-cadmium laser having an oscillation wavelength of 325 nm, a water-cooling argon laser having an oscillation wavelength of 351.1 to 363.8 nm or a zinc sulphide/cadmium laser having an oscillation wavelength of 330 nm to 440 nm may be employed as exciting light. Also gallium nitride InGaN quantum well laser detected to oscillate an ultraviolet laser or a near ultraviolet laser and having an oscillation wavelength of 360 to 440 nm or a waveguide MgO—$LiNbO_3$ inversion domain wavelength conversion type laser having an oscillation wavelength of 360 to 430 nm may be employed. The output of the laser beam may be 0.1 to 300 W in the irradiating process. When a pulse laser is employed, it is preferable that a laser having the peak output is 1000 W, preferably 2000 W is applied. When the support member is a transparent member, the laser beam may be applied from the reverse side of the support member through the support member to perform exposure.

The printing plate is processed such that a negative mode, lipophilic and hydrophilic image distribution is formed on the surface of the thermal response substance having the photocatalyst function. Then, the printing plate can directly be supplied to an offset printing step without a necessity of performing a developing process.

Therefore, a multiplicity of advantages including the easiness and simplicity can be realized as compared with a usual and conventional flat-plate printing method. That is, the foregoing chemical process using alkali developing solution is not required. Therefore, a wiping operation and a brushing operation are not required. Moreover, discharge of waste of the developing solution causing a load on the environment can be omitted. Another advantage can be obtained in that printing can easily be performed by using the above-mentioned simple image recording means.

Another discussions related to the printing method are substantially the same with the discussion described in connection with the fourth embodiment (see section 4-3). Thus, detailed explanations are omitted.

7-4. Reuse of Printing Plate

A step for reproducing the printing plate used in the printing process will now be described.

Ink allowed to adhere to the printing plate after it has been used in the printing operation is removed by a cleaning operation by using petroleum solvent. As the solvent, marketed printing ink dissolving solution is employed which is made of aromatic hydrocarbon which is, for example, kerosene, isoperm, benzole, toluole, xylol, acetone, methylethylketone and their mixed solvent. When the image substance is not dissolved, a cloth or the like is used to wipe off the same with a light load. When 1/1 mixed solvent of toluene/dieclean is used, a satisfactory result is sometimes obtained.

When the printing plate from which ink has been removed by cleaning is irradiated with active light, the hydrophilic of the overall surface can uniformly be restored. The irradiation with active light may be performed at arbitrary timing from a moment printing ink has been removed by cleaning to a moment recording in the heat mode is performed in a next plate making process. It is preferable that the irradiation is performed when the printing plate is reused in a next plate making process from a view point of eliminating an influence of the hysteresis nature during the preservation of the printing plate.

The number of times the printing plate according to the present embodiment is repeatedly reproduced is not completely detected. The number of times is 15 or more. It is considered that the number of times is limited by contamination of the surface of the printing plate which cannot be removed, damage which cannot practically be repaired and mechanical deformation (distortion) of the material of the printing plate.

7-5. Printing Apparatus

Next, an apparatus in which the printing plate is mounted to perform printing will now be described with reference to the drawings.

The printing plate having the surface which incorporates the thermal response substance having the photocatalyst function may be secured as a component of a printing cylinder or structured to be detachable. In the description with reference to FIG. 9 and following figures, a former example in which the printing cylinder is the printing plate will now be described with which the simplicity, which is the characteristic of the present invention, can be exhibited.

Figure 9:
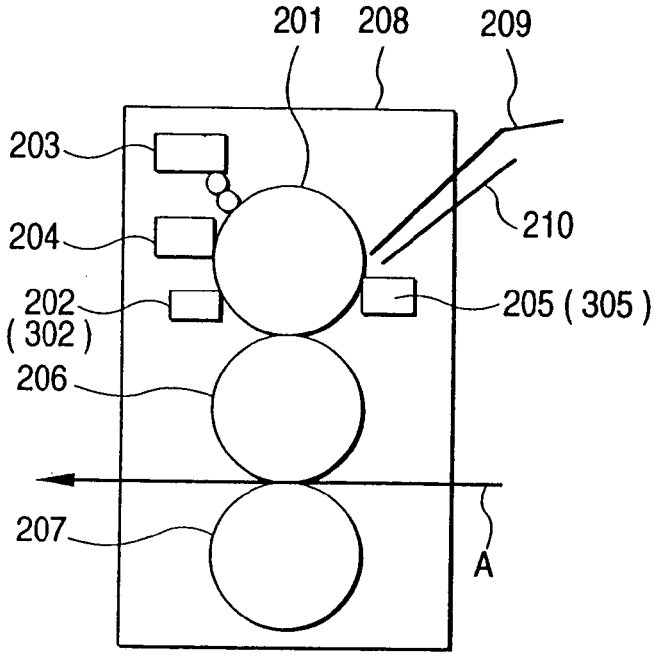
FIG. 9 is a diagram showing the structure of an offset printing apparatus according to a seventh embodiment of the present invention.

FIG. 9 is a diagram showing the structure of the offset printing apparatus according to a seventh embodiment of the present invention. As shown in FIG. 9, the offset printing apparatus according to the first embodiment of the present invention incorporates a printing cylinder 201 having the surface which incorporates a thermal response substance, such as titanium oxide or zinc oxide, having the photocatalyst function; a heating unit 202 for performing heating the printing cylinder 201 at the hydrophobicity developing temperature to cause the overall surface of the printing plate to have the hydrophobic nature; an irradiation unit 205 for irradiating the printing cylinder 201, the overall surface of which has been made to be hydrophobic, with activation light to correspond to an image to form distribution of hydrophilic regions and hydrophobic regions corresponding to an image; an ink/dampening water supply unit 203 for supplying ink and dampening water to the printing cylinder 201 on which an image has been recorded in the heat mode; an ink cleaning unit 204 for removing ink left on the printing cylinder 201 after the printing operation has been completed; a blanket 206 serving as an intermediate member for transferring ink held on the printing cylinder 201 to paper; and an impression drum 207 for holding supplied paper together with the blanket 206. The foregoing elements are accommodated in a body 208. As described later, the body 208 is provided with a film supply unit 210 for supplying lith film 209 on which the original document has been printed and developed.

The heating unit 202 is provided with an electric heater having a thermostat. Thus, the surface of the printing cylinder is maintained at a range of the hydrophobicity developing temperature. The electric heating method is suitable as the heating means. Also a heat radiation method may be employed which is a similar uniform plane heating method and which uses an infrared ray lamp with which the temperature can easily be adjusted. Any one of the foregoing heating method may be employed.

Figure 10:
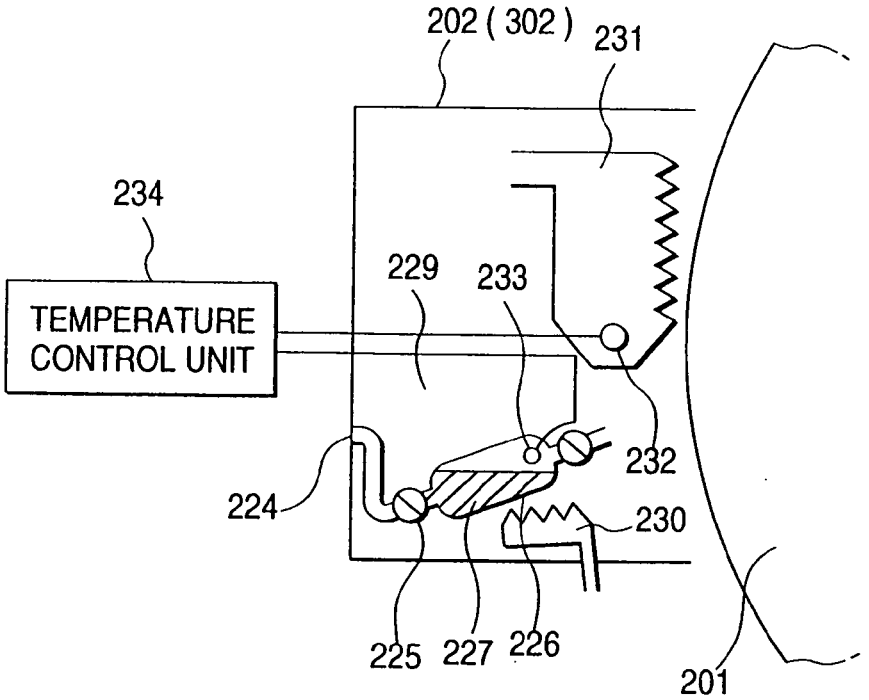
FIG. 10 is a diagram showing the heat unit of FIG. 9.

FIG. 10 shows an aspect of the heating unit 202 which incorporates an organic-compound steam supply means for enhancing the hydrophobic nature by heating the surface of the printing plate in an atmosphere containing organic compound steam.

Referring to FIG. 10, in the organic-compound steam supply means 229, air is introduced through an air intake opening 224 so as to be, through a cock 225, supplied to an evaporating chamber 226 in which a separating funnel having an inner diameter of about 30 mm is laterally placed. The evaporating chamber is filled with the organic compound 227 (indicated with diagonal lines) in such a manner that the capacity ratio is, for example, 50%. During passage of air through the organic compound 227 and the surface of the same, steam of the organic compound is introduced to the surface of the printing plate on the printing cylinder 201. Thus, recording is performed in an atmosphere of the mixture of air and steam.

The heating region in the mantle of the heating unit 202 is heated by an electric heater 231, while the evaporating chamber 226 is heated by an electric heater 230. The heating temperatures are controlled to be predetermined levels by temperature sensors 232 and 233 and a temperature control unit 234 provided for the heating region and the evaporating chamber 226.

The quantity of steam of the organic compound 227 is determined to be capable of enhancing the hydrophobic nature when the control unit 234 has set the heating temperature to be a predetermined hydrophobicity developing temperature. The temperature of the evaporating chamber 226 is set to realize the foregoing quantity. The temperature of the evaporating chamber is not raised in a case of an organic compound (for example, methylethylketone or methyl cellosolve) which has a low boiling point and which can easily be vaporized, the lower portion of the evaporating chamber is simply filled with the organic compound 227. In a case of a compound (for example, hexyleneglycol) having a relatively high boiling point and requiring another means, a structure is employed in which diaton earth, silica particles or zeolite having a high percentage of voids is placed in the evaporating chamber together with the organic compound 227 to raise the degree of contact with the introduced air and the organic compound. If the organic compound 227 is a solid material, such as naphthalene, it is charged into the evaporating chamber 226 at a proper percentage of voids. In a case of an organic compound having a furthermore high boiling point, a mechanism is employed which has a temperature control unit 234, an electric heater 230 and the sensor 233 and which is able to adjust the temperature in the evaporating chamber 226 to a level suitable to cause evaporation to occur. When, for example, silicon oil is used, diaton earth impregnated with silicon oil is placed in the lower half portion of the glass tube such that the capacity ratio is 50% and contact with air is permitted. The temperature of air is room temperature at the intake opening 224, and then the temperature is raised to 190° C. during passage through the tube by an electric heater (not shown).

As a matter of course, air containing the foregoing material is discharged to the outside portion. If necessary, air is purified before discharge.

The printing plate having the surface caused to have the hydrophobic nature in the heating unit 202 is heated by the irradiation unit 205 at the higher hydrophilicity developing temperature to correspond to the image.

Referring back to FIG. 9, the irradiation unit 205 according to this embodiment incorporates the mercury lamp to serve as the light source. The light source may be another light source, such as a xenon discharge lamp, a high luminance halogen-tungsten lamp. A slit formed perpendicular to a direction of rotation of the printing cylinder permits slight light to scan and expose the overall surface when the printing cylinder has been rotated. The width of the slit is not required to a narrow width. The luminance, the width of the slit and the rotational speed of the printing cylinder are determined in such a manner that the quantity of received light with which the surface of the printing plate can be made to be hydrophilic during passage through the activation heating unit 202 can be obtained. As an alternative to the slit, a so-called ore-pipe lamp house having an irradiation width corresponding to the width of the printing cylinder may be employed.

The irradiation unit 205 may have another structure a laser beam having image information is used as activation light in the irradiating process as a substitute for the developed lith film 209 supplied from the film supply unit 210 shown in FIG. 9.

For instance, the example shown in FIG. 3 described in connection with the first and fourth embodiments can be adopted.

Here, the laser beam should have an oscillation wavelength in the ultraviolet ray region, the visible ray region or a near infrared ray region and modulated with an image signal. In this embodiment, a helium-cadmium laser is mounted which emits a laser beam with which the surface of the printing cylinder is directly irradiated. As a result of light reactions owing to the irradiation of activation light, the surface has the hydrophilic nature. It is preferable that the width of the laser beam is about 30 μm and the energy density is 0.01 to 10 W. In general, as the intensity is raised, irradiation can preferably be completed in a shorter time.

The laser is required to emit activation light. An arbitrary laser may be selected from a semiconductor laser, a solid laser or another arbitrary laser.

Although the method has been described with which the laser beam is directly modulated, recording can, as a matter of course, similarly be performed when a combination of the laser beam and an external modulating device, such as an acoustic optical device, is employed.

The operation of the seventh embodiment will now be described.

The surface portion of the printing cylinder 201 rotates and passes through the high-temperature heating unit 202. The foregoing surface is changed from the hydrophilic nature to the hydrophobic nature owing to heating. The temperature of the heating portion is controlled by the temperature control unit 234 to satisfy the range of the hydrophobicity developing temperature. When the organic compound steam is contained in the heating atmosphere, the organic-compound steam supply means 229 causes the organic compound steam to be contained in the heating atmosphere. The printing cylinder having the overall surface caused to have the hydrophobic nature is, in the irradiation unit 205, irradiated with activation light having the distribution corresponding to the image owing to passage through the image mask or modulation with image information. Thus, distribution of hydrophilic regions and hydrophobic regions corresponding to an image is formed such that the irradiated region has the hydrophilic nature and the region which has not been irradiated with light has the lipophilic characteristic. After irradiation with activation light has been completed, ink and dampening water are supplied from the ink/dampening water supply unit 203 to the printing cylinder 201. As a result, ink is held in the lipophilic image region of the printing cylinder 201. On the other hand, no ink is held in the hydrophilic non-image region and dampening water is held.

Then, paper is supplied to a space between the blanket 206 and the impression drum 207 as indicated with an arrow A. Thus, ink held on the printing cylinder 201 is transferred to the paper through the blanket 206 so that offset printing is performed.

After printing has been completed, the ink cleaning unit 204 removes ink left on the printing cylinder 201. Then, the printing cylinder 201 is heated by the heating unit 202 at the hydrophobicity developing temperature so that the printing cylinder 201 has the hydrophobic nature. Thus, the hydrophilic regions on the printing cylinder 201 corresponding to the image are erased. Then, a state before recording in the heat mode is restored.

As described above, the offset printing apparatus according to the present invention is able to form a negative printing surface on the printing cylinder 201 only by high-temperature heating of the overall surface and by heating the overall surface of the printing cylinder 201 to form a uniform hydrophobic surface and by irradiation with activation light to correspond to the image. As a result, offset printing can be performed which does not require development and which is able to maintain the sharpness of the printing surface. When the printing cylinder 201 is cleaned and the overall surface is again heated, the initial state can be restored. Therefore, the printing cylinder 201 can repeatedly be used. As a result, prints can be provided at a low cost. Since the necessity for removing the printing cylinder 201 from the printing apparatus can be eliminated, adhesion of dust or the like experienced with the conventional PS plate and occurring when the printing cylinder 201 is mounted to the printing apparatus can be prevented. As a result, the quality of the print can be improved.

The printing cylinder 201 is employed as the printing plate. Moreover, the heating unit 202 arranged to perform heating at the hydrophobicity developing temperature, the ink/dampening water supply unit 203, the ink cleaning unit 204 and the irradiation unit 205 are disposed around the printing cylinder 201. Thus, simple rotation of the printing cylinder 201 enables the overall surface of the printing plate to have the hydrophilic nature, reference numeral with activation light to correspond to the image, supply of ink and dampening water to be performed and cleaning of ink to be performed after the printing operation has been performed. As a result, a compact apparatus can be realized, causing a required space to be saved.

The present invention in which a simple negative type plate making method is employed and which is structured to control the heating temperature to cause the overall surface to have the hydrophobic nature and irradiate the surface to correspond to the image with activation light. As compared the method with which activation light is directly irradiated to correspond to the image without the heating operation and the method with which control of the heating temperature to the hydrophobicity developing temperature is not performed if the heating scan is performed, the following advantages can be obtained: (1) a uniform hydrophobic surface can be obtained; (2) irradiation with activation light to correspond to the image can be performed immediately after the hydrophobic nature imparting process; and (3) no influence of the hysteresis is exerted and satisfactory reproducibility can be realized. As a result, an advantage can be obtained in that a printing plate exhibiting excellent distinguishing capability between the image regions and non-image regions can be manufactured with a satisfactory reproducibility. Another advantage can be obtained in that heating for realizing the hydrophobic nature in the presence of the organic compound enhances the hydrophobic nature. Thus, the effect of distinguishing the hydrophilic regions and the hydrophobic regions from each other can furthermore be improved. Therefore, the material can be selected from a wide range.

7-6. Examples of Embodiment

Some examples of the present embodiment will be discussed.

EXAMPLE 1

Using a printing plate prepared under the condition as same as Example 1 described in connection with the first embodiment (see section 1-6), the heating unit 202 (the evaporating chamber was not filled with the organic compound) was operated to perform electric heating at a controlled heating temperature of 200° C. Then, the printing cylinder was rotated at a rotational speed in such a manner that time required to complete passage through the heating portion was one minute. Then, contact angle meter CA-D (manufactured by Kyowa Interface Science Co., Ltd.) was operated to measure the contact angle of the surface with respect to water by a water drop method in air. As a result, all of the portions satisfied a range from 48 to 51 degrees.

Next, as the irradiation unit 205, US10 printing light source apparatus Unilec URM 600 GH60201X (manufactured by Ushio Inc.). The intensity of light was set to be 100 mW/cm$^2$ and the printing cylinder was rotated at a rotational speed with which the passing time was 15 seconds. The surface of the printing plate was exposed to activation light through a developed film supplied from the film supply unit 210. Then, contact angle meter CA-D (manufactured by Kyowa Interface Science Co. Ltd.) was operated to measure the contact angle of the surface with respect to water by a water drop method in air. As a result, all of the portions satisfied a range from 7 to 9 degrees.

The printing cylinder 201 was mounted to the single-side printing apparatus OLIVER-52 manufactured by Sakurai Graphic System Co., Ltd. Then, pure water serving as dampening water and ink which was Newchampion F-gloss 85 ink manufactured by Dainippon Ink & Chemicals, Incorporated were used in the ink/dampening water supply unit 203. Thus, offset printing was performed to make 1000 prints. Clear prints were obtained from start of the operation to the end of the same. Moreover, the printing cylinder 201 was free from any damage.

Then, the surface of the printing cylinder 201 was, in the ink cleaning unit 204, thoroughly cleaned with a waste impregnated with 1/1 mixed solution of printing ink cleaning solution DICLEAN R (released from Dainippon Ink & Chemicals Incorporated) and toluene so that ink was removed. Then, electric power was again supplied to the heating unit 202 so as to perform heating under the same conditions. After that, heating was again performed at 200° C. in the heating unit 202. Then, the contact angle was measured by a method similar to the above-mentioned process. All portions of the printing cylinder 201 satisfied a range from 48 to 55 degrees.

Then, the surface of the printing cylinder 201 was heated by the thermal head to correspond to the image.

The printing cylinder 201 was mounted to the single-side printing apparatus OLIVER-52 manufactured by Sakurai Graphic Systems Co., Ltd. Then, pure water serving as dampening water and ink which was Newchampion F-gloss 85 ink manufactured by Dainippon Ink & Chemicals Incorporated were used in the ink/dampening water supply unit 203. Thus, offset printing was performed to make 1000 prints. Clear prints were obtained from start of the operation to the end of the same. Moreover, the printing cylinder 201 was free from any damage.

The foregoing operation was repeated five times. As a result, no change occurred in the value of the contact angle realized after heating at the high temperature, recovery speed of the contact angle owing to heating and sharpness of the image on the printing surface.

Therefore, the printing plate having the aluminum support member on which the titanium oxide layer was formed and the printing apparatus according to the present embodiment enable printing to be performed by making the negative-type printing plate by irradiation with activation light to correspond to the image and heating at the hydrophobicity developing temperature. Moreover, the printing plate can repeatedly be reused only by removing ink by cleaning.

EXAMPLE 2

Under the condition as same as Example 2 described in the first embodiment (see section 1-6), similarly to Example 1, electric heating was performed at a controlled temperature of 200° C. The printing cylinder was rotated in such a manner that time required for the passage through the heating portion was one minute. The contact angle of the surface of the printing plate with respect to water was measured by the contact angle meter CA-D (manufactured by Kyowa Interface Science Co., Ltd.) by a water drop method in air. As a result, all of the portions satisfied a range from 50 to 57 degrees.

The Unilec URM 600 GH60201X which was the same as that employed in Example 1 was operated the surface of the printing plate was irradiated with activation light through a developed film to correspond to the image under the same conditions. Then, the contact angle of the surface of the printing plate irradiated with light with respect to water was measured by using the contact angle meter CA-D by the water drop in air method Thus, all of the irradiated regions displayed 10 to 13 degrees.

The printing cylinder 201 was mounted to the single-side printing apparatus OLIVER-52 manufactured by Sakurai Graphic System Co., Ltd. Then, pure water serving as dampening water and ink which was Newchampion F-gloss 85 ink manufactured by Dainippon Ink & Chemicals, Incorporated were used in the ink/dampening water supply unit 203. Thus, offset printing was performed to make 1000 prints: Clear prints were obtained from start of the operation to the end of the same. Moreover, the printing cylinder 201 was free from any damage.

Then, the surface of the printing cylinder 201 was, in the ink cleaning unit 204, thoroughly cleaned with a waste impregnated with 1/1 mixed solution of printing ink cleaning solution DICLEAN R (released from Dainippon Ink & Chemicals Incorporated) and toluene so that ink was removed. Then, electric power was again supplied to the heating unit 202 so as to perform heating under the same conditions. After that, electric power was again supplied to the heating unit 202 so as to perform heating under the same conditions. Then, the contact angle was measured by a method similar to the foregoing measurement in a state in which the temperature was lowered to the room temperatures. All portions of the surface satisfied a range from 50 to 57 degrees.

The Unilec URM 600 GH60201X which was the same as that employed in Example 1 was operated the surface of the printing plate was irradiated with activation light through a developed film to correspond to the image under the same conditions. Then, the contact angle of the surface of the printing plate irradiated with light with respect to water was measured by using Contact Angle Meter CA-D by the water drop in air method. Thus, all of the irradiated regions displayed 10 to 13 degrees.

The printing cylinder 201 was mounted to the single-side printing apparatus OLIVER-52 manufactured by Sakurai. Then, pure water serving as dampening water and ink which was Newchampion F-gloss 85 ink manufactured by Dai-Nippon Ink were used in the ink/dampening water supply unit 203. Thus, offset printing was performed to make 1000 prints. Clear prints were obtained from start of the operation to the end of the same. Moreover, the printing cylinder 201 was free from any damage.

As a result, the printing plate having the SUS support member on which the zinc oxide layer was formed and the printing apparatus according to the present embodiment enable printing to be performed by irradiation of the overall surface with activation light and heat mode printing. Moreover, the printing plate can repeatedly be reused only by removing ink by cleaning.

EXAMPLE 3

Under the condition as same as Example 3 described in the first embodiment (see section 1-6), the plate making process, printing, cleaning ink to remove the same and re-printing were performed similarly to Example As a result, the contact angle of the hydrophobic region with respect to water after heating was performed was 45 to 50 degrees in each of the first and second operations. The contact angle of the region irradiated with activation light was 10 to 14 degrees. The quality of the printing surface was free from contamination in each of the first and second operations. Moreover, the identifying characteristic between the image region and the non-image was satisfactory.

EXAMPLE 4

Under the condition as same as Example 4 described in the first embodiment (see section 1-6), the plate making process, printing, cleaning ink to remove the same and re-printing were performed similarly to Example 1.

As a result, the contact angle of the hydrophobic region with respect to water owing to high temperature heating was 48 to 52 degrees in each of the first and second operations. The contact angle of the region irradiated with activation light was 10 to 15 degrees. The quality of the printing surface was free from contamination in each of the first and second operations. Moreover, the identifying characteristic between the image region and the non-image was satisfactory.

EXAMPLE 5

The same method as that according to Example 1 was employed except for an argon laser which was employed as a substitute for Unilec URM 600 to apply activation light to correspond to an image and irradiation by modulating a laser beam with image information to form distribution corresponding to the image as a substitute for the developed lith film employed as the image mask. Thus, a printing plate was made to perform printing. Moreover, the printing plate was repeatedly used. The irradiation with the laser beam was performed such that the oscillation wavelength was 0.35 μm and the diameter of the beam was 30 μm. The intensity of the laser beam was 50 mW.

The contact angle of the hydrophilic region realized owing to irradiation with the laser beam with respect to water was 9 to 11 degrees in each of the first and second operations. The quality of the printing surface was free from contamination in each of the first and second operations. Moreover, the identifying characteristic between the image region and the non-image was satisfactory.

EXAMPLE 6

Plate making and printing, cleaning ink to remove the same and re-printing were performed by using the same printing, plate and the same apparatus as those according to Example 1 except for the process for introducing steam of the organopolysiloxane compound under the condition as same as Example 6 described in the first embodiment (see section 1-6).

As a result, a maximal contact angle of the image region on which an image was recorded in the heat mode with respect to water appeared when the temperature was 190° C. The value of the contact angle was 72 degrees. Then contact angle of the hydrophilic region irradiated with activation light to correspond to the image with respect to water was 9 to 11 degrees. No influence of silicon steam was exerted. The result was compared with the result in Example 1. When heating to the temperature at which hydrophobicity was developed performed in the presence of steam of organic silicon compound, the temperature at which the contact angle was made to be a maximal value was changed. However, the contact angle was considerably enlarged so that the identifying characteristic between the lipophilic characteristic and the hydrophilic nature was improved.

Then, the foregoing printing plate was used to perform offset printing to make 1000 prints. Similarly to Example 1, clear prints were obtained from start to completion. When the printing operation was continued to make 5000 prints, visible ink contamination occurs in Example 1 in which printing was performed without presence of silicon KF99. In Example 6 in which printing was performed in the presence of silicon KF99, no ink contamination was observed. Also the printing cylinder 201 was free from any damage.

EXAMPLE 7

Tubular heat recording was performed by the same method as that according to the foregoing embodiment except for the structure that silicon KF99 according to Example 6 was changed to organic compounds. Results were shown in Table 2. As can be understood from the table, the difference between the hydrophobic nature and the lipophilic characteristic of the image region and the non-image region can be made clearer. It leads to a fact that durability against increase in the number of prints was improved. In Table 2, contamination with ink was evaluated such that no contamination after 5000 prints were made was given mark o, and allowable range and visible contamination was given mark Δ.

TABLE 2

| organic compound | boiling point (° C.) | contact angle image region | contact angle non-image region | contamination |
|---|---|---|---|---|
| 2,2,4-trimethylpentane | 99 | 78 | 8 to 10 | ○ |
| cyclohexane | 131 | 75 | 8 to 10 | ○ |
| 1-dodecanol | 255 | 69 | 8 to 10 | ○ |
| n-hexadecane | 287 | 65 | 7 to 9 | ○ |
| no organic compound | | 46 | 7 to 9 | Δ |

EXAMPLE 8

Under the condition as same as Example 5 described in the fourth embodiment (see section 4-6), the plate making process, printing, cleaning ink to remove the same and re-printing were performed similarly to Example 1.

In this case, since Si absorbed applied infrared rays, the foregoing thin layer converted light energy into heat energy. That is, irradiation with infrared rays causes the Si layer to generate heat. Thus, heating of the barium titanate layer was permitted. The heating temperature was adjusted to satisfy the range (155 to 250° C.) of the hydrophobicity developing temperature by controlling the output of the laser beam.

The contact angle of the surface of the printing plate irradiated with the infrared-ray laser beam with respect to water was 49 to 56 degrees in each of the first and second operations. The contact angle of the hydrophilic region realized owing to irradiation with ultraviolet rays with respect to water was 12 to 16 degrees in each of the first and second operations. The quality of the printing surface was free from contamination in each of the first and second operations. Moreover, the identifying characteristic between the image region and the non-image was satisfactory.

8. Eighth Embodiment

An eighth embodiment of the present invention will now be described with reference to FIG. 6.

As well as the second embodiment, a printing apparatus according to the present embodiment can be realized by four printing units each of which is the offset printing apparatus of the seventh embodiment are in series disposed in a body 12. Thus, Y (yellow), M (magenta), C (cyan) and B (Black) ink is used to perform color printing.

Since the structure and operation of each of the printing units 11Y, 11M, 11C and 11B are the same as those of the offset printing apparatus of the seventh embodiment, they are omitted from description.

Since the structure and operation of each of the printing units 11Y, 11M, 11C and 11B are the same as those of the offset printing apparatus shown in FIG. 9, they are omitted from description. The eighth embodiment is different in that ink in Y (yellow), M (magenta), C (cyan) and B (Black) is supplied to the ink/dampening water supply portion of each of the printing units 11Y, 11M, 11C and 11B.

The operation of the eighth embodiment will now be described.

In the printing units 11Y, 11M, 11C and 11B, the surface of the printing plate allowed to pass through the heating unit 202 was caused to have the hydrophobic nature while the printing cylinder 201 was being slowly rotated. The structure of the heating portion was described with reference to FIG. 10. Therefore, the structure is omitted from description. The temperature of the heating atmosphere and the temperature of the evaporating chamber in a case where the organic compound was caused to present were controlled by the control unit (234 shown in FIG. 10). Therefore, optimum conditions are selected according to a fact whether or not the organic compound is present, the type of the organic compound and the type of the thermal response substance on the surface of the printing plate. The printing cylinder 201 was rotated at the speed with which a sufficient heating time elapsed so that the overall surface of the printing cylinder was caused to have the hydrophobic nature. Then, the irradiation unit 205 shown in FIG. 9 performs heating to correspond to the image so that recording corresponding to each color is performed. Ink in Y, M, C and B is supplied from the ink/dampening water supply portion of each of the printing units 11Y, 11M, 11C and 11B. Thus, ink and dampening water are held in the printing cylinder 201 of each of the printing units 11Y, 11M, 11C and 11B. Then, as indicated with an arrow B shown in FIG. 6, paper is supplied to transfer ink in each of the printing units 11Y, 11M, 11C and 11B to the paper. That is, ink in Y is transferred in the printing unit 11Y, ink in M is transferred in the printing unit 11M, ink in C is transferred in the printing unit 11C and ink in B is transferred in the printing unit 11B. As a result, a color image can be printed on the paper by the negative method.

After the printing operation has been completed, the ink cleaning portion of each of the printing units 11Y, 11M, 11C and 11B removes ink left on the printing cylinder. Then, while printing cylinder 201 is being slowly rotated, the heating unit 202 performs heating to cause the overall surface of the printing cylinder 201 is caused to have the hydrophobic nature. Then, the printing cylinder 201 is restored to a state before recording is performed in the heat mode. It is preferable that the process for imparting the hydrophobic nature is performed immediately before a next printing operation to prevent the influence of the hysteresis nature.

9. Ninth Embodiment

A ninth embodiment of the present invention will now be described with reference to FIGS. 7 and 8.

As well as the third embodiment, a printing apparatus according to the present embodiment can be realized by four printing units each of which is the offset printing apparatus of the seventh embodiment are, in the body 15, disposed as printing stations 14Y, 14M, 14C and 14B around the impression drum 7. Thus, ink in Y (yellow), M (magenta), C (cyan) and B (Black) is used to perform color printing.

Since the structure of the apparatus of the present embodiment is the same as that of the offset printing apparatus of the third embodiment, they are omitted from description.

The operation of the ninth embodiment will now be described.

Initially, in the printing stations 14Y, 14M, 14C and 14B, the printing cylinder is heated to a high temperature not lower than an intermediate temperature level so that the overall surface of the printing cylinder is made to be hydrophilic. Then, images in the foregoing colors are, in the active-light irradiating portion, are recorded in the negative mode such that heating is performed to correspond to the image so as to realize the hydrophilic nature. Ink in Y, M, C and B is supplied from the ink/dampening water supply portion of each of the printing stations 14Y, 14M, 14C and 14B to cause ink to be held on the printing cylinder 201 of each of the printing stations 14Y, 14M, 14C and 14B. Then, paper is supplied as indicated with an arrow C shown in FIG. 7, and then paper is conveyed around the impression drum 7. Thus, ink in each of the printing stations 14Y, 14M, 14C and 14B is transferred to the paper. That is, ink in Y is transferred in the printing station 14Y, ink in M is transferred in the printing station 14M, ink in C is transferred in the printing station 14C and ink in B is transferred in the printing station 14B. Thus, a color image is printed on the paper.

After the printing operation has been completed, ink left on the printing cylinder is removed by the ink cleaning portion of each of the printing stations 14Y, 14M, 14C and 14B. Then, the printing cylinder is heated under the same conditions as those in the above-mentioned process. Thus, the printing cylinder is restored to a state before recording is performed by using activation light.

In the eighth and ninth embodiments, the four printing units 11Y, 11M, 11C and 11B or the four printing stations 14Y, 14M, 14C and 14B are employed to perform color printing. Five or more printing units or printing stations may be employed to perform color printing.

In the seventh to ninth embodiments, the printing cylinder 201 is employed. Note that the present invention is not limited to this. As a matter of course, the present invention can be applied to a structure in which a sheet-shape printing plate is used to perform offset printing.

In the seventh to ninth embodiments, the heating unit 202, the ink cleaning unit 204, the ink/dampening water supply unit 203 and the irradiation unit 205 are clockwise disposed. The structure is not limited to this. The disposing order may arbitrarily be determined.

In each of the embodiments and examples, the present invention is not limited to the above-mentioned thermal response substance. An arbitrary thermal response substance may be selected from the foregoing materials.

The printing method according to the present invention is configured such that the thermal response substance, in particular, the thermal response metal and metal oxide described in the specification are employed to form the image forming layer so that the printing plate is made. Then, the surface of the printing plate is irradiated with activation light to correspond to an image to form distribution of hydrophilic regions and hydrophobic regions corresponding to an image. Thus, the printing plate is made. According to the present invention, the process, such as development, is not required. Thus, the printing plate can directly be reproduced and repeatedly used. Moreover, ink on the printing plate is removed after the printing operation has been completed to permit reproduction and repeated use of the printing plate. In addition, the printing apparatus structured such that the printing plate is mounted to the printing cylinder of the printing machine to perform conversion to the hydrophilic nature, recording in the heat mode, supply of ink/dampening water and reproduction of the printing plate is used to perform simple and low-cost offset printing. The method and apparatus according to the present invention employ the negative plate making method which exhibits excellent capability of distinguishing image regions and non-image regions as compared with the as compared with the plate making method and printing method with which no adjustment to the hydrophobicity developing temperature region is performed and irradiation with activation light to correspond to the image is performed. Moreover, a system for emitting activation light is not required. Moreover, an advantage can be realized in that also the material for forming the image is not required to have the photocatalyst function. Therefore, the material can be selected from a wide range.

10. Tenth Embodiment

A tenth embodiment of the present invention will now be described.

10-1. Thermal Responsive Substance

The material of the printing plate according to the present embodiment is the substance having a "thermal response characteristic" described above.

The materials described in connection with the tenth embodiment can be adopted as the above "thermal responsive substance". Since the same discussion can be applied, detailed explanations are omitted.

10-2. Printing Plate

The structure of the printing plate according. to the present embodiment will now be described.

The printing plate according to the present embodiment may be structured variously and made of any one of a variety of materials. Specifically, the materials and the structure described in connection with the fourth embodiment can be adopted. Since the same discussion can be applied, detailed explanations are omitted.

10-3. Printing Method

Next, a printing method according to the present embodiment will be discussed.

According to the present embodiment, heating is performed at the proper hydrophobicity developing temperature except for the higher hydrophilicity developing temperature, the overall surface is caused to have the hydrophobic nature. Thus, the surface is heated at the higher hydrophilicity developing temperature to correspond to the image. As a result, negative hydrophobic and hydrophilic image distribution in which the region heated to the image has the hydrophilic nature can be obtained.

The present invention is characterized by using the thermal response characteristic to perform heating at the hydrophobicity developing temperature and heating at the higher hydrophilicity developing temperature to correspond to the image. Thus, a uniform hydrophobic surface, an excellent effect of distinguishing the hydrophobic regions and hydrophilic regions from one another. Moreover, a negative type plate making method is realized with which excellent reproducibility free from hysteresis nature of the printing plate during preservation can be realized. By using the foregoing characteristics, a printing plate exhibiting excellent capability of distinguishing image regions and non-image region can be manufactured with satisfactory reproducibility.

Another advantage can be obtained in that simplicity can be realized with which only two steps of heating processes including uniform heating and heating corresponding to an image are required to make the printing plate.

Moreover, the organic compound (to be described later) caused to present in the atmosphere of the hydrophobicity developing temperature enhances the hydrophobic nature. Thus, the effect of distinguishing the hydrophilic regions and the hydrophobic regions from each other can furthermore be improved. As a result, the quality of the printing plate can be improved.

The heating means for forming the hydrophilic image portion on the printing plate having the hydrophobic nature may be a solid laser for radiating infrared rays, a semiconductor laser for radiating infrared ray region light or a visible ray region light, an infrared ray lamp, xenon discharge lamp, a photothermal conversion drawing apparatus incorporating a large-capacity capacitor with which discharge is performed to emit flash light or a direct image recording means incorporating a heat fusion type or a sublimation thermal pigment transfer type thermal recording head.

To adjust the heating temperature to the. higher hydrophilicity developing temperature which is higher than the hydrophobicity developing temperature, the intensity of light for use in the heating operation is controlled or the electric power which is supplied to the thermal recording head is controlled.

Heating which is performed to correspond to an image by the light heating method may be performed by either of a plane exposing method or scanning method. The former method is a method with which infrared rays are applied or a method with which short-time light emitted from a xenon discharge lamp and having a high luminance is applied to the surface of the printing plate through a mask image to generate heat by photothermal conversion. When a plane exposing light source, such as the infrared ray lamp is employed, the preferred quantity of exposure varies depending on the luminance. It is usually preferable that the intensity of the plane exposure before modulation with the image which must be printed is performed satisfies a range from 0.1 to 10 J/cm$^2$, more preferably a range from 0.3 to 1 J/cm$^2$. When the support member is a transparent member, exposure can be performed from the reverse side of the support member through the support member and the mask image. It is preferable that exposure luminance is determined in such a manner that the foregoing exposing intensity can be obtained when the exposure duration is 0.01 μsec to 1 msec, preferably 0.01 μsec to 0.1 msec. When the irradiation is performed for a long time, the exposing intensity must be raised because of a competitive relationship between the rate at which thermal energy is generated and the diffusion rate of the generated thermal energy.

In the latter case, a method is employed which uses a laser beam source to modulate an image with a laser beam to scan the surface of the printing plate. The laser beam source is exemplified by a semiconductor laser, a gas laser, a helium neon laser, a helium-cadmium laser and a YAG laser. The output of the laser beam is 0.1 to 300 W. When a pulse laser is employed, it is preferable that laser beams having a peak output of 1000 W, preferably 2000 W is applied. When the support member is a transparent support member, for example, a photothermal converting layer may be provided for the printing plate. Thus, the foregoing layer absorbs light energy to generate heat. As an alternative to this, the thermal responsive substance is caused to absorb light to generate heat for use in the heating process.

The contact heating method is arranged to employ a known contact recording apparatus, for example, a thermal fusion type thermal recording head or a sublimation thermal pigment transfer type thermal recording head is employed. In the foregoing case, a known thermal recording device may be employed which uses a method for two-dimensionally operating a single thermal recording device, a method which uses an array formed by linearly disposing thermal recording devices to perform scanning in a right-angle direction to record an image or a high speed drawing method which uses recording devices disposed two-dimensionally. In this specification, thermal recording and thermal recording have the same meaning to perform a recording operation to correspond to the image.

The printing plate is processed such that a negative-type lipophilic-hydrophilic image distribution is formed on the surface of the thermal responsive substance. Then, the printing plate can directly be supplied to an offset printing step without a necessity of performing a developing process.

Therefore, a multiplicity of advantages including the easiness and simplicity can be realized as compared with a usual and conventional flat-plate printing method. That is, the foregoing chemical process using alkali developing solution is not required. Therefore, a wiping operation and a brushing operation are not required. Moreover, discharge of waste of the developing solution causing a load on the environment can be omitted.

Another discussions related to the printing method are substantially the same with the discussion described in connection with the first embodiment (see section 1-3). Thus, detailed explanations are omitted.

10-4. Reuse of Printing Plate

The region of the flat printing plate corresponding to the image and heated at the high temperature has the sufficient hydrophilic nature. If necessary, a post-treatment may be performed by using cleaning water, a rinsing solution containing a surface active agent or the like or a desensitizer containing arabic gum or a starch derivative. As the post-treatment which is performed when the image recording material according to the present invention is used as the material of the printing plate, the foregoing processes may variably be combined with one another.

As the post-treatment, any one of the following methods may be employed: a method with which sponge or absorbent cotton impregnated with the foregoing surface treatment solution is used to apply the solution to the surface of the flat printing plate, a method with which the printing plate is immersed in a vat filled with the surface treatment solution to apply the solution and a method with which an automatic coater is used. When a squeeze or a squeeze roller is used to uniform the quantity of application after the application has been performed, a preferred result can sometimes be obtained. In general, it is preferable that the quantity of application of the surface treatment solution is 0.03 to 0.8 $g/m^2$ (dry weight).

The flat printing plate obtained as a result of the foregoing processes is mounted on an offset printing machine or the like or made on the printing machine to print a multiplicity of sheets.

A step for reproducing the printing plate used in the printing process will now be described.

Ink allowed to adhere to the printing plate after it has been used in the printing operation is removed by a cleaning operation by using petroleum solvent. As the solvent, marketed printing ink dissolving solution is employed which is made of aromatic hydrocarbon which is, for example, kerosene, isoperm, benzole, toluole, xylol, acetone, methylethylketone and their mixed solvent. When the image substance is not dissolved, a cloth or the like is used to wipe off the same with a light load. When 1/1 mixed solvent of toluene/dieclean is used, a satisfactory result is sometimes obtained.

When the printing plate from which ink has been removed by cleaning is heated to the hydrophobicity developing temperature by the above-mentioned method. Thus, the overall surface of the printing cylinder is able to restore the hydrophobic nature. The heating process may be performed at arbitrary timing from a moment printing ink has been removed by cleaning to a moment irradiation with active light to correspond to the image is performed in a next plate making process. It is preferable that the irradiation is performed when the printing plate is reused in a next plate making process from a view point of eliminating an influence of the hysteresis nature during the preservation of the printing plate.

The number of times the printing plate according to the present invention is repeatedly reproduced is not completely detected. The number of times is 15 or more. It is considered that the number of times is limited by contamination of the surface of the printing plate which cannot be removed, damage which cannot practically be repaired and mechanical deformation (distortion) of the material of the printing plate.

10-5. Printing Apparatus

Next, an apparatus in which the printing plate is mounted to perform printing will now be described with reference to FIG. 9.

The printing plate having the surface which incorporates the thermal responsive substance having the photocatalyst function may be secured as a component of a printing cylinder or structured to be detachable. In the following description, a former example in which the printing cylinder is the printing plate will now be described with which the simplicity, which is the characteristic of the present invention, can be exhibited.

FIG. 9 can be used for explaining the present embodiment by replacing the heating unit 202 with a heating unit 302 and the irradiation unit 205 with a thermal recording unit 305. The heating unit 302 is provided for heating the printing cylinder 201 at the hydrophobicity developing temperature in order to make the whole surface of the printing plate hydrophobic. The thermal recording unit 305 is provided for heating the hydrophobic printing plate at the higher hydrophilicity developing temperature in order to form an hydrophilic-hydrophobic image distribution thereon. As the heating unit 302, the configuration shown in FIG. 10 can be adopted. The same reference numerals can be used with any other members, and detailed explanations are omitted.

The thermal recording unit 305 according to this embodiment incorporates the thermal recording head. A known contact heating recording apparatus may be employed. In this embodiment, a thermal head incorporates a tantalum-silica heating resistor on which a SIALON wear resisting protective layer is formed. A thermal recording unit having the above-mentioned thermal heads disposed perpendicular to the direction of rotation of the printing cylinder is employed. Thus, drawing is performed by heating the surface of the printing cylinder when the printing cylinder has been rotated. The temperature of the thermal head is raised to 450° C. owing to supply of electric power at a rate of 20 msec. Therefore, drawing at the higher hydrophilicity developing temperature is permitted. The recording method with which contact heating includes two-dimensional recording with which scanning of the one-dimensional unit in the perpendicular direction is performed, a two-dimensional scanning method using heating device or a one-dimensional block unit.

Another aspect of the thermal recording unit 305 may employ a method image information is caused to be held by a radiation rays of the photothermal converting characteristic to irradiate the surface of the printing plate as a substitute for the contact heat recording method, such as the thermal recording head. It is preferable that a heat mode drawing method using infrared laser beam is employed.

For example, the configuration shown in FIG. 3 can be adopted. When the printing cylinder 201 is rotated, the surface of the printing cylinder 201 is exposed with the modulated infrared-ray laser beam. Thus, the portions of the printing cylinder 201 which have not been irradiated with the infrared-ray laser beam are hydrophilic non-image regions, while the portion irradiated with the infrared-ray laser beam is the lipophilic image region. Thus, negative type recording is performed.

The laser may be any one of a semiconductor laser, a solid laser or another arbitrary laser if the laser is able to oscillate infrared rays. As a matter of course, it is preferable that the printing plate irradiated with light contains the photothermal conversion light absorbing substance.

Although the method has been described with which the laser beam is directly modulated, drawing can, as a matter of course, similarly be performed when a combination of the laser beam and an external modulating device, such as an acoustic optical device, is employed.

The operation of the tenth embodiment will now be described.

The surface portion of the printing cylinder 201 rotates and passes through the heating unit 302. The foregoing surface is changed from the hydrophilic nature to the hydrophobic nature owing to heating. The temperature of the heating portion is controlled by the temperature control unit 234 to satisfy the range of the hydrophobicity developing temperature. When the organic compound steam is contained in the heating atmosphere, the organic-compound steam supply means 229 causes the organic compound steam to be contained in the heating atmosphere. The printing cylinder having the overall surface caused to have the hydrophobic nature is contact-heated by the thermal recording unit in the thermal recording unit 305. As an alternative to this, the printing cylinder is irradiated with infrared-ray laser beam modulated with image information. Thus, the distribution of image of hydrophilic and hydrophobic natures can be obtained in which the heated regions have the hydrophilic nature and the regions which have not been heated have the hydrophobic nature. After heating at the higher hydrophilicity developing temperature to correspond to the image has been completed, ink and dampening water are supplied from the ink/dampening water supply unit 203 to the printing cylinder 201. As a result, ink is held in the lipophilic image region of the printing cylinder 201. On the other hand, no ink is held in the hydrophilic non-image region and dampening water is held.

Then, paper is supplied to a space between the blanket 206 and the impression drum 207 as indicated with an arrow A. Thus, ink held on the printing cylinder 201 is transferred to the paper through the blanket 206 so that offset printing is performed.

After printing has been completed, the ink cleaning unit 204 removes ink left on the printing cylinder 201. Then, the printing cylinder 201 is heated by the heating unit 302 at the hydrophobicity developing temperature so that the printing cylinder 201 has the hydrophobic nature. Thus, the hydrophilic regions on the printing cylinder 201 corresponding to the image are erased. Then, a state before recording in the heat mode is restored.

As described above, the offset printing apparatus according to the present invention is able to form a negative printing surface on the printing cylinder 201 only by high-temperature heating of the overall surface and by heating the overall surface of the printing cylinder 201 to form a uniform hydrophobic surface and by performing heating at the higher hydrophilicity developing temperature to correspond to the image. As a result, offset printing can be performed which does not require development and which is able to maintain the sharpness of the printing surface. When the printing cylinder 201 is cleaned and the overall surface is again heated at the hydrophobicity developing temperature, the initial state can be restored. Therefore, the printing cylinder 201 can repeatedly be used. As a result, prints can be provided at a low cost. Since the necessity for removing the printing cylinder 201 from the printing apparatus can be eliminated, adhesion of dust or the like experienced with the conventional PS plate and occurring when the printing cylinder 201 is mounted to the printing apparatus can be prevented. As a result, the quality of the print can be improved.

The printing cylinder 201 is employed as the printing plate. Moreover, the heating unit 302 arranged to perform heating at the hydrophobicity developing temperature, the ink/dampening water supply unit 203, the ink cleaning unit 204 and the thermal recording unit 305 disposed around the printing cylinder 201. Thus, simple rotation of the printing cylinder 201 enables the overall surface of the printing plate to have the hydrophilic nature, reference numeral with active light to correspond to the image, supply of ink and dampening water to be performed and cleaning of ink to be performed after the printing operation has been performed. As a result, a compact apparatus can be realized, causing a required space to be saved.

The present invention in which a simple negative type plate making method is employed and which is structured to perform heating at the higher hydrophilicity developing temperature to correspond to the image does not require control of the heating temperature without a heating operation or with the heating operation. As compared with the method with which active light is irradiated to correspond to the image, the following advantages can be obtained: (1) a uniform hydrophobic surface can be obtained; (2) heating at the high temperature corresponding to the image can immediately be performed after the process for realizing the hydrophobic nature has been performed so that the process is completed simply and quickly; and (3) no influence of the hysteresis nature is exerted and satisfactory reproducibility can be realized. As a result, an advantage can be obtained in that a printing plate exhibiting excellent distinguishing capability between the image regions and non-image regions can be manufactured with a satisfactory reproducibility. Another advantage can be obtained in that heating for realizing the hydrophobic nature in the presence of the organic compound enhances the hydrophobic nature. Thus, the effect of distinguishing the hydrophilic regions and the hydrophobic regions can furthermore be improved. Since the material of the printing plate is required to have the thermal response characteristic, the photocatalyst function is not required. Therefore, the material can be selected from a wide range.

10-6. Examples of Embodiment

Some examples of the present embodiment will be. discussed.

EXAMPLE 1

Using a printing plate prepared under the condition as same as Example 1 described in connection with the first embodiment (see section 1-6), the heating unit 302 (the evaporating chamber organic compound) was operated to perform electric heating at a controlled heating temperature of 200° C. Then, the printing cylinder was rotated at a rotational speed in such a manner that time required to complete passage through the heating portion was one minute. Then, the contact angle meter CA-D (manufactured by Kyowa Interface Science Co., Ltd. Co., Ltd.) was operated to measure the contact angle of the surface with respect to water by a water drop method in air. As a result, all of the portions satisfied a range from 48 to 55 degrees.

Then, a heating-member array incorporating 150 μm×150 μm thermal heads each of which was structured such that a SIALON wear resisting protective layer was formed on a Ta—$SiO_2$ heating resistor and disposed apart from one another for a distance of 250 μm in the thermal recording unit 305 was used so as to be brought into contact with the surface layer of titanium oxide so that printing of characters was performed at raised temperature. The operated thermal heed was heated to 220° C. owing to supply of electric power for 2 msec and 490° C. owing to supply of electric power for 5 msec. When electric power was continuously supplied while the surface of the anode oxide film having a low heat conductivity was being scanned at 2.5 m/sec, a fact was confirmed that the surface was maintained at substantially 480° C. by performing an individual measurement of the temperature. The recording speed was 2.5 m/sec. At this time, the contact angle was estimated to be 100 or smaller from experimental example shown in FIG. 1. The actual contact angle with respect to water was 7° to 9° by performing measurement by the water drop method in air by using the contact angle meter CA-D (manufactured by Kyowa Interface Science Co., Ltd. Co., Ltd.).

The printing cylinder 201 was mounted to the single-side printing apparatus OLIVER-52 manufactured by Sakurai Graphic System Co., Ltd. Then, pure water serving as dampening water and ink which was Newchampion F-gloss 85 ink manufactured by Dainippon Ink & Chemicals, Incorporated were used in the ink/dampening water supply unit 203. Thus, offset printing was performed to make 1000 prints. Clear prints were obtained from start of the operation to the end of the same. Moreover, the printing cylinder 201 was free from any damage.

Then, the surface of the printing cylinder 201 was, in the ink cleaning unit 204, thoroughly cleaned with a waste impregnated with 1/1 mixed solution of printing ink cleaning solution DICLEAN R (released from Dainippon Ink & Chemicals Incorporated) and toluene so that ink was removed. Then, electric power was again supplied to the heating unit 302 so as to perform heating under the same conditions. Then, the heating unit 302 is again operated to perform heating at 200° C. Then, the contact angle was measured by a method similar to the foregoing measurement. As a result, all portions of the printing cylinder satisfied a range from 48 to 55 degrees.

Then, the surface of the printing cylinder 201 was heated by the thermal head to correspond to the image.

The printing cylinder 201 was mounted to the single-side printing apparatus OLIVER-52 manufactured by Sakurai Graphic Systems Co., Ltd. Then, pure water serving as dampening water and ink which was Newchampion F-gloss 85 ink manufactured by Dainippon Ink & Chemicals Incorporated were used in the ink/dampening water supply unit 203. Thus, offset printing was performed to make 1000 prints. Clear prints were obtained from start of the operation to the end of the same. Moreover, the printing cylinder 201 was free from any damage.

The foregoing operation was repeated five times. As a result, no change occurred in the value of the contact angle realized after heating at the hydrophobicity developing temperature, recovery speed of the contact angle owing to heating and sharpness of the image on the printing surface.

As a result, the printing plate having the aluminum support member on which the titanium oxide layer was formed and the printing apparatus according to the present embodiment enable printing to be performed by high temperature heating to the hydrophobic and by the thermal head to correspond to the image so that a negative printing plate is used to perform printing plate. Moreover, the printing plate can repeatedly be reused only by removing ink by cleaning.

EXAMPLE 2

Under the condition as same as Example 2 described in the first embodiment (see section 1-6), a method similar to that according to Example 1 was employed to perform electric heating at the control temperature of 200° C. The printing cylinder was rotated in such a manner that time required for the passage through the heating portion was one minute. The contact angle of the surface of the printing plate with respect to water was measured by the contact angle meter CA-D (manufactured by Kyowa Interface Science Co., Ltd. Co., Ltd.) by a water drop method in air. As a result, all of the portions satisfied a range from 50 to 57 degrees.

Then, a heating-member array incorporating 150 μm×150 μm thermal heads each of which was configured such that a SIALON wear resisting protective layer was formed on a Ta—$SiO_2$ heating resistor and disposed apart from one another for a distance of 250 μm in the thermal recording unit 5 was used so as to be brought into contact with the surface layer of zinc oxide so that printing of characters was performed at raised temperature. When the scanning speed of the thermal head was 2.5 m/sec, the surface of zinc oxide was maintained at 450° owing to supply of electric power. The foregoing fact was confirmed by performing measurement performed individually. Then, the contact angle meter CA-D (manufactured by Kyowa Interface Science Co., Ltd.) was operated to measure the contact angle of the irradiated surface with respect to water by a water drop method in air. As a result, all of the portions satisfied a range from 10 to 13 degrees.

The printing cylinder 201 was mounted to the single-side printing apparatus OLIVER-52 manufactured by Sakurai Graphic Systems Co., Ltd. Then, pure water serving as dampening water and ink which was Newchampion F-gloss 85 ink manufactured by Dainippon Ink & Chemicals Incorporated were used in the ink/dampening water supply unit 203. Thus, offset printing was performed to make 1000 prints. Clear prints were obtained from start of the operation to the end of the same. Moreover, the printing cylinder 201 was free from any damage.

Then, the surface of the printing cylinder 201 was, in the ink cleaning unit 204, thoroughly cleaned with a waste impregnated with 1/1 mixed solution of printing ink cleaning solution DICLEAN R (released from Dainippon Ink & Chemicals Incorporated) and toluene so that ink was removed. Then, electric power was again supplied to the heating unit 302 so as to perform heating under the same conditions. Then, the contact angle was measured by a method similar to the foregoing measurement in a state in which the temperature was lowered to the room temperatures. All portions of the printing cylinder 201 satisfied a range from 50 to 57 degrees.

Then, the thermal recording apparatus having the thermal head which was the same as that according to Example 1 was operated to perform thermal recording on the surface of the printing plate through a developed film under the same conditions. After the thermal recording operation was completed, the contact angle meter CA-D (manufactured by Kyowa Interface Science Co., Ltd.) was operated to measure the contact angle of the surface of the printing plate with respect to water by a water drop method in air. As a result, all of the portions satisfied a range from 10 to 13 degrees.

The printing cylinder 201 was mounted to the single-side printing apparatus OLIVER-52 manufactured by Sakurai Graphic Systems Co., Ltd. Then, pure water serving as dampening water and ink which was Newchampion F-gloss 85 ink manufactured by Dainippon Ink & Chemicals Incorporated were used in the ink/dampening water supply unit 203. Thus, offset printing was performed to make 1000 prints. Clear prints were obtained from start of the operation to the end of the same. Moreover, the printing cylinder 201 was free from any damage.

As a result, the printing plate having the SUS support member on which the zinc oxide layer was formed and the printing apparatus according to Example 1 enable printing to be performed by performing heating at the hydrophobicity developing temperature and heat mode printing. Moreover, the printing plate can repeatedly be reused only by removing ink by cleaning.

EXAMPLE 3

Under the condition as same as Example 3 described in the first embodiment (see section 1-6), the plate making process, printing, cleaning ink to remove the same and re-printing were performed similarly to Example 1.

The contact angle of the hydrophilic region with respect to water owing to high temperature heating was 45 to 50 degrees in each of the first and second operations. The contact angle in the heat mode recording region was 10 to 14 degrees. Also the quality of the printing surface was free from contamination in each of the first and second operations. Moreover, the identifying characteristic between the image region and the non-image was satisfactory.

EXAMPLE 4

Under the condition as same as Example 4 described in the first embodiment (see section 1-6), the plate making process, printing, cleaning ink to remove the same and re-printing were performed similarly to Example 1.

In the foregoing case, applied infrared rays were absorbed by the Si. Therefore, the foregoing thin layer serves as a member for converting light energy into heat energy. That is, irradiation with infrared rays causes the Si layer to generate heat. Thus, the barium titanate layer can be heated.

In accordance with a result of a comparison with a result of the test with which measurement was performed owing to contact with the thermal head, a fact was detected that the temperature of the barium titanate layer in the light applied portion when the infrared laser drawing was performed under the foregoing conditions was 360° C.

The contact angle of the hydrophilic region with respect to water owing to high temperature heating was 14 to 20 degrees in each of the first and second operations. Also the quality of the printing surface was free from contamination in each of the first and second operations. Moreover, the identifying characteristic between the image region and the non-image was satisfactory.

EXAMPLE 5

Under the condition as same as Example 5 described in the first embodiment (see section 1-6), the plate making process, printing, cleaning ink to remove the same and re-printing were performed similarly to Example 1.

The contact angle of the hydrophilic region with respect to water owing to high temperature heating was 11 to 17 degrees in each of the first and second operations. Also the quality of the printing surface was free from contamination in each of the first and second operations. Moreover, the identifying characteristic between the image region and the non-image was satisfactory.

EXAMPLE 6

Under the condition as same as Example 6 described in the first embodiment (see section 1-6), the plate making process, printing, cleaning ink to remove the same and re-printing were performed similarly to Example 1.

A maximal contact angle of heated hydrophobic region with respect to water appeared when the temperature was 190° C. The value of the contact angle with respect to water was 70 degrees. The hydrophilic region irradiated with active light to correspond to the image with respect to water was 9 to 11 degrees. Therefore, no influence of silicon steam was exerted. The result was compared with the result in Example 1. When heating to the temperature at which hydrophobicity was developed performed in the presence of steam of organic silicon compound, the temperature at which the contact angle was made to be a maximal value was changed. However, the contact angle was considerably enlarged so that the identifying characteristic between the lipophilic characteristic and the hydrophilic nature was improved.

Then, the foregoing printing plate was used to perform offset printing to make 1000 prints. Similarly to Example 1, clear prints were obtained from start to completion. When the printing operation was continued to make 5000 prints, visible ink contamination occurs in Example 1 in which printing was performed without presence of silicon KF99. In Example 6 in which printing was performed in the presence of silicon KF99, no ink contamination was observed. Also the printing cylinder 201 was free from any damage.

11. Eleventh Embodiment

An eleventh embodiment of the present invention will now be described with reference to FIG. 6.

As well as the second embodiment, a printing apparatus according to the present embodiment can be realized by four printing units each of which is the offset printing apparatus of the tenth embodiment are in series disposed in a body 12. Thus, Y (yellow), M (magenta), C (cyan) and B (Black) ink is used to perform color printing.

Since the structure and operation of each of the printing units 11Y, 11M, 11C and 11B are the same as those of the offset printing apparatus shown in FIG. 2, they are omitted from description. The second embodiment is different in that ink in Y (yellow), M (magenta), C (cyan) and B (Black) is supplied to the ink/dampening water supply portion of each of the printing units 11Y, 11M, 11C and 11B.

The operation of the eleventh embodiment will now be described.

In the printing units 11Y, 11M, 11C and 11B, the surface of the printing plate which passed through the heating unit 302 set to the temperature at which hydrophobicity was developed was caused to have the hydrophobic nature while the printing cylinder 201 was being rotated slowly. Since the structure of the heating unit has been described with reference to FIG. 10, the temperature of the heating atmosphere and the temperature in the evaporating chamber in a case where the organic compound is caused to present are controlled by the control unit (234 shown in FIG. 10). Therefore, optimum conditions are selected according to a fact whether or not the organic compound is present, the type of the organic compound and the type of the thermal responsive substance on the surface of the printing plate. The printing cylinder 201 was rotated at the speed with which a sufficient heating time elapsed so that the overall surface of the printing cylinder was caused to have the hydrophobic nature. Then, the thermal recording unit 305 shown in FIG. 9 performs heating to correspond to the image so that drawing corresponding to each color is performed. Ink in Y, M, C and B is supplied from the ink/dampening water supply portion of each of the printing units 11Y, 11M, 11C and 11B. Thus, ink and dampening water are held in the printing cylinder 201 of each of the printing units 11Y, 11M, 11C and 11B. Then, as indicated with an arrow B shown in FIG. 6, paper is supplied to transfer ink in each of the printing units 11Y, 11M, 11C and 11B to the paper. That is, ink in Y is transferred in the printing unit 11Y, ink in M is transferred in the printing unit 11M, ink in C is transferred in the printing unit 11C and ink in B is transferred in the printing unit 11B As a result, a color image can be printed on the paper by the negative method.

After the printing operation has been completed, the ink cleaning portion of each of the printing units 11Y, 11M, 11C and 11B removes ink left on the printing cylinder. Then, while printing cylinder 201 is being slowly rotated, the heating unit 302 performs heating to cause the overall surface of the printing cylinder 201 is caused to have the hydrophobic nature. Then, the printing cylinder 201 is restored to a state before recording is performed in the heat mode. It is preferable that the foregoing hydrophobic nature imparting process is performed immediately before a next printing operation is performed from a viewpoint of eliminating an influence of the hysteresis nature.

12. Twelfth Embodiment

A ninth embodiment of the present invention will now be described with reference to FIGS. 7 and 8.

As well as the third embodiment, a printing apparatus according to the present embodiment can be realized by four printing units each of which is the offset printing apparatus of the tenth embodiment are, in the body 15, disposed as printing stations 14Y, 14M, 14C and 14B around the impression drum 7. Thus, ink in Y (yellow), M (magenta), C (cyan) and B (Black) is used to perform color printing.

Since the structure of the apparatus of the present embodiment is the same as that of the offset printing apparatus of the third embodiment, they are omitted from description.

The operation of the third embodiment will now be described.

Initially, in the printing stations 14Y, 14M, 14C and 14B, the printing cylinder is heated to a high temperature not lower than an intermediate temperature level so that the overall surface of the printing cylinder is made to be hydrophilic. Then, images in the foregoing colors are, in the high-temperature thermal recording portion, are recorded in the negative mode such that heating is performed to correspond to the image so as to realize the hydrophilic nature. Ink in Y, M, C and B is supplied from the ink/dampening water supply portion of each of the printing stations 14Y, 14M, 14C and 14B to cause ink to be held on the printing cylinder 201 of each of the printing stations 14Y, 14M, 14C and 14B. Then, paper is supplied as indicated with an arrow C shown in FIG. 7, and then paper is conveyed around the impression drum 7. Thus, ink in each of the printing stations 14Y, 14M, 14C and 14B is transferred to the paper. That is, ink in Y is transferred in the printing station 14Y, ink in M is transferred in the printing station 14M, ink in C is transferred in the printing station 14C and ink in B is transferred in the printing station 14B. Thus, a color image is printed on the paper.

After the printing operation has been completed, ink left on the printing cylinder is removed by the ink cleaning portion of each of the printing stations 14Y, 14M, 14C and 14B. Then, the printing cylinder is heated under the same conditions as those in the above-mentioned process. Thus, the printing cylinder is restored to a state before recording is performed in the heat mode.

In the eleventh and twelfth embodiments, the four printing units 11Y, 11M, 11C and 11B or the four printing stations 14Y, 14M, 14C and 14B are employed to perform color printing. Five or more printing units or printing stations may be employed to perform color printing.

In the tenth to twelfth embodiments, the printing cylinder 201 is employed. Note that the present invention is not limited to this. As a matter of course, the present invention can be applied to a structure in which a sheet-shape printing plate is used to perform offset printing.

In the tenth to twelfth embodiments, the heating unit 302, the ink cleaning unit 204, the ink/dampening water supply unit 203 and the thermal recording unit 305 are clockwise disposed. The structure is not limited to this. The disposing order may arbitrarily be determined.

In each of the embodiments and examples, the present invention is not limited to the above-mentioned thermal responsive substance. An arbitrary thermal responsive substance may be selected from the foregoing materials.

The printing method according to the present invention is structured such that the thermal responsive substance, in particular, the thermal response metal and metal oxide described in the specification are employed to form the image forming layer so that the printing plate was made. Then, the printing plate is heated to the higher hydrophilicity developing temperature to make the surface to be hydrophilic to correspond to the image. Then, the distribution of image of hydrophilic and hydrophobic natures is formed to make the printing plate. The method according to the present invention does not require a developing process and the like. Thus, the printing can directly be made. Moreover, ink on the printing plate is removed after the printing operation has been completed to permit reproduction and repeated use of the printing plate. In addition, the printing apparatus structured such that the printing plate is mounted to the printing cylinder of the printing machine to perform conversion to the hydrophilic nature, drawing in the heat mode, supply of ink/dampening water and reproduction of the printing plate is used to perform simple and low-cost offset printing. The method and apparatus according to the present invention employ the negative plate making method which exhibits excellent capability of distinguishing image regions and non-image regions as compared with the as compared with the plate making method and printing method with which no adjustment to the hydrophobicity developing temperature region is performed and irradiation with active light to correspond to the image is performed. Moreover, a system for emitting active light is not required. Moreover, an advantage can be realized in that also the material for forming the image is not required to have the photocatalyst function. Therefore, the material can be selected from a wide range.

What is claimed is:

1. An offset printing method, comprising the steps of:

preparing a printing plate having a surface converted to hydrophilic due to light energy generated at a first temperature, the surface being converted to hydrophobic due to heat energy generated at a second temperature;

making forcibly the whole surface of the printing plate either one of hydrophobic or hydrophilic in nature;

forming a region having the other one nature of hydrophobic and hydrophilic on a part of the surface of the printing plate so as to correspond to an image to be printed;

supplying ink onto the region having the hydrophobic nature; and transferring the ink onto a printing medium to print the image, wherein the material on the printing plate has photocatalyst function, wherein the whole of the surface of the printing plate is made hydrophilic first by irradiating light having a wavelength activating the photocatalyst function, and then a part of the surface of the printing plate is heated at the second temperature to form a hydrophobic region, and wherein the hydrophobic region forming step is performed in an atmosphere in which an organic compound exists.

2. The offset printing method as set forth in claim 1, wherein the second temperature is 50 to 250° C.

3. The offset printing method as set forth in claim 1, wherein the claimed steps are repeated to reuse the printing plate after cleaning the surface thereof to remove ink left after the printing.

4. The offset printing method as set forth in claim 1, wherein the hydrophobic region forming step is performed by one recording means selected from a thermal transfer recording head and a photothermal converting type radiant rays.

5. The offset printing method as set forth in claim 1, wherein the organic compound has a vapor pressure of at least 1 mmHg or higher at 400° C., and is stable at the first temperature.

6. The offset printing method as set forth in claim 1, wherein the organic compound has a boiling point of 30 to 400° C., and is stable at the first temperature.

7. The offset printing method as set forth in claim 1, wherein the material on the printing plate is constituted by at least one of metal selected from a group consisting of elements belonging to third to sixth period of the periodic table and elements not belonging to group 0 and group VIIA (halogen elements) and a group of oxides of the metal.

8. An offset printing method, comprising the steps of:

preparing a printing plate having a surface converted to hydrophilic due to light energy generated at a first temperature, the surface being converted to hydrophobic due to heat energy generated at a second temperature;

making forcibly the whole surface of the printing plate either one of hydrophobic or hydrophilic in nature;

forming a region having the other one nature of hydrophobic and hydrophilic on a part of the surface of the printing plate so as to correspond to an image to be printed;

supplying ink onto the region having the hydrophobic nature; and transferring the ink onto a printing medium to print the image, wherein the material on the printing plate has photocatalyst function, wherein the whole of the surface of the printing plate is made hydrophobic first by heating at the second temperature, and then a part of the surface of the printing plate of the printing plate is irradiated by light having a wavelength activating the photocatalyst function to form a hydrophilic region, and wherein the hydrophobication step is performed in an atmosphere in which an organic compound exists.

9. The offset printing method as set forth in claim 8, wherein the second temperature is 50 to 250° C.

10. The offset printing method as set forth in claim 8, wherein the claimed steps are repeated to reuse the printing plate after cleaning the surface thereof to remove ink left after the printing.

11. The offset printing method as set forth in claim 8, wherein the organic compound has a vapor pressure of at least 1 mmHg or higher at 400° C., and is stable at the second temperature.

12. The offset printing method as set forth in claim 8, wherein the organic compound has a boiling point of 30 to 400° C., and is stable at the second temperature.

13. The offset printing method as set forth in claim 8, wherein the material on the printing plate is constituted by at least one of metal selected from a group consisting of elements belonging to third to sixth period of the periodic table and elements not belonging to group 0 and group VIIA (halogen elements) and a group of oxides of the metal.

* * * * *